US012527350B2

(12) United States Patent
Lomas et al.

(10) Patent No.: US 12,527,350 B2
(45) Date of Patent: Jan. 20, 2026

(54) AEROSOL DELIVERY DEVICE

(71) Applicant: Imperial Tobacco Limited, Bristol (GB)

(72) Inventors: Peter Lomas, Liverpool (GB); Chris Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 611 days.

(21) Appl. No.: 17/486,253

(22) Filed: Sep. 27, 2021

(65) Prior Publication Data

US 2022/0030941 A1 Feb. 3, 2022

Related U.S. Application Data

(63) Continuation of application No. PCT/EP2020/056087, filed on Mar. 6, 2020, and a
(Continued)

(30) Foreign Application Priority Data

Mar. 29, 2019 (EP) ..... 19166268
Mar. 29, 2019 (EP) ..... 19166294
(Continued)

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/48* (2020.01)

(58) Field of Classification Search
CPC ..... A24F 40/42; A24F 40/10; A24F 40/48
See application file for complete search history.

(56) References Cited

U.S. PATENT DOCUMENTS

2013/0167854 A1 7/2013 Shin
2014/0311503 A1 10/2014 Liu
(Continued)

FOREIGN PATENT DOCUMENTS

CN 201226775 Y 4/2009
CN 101731758 A 6/2010
(Continued)

OTHER PUBLICATIONS

International Search Report and Written Opinion (PCT/EP2020/056075); May 15, 2020; 8 pgs.
(Continued)

*Primary Examiner* — Michael H. Wilson
*Assistant Examiner* — Jennifer A Kessie
(74) *Attorney, Agent, or Firm* — Dunlap Codding, P.C.

(57) ABSTRACT

The present disclosure relates to an aerosol delivery device having a vaporizing chamber housing a vaporizer for vaporizing a vaporizable liquid and a transverse baffle mounted downstream from the vaporizer. The transverse baffle defines at least one aperture for chamber airflow path downstream of the vaporizer and an upstream face of the baffle facing the vaporizer comprises a recessed surface. It also relates to an aerosol delivery device where an upstream face of the baffle facing the vaporizer comprises at least one sloped surface and the at least one sloped surface slopes to at least one gutter on the upstream face of the baffle.

16 Claims, 23 Drawing Sheets

Related U.S. Application Data continuation of application No. PCT/EP2020/056090, filed on Mar. 6, 2020, and a continuation of application No. PCT/EP2020/056075, filed on Mar. 6, 2020, and a continuation of application No. PCT/EP2020/056088, filed on Mar. 6, 2020.

(30) Foreign Application Priority Data

Mar. 29, 2019 (EP) ..... 19166299
Mar. 29, 2019 (EP) ..... 19166301

(51) Int. Cl.
*A24F 40/46* (2020.01)
*A24F 40/48* (2020.01)

(56) References Cited

U.S. PATENT DOCUMENTS

| | | | | |
|---|---|---|---|---|
| 2015/0083147 | A1 | 3/2015 | Schiff et al. | |
| 2015/0181939 | A1 | 7/2015 | Liu | |
| 2015/0305409 | A1 | 10/2015 | Verleur et al. | |
| 2016/0015082 | A1 | 1/2016 | Liu | |
| 2016/0073692 | A1* | 3/2016 | Alarcon | A24F 40/40 131/329 |
| 2016/0374393 | A1 | 12/2016 | Chen | |
| 2018/0160727 | A1 | 6/2018 | Bauer | |
| 2018/0199627 | A1 | 7/2018 | Bowen et al. | |
| 2019/0021396 | A1 | 1/2019 | Vo et al. | |
| 2019/0223508 | A1* | 7/2019 | Otiaba | A24F 40/42 |
| 2022/0030941 | A1 | 2/2022 | Lomas et al. | |

FOREIGN PATENT DOCUMENTS

| | | | |
|---|---|---|---|
| CN | 203872998 | U | 10/2014 |
| CN | 203884697 | U | 10/2014 |
| CN | 104126876 | A | 11/2014 |
| CN | 204032365 | U | 12/2014 |
| CN | 207855027 | U | 9/2018 |
| CN | 108778384 | | 11/2018 |
| EP | 2460422 | A1 | 6/2012 |
| EP | 2712511 | A1 | 4/2014 |
| EP | 3053459 | A2 | 8/2016 |
| EP | 3287017 | A1 | 2/2018 |
| EP | 3292775 | A1 | 3/2018 |
| EP | 3315036 | A1 | 5/2018 |
| GB | 2515562 | A | 12/2014 |
| GB | 2550840 | A | 12/2017 |
| WO | WO2015188296 | A1 | 12/2015 |
| WO | WO2017163045 | A1 | 9/2017 |
| WO | WO2018029186 | A1 | 2/2018 |
| WO | WO2018060675 | A1 | 4/2018 |

OTHER PUBLICATIONS

International Search Report and Written Opinion (PCT/EP2020/056087); Apr. 1, 2020; 10 pgs.
International Search Report and Written Opinion (PCT/EP2020/056088); Apr. 3, 2020; 11 pgs.
International Search Report and Written Opinion (PCT/EP2020/056090); May 4, 2020; 11 pgs.
European Patent Office; Extended European Search Report regarding European Patent Application No. 19166268.3, filed Mar. 29, 2018, dated Sep. 23, 2019.
European Patent Office; Extended European Search Report regarding European Patent Application No. 19166294.9, filed Mar. 29, 2018, dated Oct. 9, 2019.
European Patent Office; Extended European Search Report regarding European Patent Application No. 19166299.8, filed Mar. 29, 2018, dated Oct. 18, 2019.
European Patent Office; Extended European Search Report regarding European Patent Application No. 19166301.2, filed Mar. 29, 2018, dated Oct. 10, 2019.
China National Intellectual Property Administration, First Office Action regarding 202080025500.4, Dec. 19, 2023; 9 pages. (English Translation attached).
China National Intellectual Property Administration, Second Office Action regarding Chinese Patent Application No. 202080025500.4, dated Sep. 5, 2024, with English translation.
European Patent Office, First Examination Report regarding European Patent application No. 20708103.5, dated Jun. 13, 2025, 5 pages.

* cited by examiner

AEROSOL DELIVERY DEVICE

CROSS REFERENCE TO RELATED APPLICATIONS/INCORPORATION BY REFERENCE STATEMENT

This application is a non-provisional application claiming benefit to the international application no. PCT/EP2020/056075 filed on Mar. 6, 2020, which claims priority to EP 19166268.3 filed on Mar. 29, 2019. This application also claims benefit to the international application no. PCT/EP2020/056087 filed on Mar. 6, 2020, which claims priority to EP 19166294.9 filed on Mar. 29, 2019. This application also claims benefit to the international application no. PCT/EP2020/056088 filed on Mar. 6, 2020, which claims priority to EP 19166299.8 filed on Mar. 29, 2019. This application also claims benefit to the international application no. PCT/EP2020/056090 filed on Mar. 6, 2020, which claims priority to EP 19166301.2 filed on Mar. 29, 2019. The entire contents of each of the above-referenced applications are hereby incorporated herein by reference in their entirety.

FIELD OF THE DISCLOSURE

In one aspect, the present disclosure relates to an aerosol delivery device, and, more particularly but not exclusively, to an aerosol delivery device for a smoking substitute system. In another aspect, the present disclosure relates to an aerosol delivery device, and, more particularly but not exclusively, to an aerosol delivery device having a filter. In another aspect, the present disclosure relates to a consumable for a smoking substitute device, a smoking substitute device, a method of manufacturing a consumable for a smoking substitute device and a manufacturing assembly and particularly, although not exclusively, to a consumable including an external adaptation for receipt of a filter. In another aspect, the present disclosure relates to an aerosol delivery device, and more particularly but not exclusively, to an aerosol delivery device having a vaporizer, and a pair of contact pins for electrically connecting the vaporizer to a power supply.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices, which may also be known as electronic nicotine delivery systems, may comprise electronic systems that permit a user to simulate the act of smoking by producing an aerosol, also referred to as a "vapor", which is drawn into the lungs through the mouth (inhaled) and then exhaled. The inhaled aerosol typically bears nicotine and/or flavorings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilizing a different smoking substitute approach. A smoking substitute approach corresponds to the manner in which the substitute system operates for a user.

One approach for a smoking substitute device is the so-called "vaping" approach, in which a vaporizable liquid, typically referred to (and referred to herein) as "e-liquid", is heated by a heater to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute device includes a mouthpiece, a power source (typically a battery), a tank or liquid reservoir for containing e-liquid, as well as a heater. In use, electrical energy is supplied from the power source to the heater, which heats the e-liquid to produce an aerosol (or "vapor") which is inhaled by a user through the mouthpiece.

Vaping smoking substitute devices can be configured in a variety of ways. For example, there are "closed system" vaping smoking substitute devices which typically have a heater and a sealed tank which is pre-filled with e-liquid and is not intended to be refilled by an end user. One subset of closed system vaping smoking substitute devices include a main body which includes the power source, wherein the main body is configured to be physically and electrically coupled to a consumable including the tank and the heater. In this way, when the tank of a consumable has been emptied, the main body can be reused by connecting it to a new consumable. Another subset of closed system vaping smoking substitute devices are completely disposable and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a vaporizer, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the vaporizer, which heats e-liquid from the tank to produce a vapor which is inhaled by a user through the mouthpiece.

Another example vaping smoking substitute device is the blu PRO™ e-cigarette. The blu PRO™ e cigarette is an open system device which includes a main body, a (refillable) tank, and a mouthpiece. The main body and tank are physically and electrically coupled together by screwing one to the other. The mouthpiece and refillable tank are physically coupled together by screwing one into the other, and detaching the mouthpiece from the refillable tank allows the tank to be refilled with e-liquid. The device is activated by a button on the main body. When the device is activated, electrical energy is supplied from the power source to a vaporizer, which heats e-liquid from the tank to produce a vapor which is inhaled by a user through the mouthpiece.

In prior art smoking substitute devices, some of the unvaporized e-liquid passes through the wick and to the mouthpiece. This may result in unvaporized e-liquid passing into the user's mouth, which may be unpleasant for the user. Further leakage occurs due to leakage paths present between the components of the consumable.

The present disclosure has been devised in light of the above considerations. Additionally, it is desirable to provide consumables which are easier and cheaper to manufacture.

SUMMARY OF THE DISCLOSURE

First Mode: An Aerosol Delivery Device in which a Baffle within a Vaporizing Chamber has a Face with a Barrier Adjacent an Aperture Through the Baffle At its most general, the first mode of the present disclosure relates to an aerosol delivery device in which an airflow-directing member (baffle) within a vaporizing chamber has a face with a barrier adjacent an aperture through the baffle. It also relates to an aerosol delivery device in which an airflow directing member (baffle) has a face with at least one sloped surface facing a vaporizer.

In a first aspect of the first mode, there is provided an aerosol delivery device having a vaporizing chamber housing a vaporizer for vaporizing a vaporizable liquid and a transverse baffle mounted downstream from the vaporizer, the transverse baffle defining at least one aperture for chamber airflow path downstream of the vaporizer wherein an upstream face of the baffle facing the vaporizer comprises a recessed surface.

In a second aspect of the first mode, there is provided an aerosol delivery device having a vaporizer for vaporizing a vaporizable liquid and a transverse baffle mounted downstream from the vaporizer, the transverse baffle defining at least one aperture for an airflow path downstream of the vaporizer wherein an upstream face of the baffle facing the vaporizer comprises at least one sloped surface, the sloped surface sloping to at least one gutter on the upstream face of the baffle.

The inclusion of a baffle downstream from the vaporizer may help to reduce (or prevent) un-vaporized liquid from the vaporizer passing to the user. The un-vaporized liquid may collect on the upstream face of the baffle facing the vaporizer, whilst vapor is able to pass through the aperture(s) defined by the baffle. By providing (in the first aspect) a recessed surface on the baffle, any unvaporized liquid is collected on the recessed surface is prevented from swept/sucked into the airflow path through the aperture. By providing (in the second aspect), a sloped surface on the upstream face of the baffle, any unvaporized liquid can be swept (by the airflow) into the gutter over the sloped surface where it can be trapped to prevent it from being swept/sucked into the airflow path through the aperture.

The terms "transversely" and "transverse" are used herein in relation to components of the device to describe a direction that is substantially perpendicular to the axial (longitudinal) direction of the device.

The device has a device airflow path extending from at least one inlet of the device to an outlet of the device. The term "upstream" is used to define a direction towards the inlet(s) of the device. The term "downstream" is used to define a direction towards the outlet of the device.

Optional features of the present disclosure will now be set out. These are applicable singly or in any combination with any aspect of the present disclosure.

In some embodiments of the first aspect, the recessed surface may comprise a planar surface. In other embodiments, the recessed surface may comprise one or more sloped surfaces sloping to one or more gutters as described for the second aspect.

The recessed surface may comprise a plurality of ridges and a plurality of gutters extending in a front to back direction of the device perpendicular to transverse and longitudinal directions of the device.

In some embodiments of the first aspect, the recessed surface is at least partly surrounded by a recess wall.

In some embodiments, the recess wall may be a substantially vertical wall. In this case, the substantially vertical wall is substantially vertical relative to the upstream face of the baffle. In other words, the recess wall may be substantially perpendicular to the upstream face of the baffle. In other embodiments, the recess wall may be a sloped wall. The sloped recess wall may form an obtuse angle where it meets the recessed surface of the baffle.

In some embodiments, the recessed surface is at least partly surrounded by a perimeter surface. The recess wall may extend (generally longitudinally) from the recessed surface to the perimeter surface of the upstream end face of the baffle.

In some embodiments, the recessed surface has a waist portion interposed between the apertures. The recessed surface may have at least one transversely elongated channel (e.g., two transversely elongated channels) on opposing sides of the waist portion in a front to back direction of the device (perpendicular to the transverse and longitudinal directions). The waist portion may be defined by opposing transverse recess walls that extend in a front to back direction of the device (perpendicular to the transverse and longitudinal directions). The transverse recess walls are adjacent the apertures. The waist portion has a smaller transverse width than the transversely elongated channels. The channels may extend transversely from the waist portion in both transverse directions so that the/each channel forms two laterally opposed pockets laterally outwards of the waist portion.

In the second aspect (and some embodiments of the first aspect) the upstream face of the baffle comprises one or more sloped surfaces sloping to one or more gutters. In some embodiments, there are a plurality of sloped surfaces sloping to a plurality of gutters.

The gutter(s) may be transverse gutters. The gutter(s) may extend in the front to back direction of the device (perpendicular to the transverse and longitudinal directions).

In some embodiments of the second aspect, the baffle comprises a recessed surface as described for the first aspect with the sloped surface(s) forming the recessed surface, e.g., within the recess wall.

In some embodiments, the gutter(s) may be provided in the or each channel of the recessed surface, i.e., there may be at least one sloped surface sloping to a gutter provided in at least one of the channels.

In some embodiments, the upstream face may comprise one or more pairs of sloped surfaces which meet at a ridge.

In one embodiment, the upstream face comprises a single transverse ridge joining a single pair of sloped surfaces, each sloped surface extending from the ridge to a respective gutter. The ridge may be parallel to the channels and the gutters may be provided in the channels.

In other embodiments, the upstream face comprises a plurality of ridges. The ridges may extend (e.g., between the channels) in a front to back direction of the device (perpendicular to the transverse and longitudinal directions). In these embodiments, there will be a plurality of parallel gutters aligned in the front to back direction of the device.

In some embodiments of the second aspect, the transverse baffle is provided in a vaporizing chamber which houses the baffle and a vaporizer (as in the first aspect).

Where the transverse baffle is provided in a vaporizing chamber, the device airflow path comprises a chamber airflow path extending through the aperture.

The chamber airflow path is partly defined by one or more walls of the vaporizing chamber.

The vaporizing chamber may comprise opposing parallel sidewalls that are substantially parallel to the longitudinal axis of the device, and a downstream (end) wall extending transversely between the sidewalls.

The at least one aperture may be defined by an upstream edge of the baffle (which may be flush with the perimeter surface of the upstream face of the baffle) and a facing sidewall of the chamber.

In some embodiments, the recess wall may extend from the upstream edge of the baffle to the recessed surface.

There may be two laterally opposed apertures, each defined by opposing upstream edges of the baffles and their facing side walls of the vaporizing chamber. The apertures may form notches in the upstream end face of the baffle that form the waist portion of the recessed surface with the transverse pockets of the elongated channels of the recessed surface being provided to the front and back of the apertures.

In some embodiments, the device comprises a passage extending longitudinally from the vaporizing chamber to the outlet of the device. In these embodiments, the chamber airflow path extends to a passage opening which may be provided in the downstream end wall of the vaporizing chamber.

The aperture(s) (and the upstream edge(s) of the baffle) may be offset transversely (i.e., laterally) from the longitudinal axis of the passage (e.g., may be radially outwards of the passage opening).

In some embodiments, the chamber airflow path, between the vaporizer and the passage, may comprise at least one deflection (e.g., at least one radial deflection). For example, a first portion of the chamber airflow path may extend in a generally longitudinal direction from the inlet to the vaporizer. A second portion of the chamber airflow path may deflect (radially) and extend generally radially from the vaporizer to the aperture. A third portion of the chamber airflow path extends generally longitudinally between the baffle and the vaporizing chamber side wall before deflecting radially into a fourth portion extending generally radially (laterally), e.g., generally parallel to a planar downstream face of the baffle, to the passage opening.

The chamber airflow path may then deflect as it enters the passage to extend in a generally longitudinal direction.

Where there are two apertures, the chamber airflow path may be bifurcated after the first portion.

The baffle may be configured (i.e., shaped and positioned) such that there is no direct longitudinal line of sight between the vaporizer and the passage. A transverse width of the baffle may be substantially the same or greater than a corresponding transverse width (or diameter) of the passage. A transverse cross-sectional area of the baffle may be substantially the same or greater than a transverse cross-sectional area of the passage. A transverse width of the baffle may be greater than 30% of a corresponding transverse width of the chamber, or may, e.g., be greater than 40%, or 50%.

The passage opening (i.e., the opening from the vaporizing chamber into the passage) may have a transverse cross-sectional area of more than 5 mm2. The passage opening may have a transverse cross-sectional area of no more than 10 mm2. The passage opening may have an internal diameter of more than 2.5 mm. The passage opening may have an internal diameter of no more than 4 mm. The transverse cross-sectional area of the or each aperture may be less than the cross-sectional area of the passage opening.

There may be an inlet substantially transversely aligned with the baffle (i.e., both may be aligned along a shared longitudinal axis). The inlet may be substantially transversely aligned with the passage opening (e.g., the inlet may be aligned on the longitudinal axis). The inlet, baffle and passage opening may be aligned along the longitudinal axis.

The device may comprise a tank (reservoir) for containing the vaporizable liquid (e.g., an e-liquid) with the vaporizer being in fluid communication with the tank. The e-liquid may, for example, comprise a base liquid and, e.g., nicotine. The base liquid may include propylene glycol and/or vegetable glycerin.

The tank may be defined by a tank housing. At least a portion of the tank housing may be translucent. For example, the tank housing may comprise a window to allow a user to visually assess the quantity of e-liquid in the tank. The tank may be referred to as a "clearomizer" if it includes a window, or a "cartomizer" if it does not.

The passage may extend longitudinally within the tank and a passage wall may define the inner wall of the tank. In this respect, the tank may surround the passage, e.g., the tank may be annular. The passage wall may comprise longitudinal ribs extending therealong. These ribs may provide support to the passage wall. The ribs may extend for the full length of the passage wall. The ribs may project (e.g., radially outwardly) into the tank.

The device may comprise an insert defining the device inlet(s). The insert may be inserted into an open end of the tank so as to seal against the tank housing. The insert may comprise an inner, longitudinally extending sleeve that defines the wall(s) of the vaporizing chamber and seals against the passage (e.g., seals against outer surfaces of the passage wall). The insert may be configured to support the vaporizer within the vaporizing chamber. The insert may be formed of silicone. The baffle may be formed of silicone. The insert and the baffle may be integrally formed.

The vaporizer may comprise a heater and a wick (e.g., comprising a porous material). The wick may be elongate and extend transversely across the chamber between wall(s) (e.g., sidewalls) of the chamber (which may be defined by the inner sleeve). In order to be in fluid communication with the tank, the wick extends into the tank, e.g., one or both of its opposing transverse ends may extend into the tank, e.g., through the wall(s) of the chamber/through the inner sleeve. In this way e-liquid may be drawn (e.g., by capillary action)

along the wick, from the tank to the exposed (central) portion of the wick. The wick may be oriented so as to align (in a direction of the longitudinal axis) with the or each aperture at least partly defined by the baffle (e.g., defined between the upstream edges and wall(s) of the chamber). In this respect, the chamber airflow path may pass around, through or proximal the wick and through the aperture(s). The upstream edge(s) (and downstream edge(s) of the baffle) may extend across the chamber in a direction that is substantially perpendicular to the direction of the extension of the wick.

In some embodiments, the gutters may be parallel to the wick. In other embodiments, the gutter(s) may extend perpendicularly to the wick.

The recess walls defining the elongated transverse channels of the recessed surface may be parallel to the wick. The transverse recess walls defining the waist portion of the recess may be perpendicular to the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in the chamber airflow path. This vapor may subsequently cool to form an aerosol in the vaporizing chamber.

The device may be in the form of a consumable. The consumable may be configured for engagement with a main body (i.e., so as to form a smoking substitute system). For example, the consumable may comprise components of the system that are disposable, and the main body may comprise non-disposable or non-consumable components (e.g., power supply, controller, sensor, etc.) that facilitate the delivery of aerosol by the consumable. In such an embodiment, the aerosol former (e.g., e-liquid) may be replenished by replacing a used consumable with an unused consumable.

The main body and the consumable may be configured to be physically coupled together. For example, the consumable may be at least partially received in a recess of the main body, such that there is snap engagement between the main body and the consumable. Alternatively, the main body and the consumable may be physically coupled together by screwing one onto the other, or through a bayonet fitting.

Thus, the consumable may comprise one or more engagement portions for engaging with a main body. In this way, one end of the device (i.e., the inlet end) may be coupled with the main body, whilst an opposing end (i.e., the outlet end) of the consumable may define a mouthpiece.

The main body or the consumable may comprise a power source or be connectable to a power source. The power source may be electrically connected (or connectable) to the heater. The power source may be a battery (e.g., a rechargeable battery). An external electrical connector in the form of, e.g., a USB port may be provided for recharging this battery.

The consumable may comprise an electrical interface for interfacing with a corresponding electrical interface of the main body. One or both of the electrical interfaces may include one or more electrical contacts. Thus, when the main body is engaged with the consumable, the electrical interface may be configured to transfer electrical power from the power source to a heater of the consumable. The electrical interface may also be used to identify the consumable from a list of known types. The electrical interface may additionally or alternatively be used to identify when the consumable is connected to the main body.

The main body may alternatively or additionally be able to detect information about the consumable via an RFID reader, a barcode or QR code reader. This interface may be able to identify a characteristic (e.g., a type) of the consumable. In this respect, the consumable may include any one or more of an RFID chip, a barcode or QR code, or memory within which is an identifier, and which can be interrogated via the interface.

The consumable or main body may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method.

The consumable or main body may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., Wi-Fi®, are also possible. The wireless interface may also be configured to communicate wirelessly with a remote server.

As is provided above, an airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the consumable or the main body.

In an alternative embodiment the device may be a non-consumable device in which an aerosol former (e.g., e-liquid) of the system may be replenished by re-filling the tank of the device (rather than replacing the consumable). In this embodiment, the consumable described above may instead be a non-consumable component that is integral with the main body. Thus the device may comprise the features of the main body described above. In this embodiment, the only consumable portion may be e-liquid contained in the tank of the device. Access to the tank (for re-filling of the e-liquid) may be provided via, e.g., an opening to the tank that is sealable with a closure (e.g., a cap).

The device may be a smoking substitute device (e.g., an e-cigarette device) and, when in the form of a consumable, may be a smoking substitute consumable (e.g., an e-cigarette consumable).

In a second aspect there is disclosed a smoking substitute system comprising a main body having a power source, and a consumable as described above with respect to the first aspect, the consumable being engageable with the main body such that vaporizer of the consumable is connected to the power source of the main body.

The consumable may be an e-cigarette consumable. The main body may be as described above with respect to the first aspect. The main body may, for example, be an e-cigarette device for supplying power to the consumable.

The disclosure includes the combination of the aspects and preferred features described except where such a combination is clearly impermissible or expressly avoided.

Second Mode: An Aerosol Delivery Device Having a Filter within a Passage and an Air Gap Between the Filter and a Wall of the Passage At its most general, the second mode of the present disclosure relates to an aerosol delivery device having a filter within a passage and an air gap between the filter and a wall of the passage (e.g., for an airflow path between the passage wall and the filter).

In a first aspect of the second mode, there is provided an aerosol delivery device comprising: one or more passage walls defining an elongate passage downstream of a vaporizer and extending along a longitudinal axis to an outlet; and an elongate filter extending longitudinally within the passage, an outer surface of the filter spaced from an internal surface of the one or more passage walls so as to define an elongate airflow path between the filter and the passage wall.

The inclusion of a filter within the passage, downstream of the vaporizer, may help to reduce (or prevent) un-vaporized liquid from the vaporizer being discharged from the outlet of the passage (i.e., into a user's mouth). That is, the filter may absorb un-vaporized liquid that is carried by the airflow through the passage.

However, one issue with the inclusion of such a filter is that it restricts airflow through the passage, which can increase the suction required in order to draw air (i.e., vapor/aerosol) through the passage. By forming the filter so as to define an airflow path that extends past the filter (i.e., between the passage wall and the filter), this issue can be at least partly alleviated.

The term "outer surface" is used here to describe an outer boundary of the filter. It is recognized that some filters are formed of, e.g., a foam or mesh of fibers (or similar) formed into a particular shape. In such cases, the outer surface is not a surface of, e.g., an individual fiber but is rather a boundary (or a portion of the boundary) of the overall shape formed by the fibers as a collective whole.

The term "upstream" is used to define a direction away from the outlet of the device. The term "downstream" is used to define a direction towards the outlet of the device.

Optional features of the present disclosure will now be set out. These are applicable singly or in any combination with any aspect of the present disclosure.

The airflow path between the filter and the passage wall may extend for (e.g., substantially) the length of the filter (i.e., in the longitudinal direction). That is, the outer surface of the filter may be spaced from the internal surface for the length of the filter. The airflow path may be substantially linear and may extend longitudinally between the filter and the one or more passage walls.

The transverse cross-sectional shape of the portion of the passage containing the filter may be consistent over the length of the portion of the passage. The transverse cross-sectional shape of the passage may be consistent for the entire length of the passage. The transverse cross-sectional shape of the passage may be circular. Alternatively, the cross-sectional shape of the passage may be, e.g., elliptical, rectangular, triangular, etc.

The terms "transversely" and "transverse" are used herein to describe a direction that is substantially perpendicular to the axial (longitudinal) direction of the device.

The transverse cross-sectional shape of the airflow path may be consistent over the length of the airflow path. The transverse cross-sectional shape of the filter may be consistent over the length of the filter. The filter may, for example, have a cross-sectional shape that is a circle sector. The central angle of the circle sector may be approximately equal to or greater than 180 degrees. The cross-sectional shape of the filter may be semi-circular. Thus, the filter may comprise a circumferential outer surface that contacts (lies against) an inner circumferential surface of the passage wall (i.e., when the passage has a circular cross-section). A planar (diametrical) outer surface of the filter may extend between the ends of the circumferential surface, which may be spaced from an internal surface of the one or more passage walls to define the airflow path (having a semi-circular cross-section).

The cross-sectional shape of the filter may alternatively be triangular (i.e., such that the filter may have a triangular prism shape). The points of the triangle (i.e., longitudinal edges of the filter) may each contact an inner surface of the one or more passage walls. In this respect, the filter may be retained in the passage, at least partly, by the contact between the longitudinal edges of the filter and the internal surface(s). The triangular filter may comprise three planar outer surfaces (i.e., extending between the three longitudinal edges) that are each spaced from a respective internal surface so as to define three airflow paths extending between the filter and the one or more passage walls.

The filter may alternatively have a cross-sectional shape that is C-shaped. The C-shaped cross-sectional shape may be in the form of an annulus sector. The annulus sector may have a central angle that is greater than or equal to 180 degrees and may be less than or equal to 270 degrees. The outer radius of the annulus sector may be approximately twice as large as the inner radius of the annulus sector. When the filter has a C-shaped cross-section, the filter may comprise a circumferential outer surface that (when the passage has a circular cross section) contacts, e.g., lies against, an inner circumferential surface of the passage wall. This contact may help to retain the filter in the passage.

The cross-sectional area of the filter may be approximately equal to or greater than 15%, or greater than 30% of the cross-sectional area of the passage. The cross-sectional area of the filter may be approximately equal to or greater than 40% of the cross-sectional area of the passage. The cross-sectional area of the filter may be approximately equal to or greater than 50% of the cross-sectional area of the passage.

The filter may be formed of a fabric, which may be cotton or another fiber. The filter may be formed of a mesh. The filter may be configured to permit the flow of vaporized e-liquid therethrough but prevent the flow of un-vaporized e-liquid.

The filter may be formed of a compressible (e.g., elastic) material or structure. The filter may be in a (e.g., partially) compressed or deformed state in the passage. For example, when the passage has a circular cross-section, the filter may be formed such that a circle circumscribing the cross-sectional shape of the filter is larger than the circle defining the cross-section of the passage. Thus, when the filter is received in the passage it must be compressed in order to fit within the passage. Once received therein, the expansion of the filter against the one or more passage walls (i.e., to return to its natural shape) may help to retain the filter in the passage.

The length of the filter (i.e., in the longitudinal direction) may be less than the length of the passage. Thus, the passage may comprise a void (i.e., a portion of the passage that does not contain the filter) downstream and/or upstream of the filter.

The passage comprises a retainer for retaining the filter in position in the passage. The retainer may be configured to restrict axial movement of the filter along the passage. In particular, the retainer may be configured to restrict axial movement of the filter in an upstream direction. For example, the retainer may comprise a rib or protrusion(s) extending inwardly from an inner surface of the one or more passage walls. An upstream end of the filter may abut/contact the retainer to prevent upstream movement. The retainer may comprise a retaining surface that extends transversely inwardly from an inner surface of the passage wall(s), and a sloped surface that extends obliquely (in an upstream direction) from an inner edge of the retaining surface to an inner surface of the passage wall(s). The sloped surface may allow the filter to be moved past the retainer in the downstream direction, whilst movement in the upstream direction is restricted by the retaining surface.

The device may comprise a vaporizing chamber in which the vaporizer is mounted. The passage may extend from the vaporizing chamber to the outlet. The device may comprise at least one inlet in fluid communication with the vaporizing chamber, such that airflow is directed from the inlet(s) through the vaporizing chamber to the passage.

A baffle may be interposed between the vaporizer and the passage. The baffle may extend generally transversely in the vaporizing chamber and may be arranged such that unvaporized liquid collects on an upstream (e.g., planar) surface of the baffle. The baffle may be aligned along the longitudinal axis so as to be transversely aligned with an opening to the passage (from the vaporizing chamber).

The outlet may form part of a mouthpiece of the device. The mouthpiece may be integrally formed with the passage (i.e., the one or more walls of the passage). The mouthpiece may define an outer surface of the device that is received in a user's mouth in use.

The vaporizing chamber may comprise opposing parallel side walls that are substantially parallel to the longitudinal axis, and a downstream (e.g., end) wall extending transversely between the side walls. The passage opening may be formed in the downstream wall of the chamber.

The device may comprise a tank (reservoir) for containing the vaporizable liquid (e.g., an e-liquid) with the vaporizer being in fluid communication with the tank. The e-liquid may, for example, comprise a base liquid and, e.g., nicotine. The base liquid may include propylene glycol and/or vegetable glycerin.

The tank may be defined by a tank housing. The tank housing may be integrally formed with the mouthpiece and/or the passage. At least a portion of the tank housing may be translucent. For example, the tank housing may comprise a window to allow a user to visually assess the quantity of e-liquid in the tank. The tank may be referred to as a "clearomizer" if it includes a window, or a "cartomizer" if it does not.

The passage may extend longitudinally within the tank and the one or more passage walls may define the inner wall of the tank. In this respect, the tank may surround the passage, e.g., the tank may be annular. The passage wall(s) may comprise longitudinal ribs extending therealong. These ribs may provide support to the passage wall(s). The ribs may extend for the full length of the passage wall(s). The ribs may project (e.g., radially outwardly) into the tank.

The device may comprise an insert defining the device inlet(s). The insert may be inserted into an open end of the tank so as to seal against the tank housing. The insert may comprise an inner, longitudinally-extending sleeve that defines wall(s) of the vaporizing chamber and seals against the passage (e.g., seals against outer surfaces of the passage wall(s)). The insert may be configured to support the vaporizer within the vaporizing chamber. The insert may be formed of silicone. The baffle may be formed of silicone. The insert and the baffle may be integrally formed.

The vaporizer may comprise a heater and a wick (e.g., comprising a porous material). The wick may be elongate and extend transversely across the chamber between wall(s) (e.g., opposing side walls) of the chamber (which may be defined by the inner sleeve). So as to be in fluid communication with the tank, the wick extends into the tank, e.g., one or both of its opposing transverse ends may extend into the tank, e.g., through the wall(s) of the chamber/through the inner sleeve. In this way e-liquid may be drawn (e.g., by capillary action) along the wick, from the tank to the exposed (central) portion of the wick. The wick may be oriented so as to be perpendicular to the baffle. In this respect, air may pass around, through or proximate the wick and either side of the baffle.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in the chamber portion of the airflow path. This vapor may subsequently cool to form an aerosol in the passage or vaporizing chamber.

The device may be in the form of a consumable. The consumable may be configured for engagement with a main body (i.e., so as to form a smoking substitute system). For example, the consumable may comprise components of the system that are disposable, and the main body may comprise non-disposable or non-consumable components (e.g., power supply, controller, sensor, etc.) that facilitate the delivery of aerosol by the consumable. In such an embodiment, the vaporizable liquid (e.g., e-liquid) may be replenished by replacing a used consumable with an unused consumable.

The main body and the consumable may be configured to be physically coupled together. For example, the consumable may be at least partially received in a recess of the main body, such that there is snap engagement between the main body and the consumable. Alternatively, the main body and the consumable may be physically coupled together by screwing one onto the other, or through a bayonet fitting.

Thus, the consumable may comprise one or more engagement portions for engaging with a main body. In this way, one end of the device (i.e., the inlet end) may be coupled with the main body, whilst an opposing end (i.e., the outlet end) of the consumable may define the mouthpiece.

The main body or the consumable may comprise a power source or be connectable to a power source. The power source may be electrically connected (or connectable) to the heater. The power source may be a battery (e.g., a rechargeable battery). An external electrical connector in the form of, e.g., a USB port may be provided for recharging this battery.

The consumable may comprise an electrical interface for interfacing with a corresponding electrical interface of the main body. One or both of the electrical interfaces may include one or more electrical contacts. Thus, when the main body is engaged with the consumable, the electrical interface may be configured to transfer electrical power from the power source to a heater of the consumable. The electrical interface may also be used to identify the consumable from a list of known types. The electrical interface may additionally or alternatively be used to identify when the consumable is connected to the main body.

The main body may alternatively or additionally be able to detect information about the consumable via an RFID reader, a barcode or QR code reader. This interface may be able to identify a characteristic (e.g., a type) of the consumable. In this respect, the consumable may include any one or more of an RFID chip, a barcode or QR code, or memory within which is an identifier, and which can be interrogated via the interface.

The consumable or main body may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method.

The consumable or main body may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., Wi-Fi®, are also possible. The wireless interface may also be configured to communicate wirelessly with a remote server.

As is provided above, an airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the consumable or the main body.

In an alternative embodiment, the device may be a non-consumable device in which an aerosol former (e.g., e-liquid) of the system may be replenished by re-filling the tank of the device (rather than replacing the consumable). In this embodiment, the consumable described above may instead be a non-consumable component that is integral with the main body. Thus the device may comprise the features of the main body described above. In this embodiment, the only consumable portion may be e-liquid contained in the tank of the device. Access to the tank (for re-filling of the e-liquid) may be provided via, e.g., an opening to the tank that is sealable with a closure (e.g., a cap).

The device may be a smoking substitute device (e.g., an e-cigarette device) and, when in the form of a consumable, may be a smoking substitute consumable (e.g., an e-cigarette consumable).

In a second aspect of the second mode, there is disclosed a smoking substitute system comprising a main body having a power source, and a consumable as described above with respect to the first aspect, the consumable engageable with the main body such that vaporizer of the consumable is connected to the power source of the main body.

The consumable may be an e-cigarette consumable. The main body may be as described above with respect to the first aspect. The main body may, for example, be an e-cigarette device for supplying power to the consumable.

In a third aspect there is disclosed an elongate filter for an aerosol delivery device, the filter having a cross-sectional shape that is one of a semi-circle, a triangle, or an annulus sector.

The filter of the third aspect may be as otherwise described above with respect to the first aspect.

In a fourth aspect of the second mode, there is disclosed an elongate filter for an aerosol delivery device, the filter configured for receipt in an elongate passage of the aerosol delivery device such that an outer surface of the filter is spaced from an inner surface of a wall defining the passage so as to define an airflow between the filter and the wall of the passage.

The filter of the fourth aspect may be as otherwise described above with respect to the first or third aspects.

The disclosure includes the combination of the aspects and preferred features described except where such a combination is clearly impermissible or expressly avoided.

Third Mode: A Consumable for a Smoking Substitute Device in which a Tank and a Mouthpiece are Integrally Formed Wherein the External Surface of the Consumable is Adapted for Receiving a Filter for Filtering Unvaporized Liquid Out of the Aerosol Vapor At its most general, the third mode of the present disclosure relates to a consumable for a smoking substitute device in which a tank and a mouthpiece are integrally formed wherein the external surface of the consumable is adapted for receiving a filter for filtering unvaporized liquid out of the aerosol vapor.

According to a first aspect of the third mode, there is provided a consumable for a smoking substitute device, the consumable comprising: a tank for storing an e-liquid; and a mouthpiece, the mouthpiece comprising a mouthpiece aperture, wherein the mouthpiece aperture is configured to be fluidly connected to the tank, so that the mouthpiece aperture receives an aerosol vapor formed from the e-liquid in use; the external surface of the mouthpiece being adapted for receiving a filter for filtering unvaporized liquid out of the aerosol vapor; wherein the tank and the mouthpiece are integrally formed. The tank and the mouthpiece being integrally formed is advantageous, as it removes a possible fluid leakage path between the tank and the mouthpiece, reducing leakage of e-liquid. Additionally, it removes the need to assemble separate mouthpiece and tank components, simplifying the manufacture of the consumable.

The consumable comprises an external adaptation for receiving a filter. In particular, the external surface of the mouthpiece of the consumable is adapted for receiving a filter for filtering unvaporized liquid out of the aerosol vapor. In this way, when a suitable filter is installed at the mouthpiece, any unvaporized liquid within the aerosol stream may be removed from the aerosol stream before entering the mouth of the user. This offers an improved user experience. Providing an external adaptation for receiving the filter means that the filter is easily installed or removed from the consumable without the need to dismantle any parts of the consumable.

Including the adaptation of the surface for receiving the filter is particularly advantageous for a consumable in which the tank is integrally formed with the mouthpiece, as integrally forming the tank and mouthpiece means that there is no location between the tank and mouthpiece for a filter.

In some embodiments the mouthpiece defines an external recess for receiving the filter or a portion of the filter. Thus the external surface of the mouthpiece may be adapted to receive the filter by providing a recess, or cavity, into which the filter or a portion of the filter is insertable.

The term "external recess" refers to a recessed portion of the outer wall of the mouthpiece which facilitates the receipt of a filter or a portion of a filter. Provision of a recess ensures that protrusion of the filter from the consumable is limited or avoided when the filter is installed and provides a means to secure the filter to prevent movement of the filter during use.

In some embodiments the external recess surrounds the mouthpiece aperture. In other words, the recessed portion of the outer wall is a portion which lies immediately adjacent to the mouthpiece aperture. In this way, when a filter is installed within the recess the aperture is occluded by the filter ensuring optimum filtration of the aerosol vapor stream.

In some embodiments, the recess has a larger cross section than the mouthpiece aperture. In this way the filter, when installed, covers at least the entire mouthpiece aperture such that aerosol vapor passing out of the consumable through the aperture is forced to pass through the filter before entering the mouth of the user. This ensures maximum filtration efficiency and removal of any unvaporized liquid.

In some embodiments the consumable is adapted to retain the filter in the recess by interference fit or a retention mechanism. In some embodiments the consumable is adapted to retain the filter in the recess by interference fit (also known as friction fit). For example, the dimensions of the recess and the filter may be complementary to provide a snug fit which prevents the inadvertent removal of the filter.

In some embodiments the consumable is adapted to retain the filter in the recess by a retention mechanism. In some embodiments this mechanism comprises a clip, such as a detent mechanism which prevents the removal of the filter after it has been pushed into the recess by a predetermined amount. In some embodiments, the mechanism comprises a movable cover, for example a cover which is movable away from the recess or removable from the consumable so that the filter can be installed, then movable to cover the filter when the filter is installed in the recess to prevent its inadvertent removal from the consumable. In some embodiments, the retention mechanism is releasable to provide for the straightforward removal of the filter from the mouthpiece. For example, the user may release a detent mechanism or remove a cover in order to remove the filter from the mouthpiece, or apply a modest level of force to overcome an interference fit. This allows the user to, e.g., replace the filter with a different filter which offers a different level of filtration or remove the filter entirely and use the consumable without any filter if this is desired, thereby offering a versatile user experience.

In some embodiments, the recess comprises a floor which defines the mouthpiece aperture, and one or more side walls extending from the floor up to an annular rim where the side walls of the recess meet the outer surface of the mouthpiece. In some embodiments, the floor of the recess has a circular or elliptical shape. In some embodiments, a single continuous side wall provides a recess with a cylindrical (or elliptic cylindrical) shape. In some embodiments, a step change in the diameter of the recess is provided in the side wall. In some embodiments, the recess has a larger diameter for the portion of the recess adjacent the rim of the recess and a smaller diameter for the portion of the recess adjacent the floor of the recess, thereby providing a shoulder or shelf within the recess which faces outwards, towards the rim. In some embodiments, the step change in diameter of the side wall is located closer to the rim of the recess than the floor of the recess. In some embodiments, less than 50% of the depth of the recess is located between the step change in diameter and the rim of the recess, for example less than 40%, less than 30% or less than 25%, with the remainder of the depth being located between the step and the floor of the recess.

In some embodiments, the depth of the recess measured as the distance from the floor of the recess (or from the mouthpiece aperture) to the rim where the recess meets the outer surface of the mouthpiece, in a direction parallel with the outlet of the consumable, is at least 3.0 mm, for example at least 3.1 mm, at least 3.2 mm, at least 3.3 mm, at least 3.4 mm, at least 3.5 mm or at least 3.6 mm. In some embodiments, the depth of the recess is less than 5.0 mm, for example less than 4.9 mm, less than 4.8 mm, or less than 4.7 mm.

In some embodiments, the width of the recess measured as the largest distance between opposing side walls of the recess, in a direction perpendicular with the outlet of the consumable, is at least 7.0 mm, for example at least 7.1 mm, at least 7.2 mm, at least 7.3 mm, at least 7.4 mm or at least 7.5 mm. In some embodiments, the width of the recess is less than 9.0 mm for example less than 8.9 mm, less than 8.8 mm, less than 8.7 mm, less than 8.6 mm, or less than 8.5 mm.

In some embodiments, the mouthpiece is further adapted for receiving a removable cover or cap for covering the filter when the filter is installed within the recess. The removable cover may be retained by the mouthpiece by an interference fit, for example by providing a snug fit between the outer edge of the cover and an inner wall of the recess. The removable cover may define an aperture permitting the passage of aerosol vapor. In some embodiments, the adaptation of the mouthpiece for receiving the cover comprises a shoulder or shelf within the recess upon which the cover rests when received by the mouthpiece. In some embodiments, the cover is formed of plastics material, preferably rigid plastics material. In some embodiments, the cover has a planar geometry, and may have the form of a plate or disc. The cover may have a circular or elliptical cross-section. In some embodiments, the cover is fully detachable from the mouthpiece.

In some embodiments the recess has an annular cross section. In this way the recess is adapted to receive a complementary annular filter. Providing an annular recess and filter allows the filter to be installed in any orientation, i.e., rotation of the filter to match the shape of the recess is not necessary.

In some embodiments, the diameter of the recess widens at the opening of the recess, i.e., at the most downstream part of the recess. The widening may be provided as a discrete step change in diameter as described above, thereby providing a shoulder feature within the recess. For example, the recess may include an upstream portion of a first internal diameter and a downstream portion of a second internal diameter, wherein the second internal diameter is greater than the first internal diameter. In this way, a filter of a length which matches the length of recess of the first internal diameter may be inserted into the recess. The downstream portion of the recess having a second internal diameter may then be covered, for example by the cap or closure described above, which will cover both the filter and the step in the inner surface of the recess which lies adjacent the outer edges of the filter. In this way, a more tortuous path around the outside of the filter (between the filter, the inner wall of the recess and the cap) is provided, ensuring that most if not all of the aerosol vapor passes through the filter itself, maximizing filtration efficiency. Furthermore, the presence of the cap reduces the risk of inadvertent loss of the filter from the mouthpiece. The use of a vapor-impermeable cap defining a vapor-permeable aperture provides increased resistance-to-draw since the vapor must pass through the aperture to enter the mouth of the user, which may improve user experience or offer a means to tailor the user experience by varying the aperture size.

In some embodiments, when the filter is in place within the recess, no part of the filter protrudes beyond the furthest extension of the outer wall of the mouthpiece. In some embodiments, when the filter and closure are in place within the recess, no part of the filter or closure protrudes beyond the furthest extension of the outer wall of the mouthpiece.

Optionally, the tank and mouthpiece are formed of the same material as each other.

In some embodiments, the tank and the mouthpiece are formed as a unitary component.

In some embodiments, the consumable further comprises an outlet, the outlet providing fluid connection between the tank and the mouthpiece aperture, wherein the outlet is integrally formed with the tank and the mouthpiece.

Optionally, the consumable may comprise an additional filter for filtering unvaporized liquid out of the aerosol vapor, wherein the additional filter is located within the outlet. Again, including the filter in the outlet is particularly advantageous for a consumable in which the tank is integrally formed with the mouthpiece, as integrally forming the tank and mouthpiece means that there is no location between the tank and mouthpiece for a filter. The filter may be a porous gas permeable and/or liquid-impermeable member.

Advantageously, the outlet comprises a void. The void provides a portion of the outlet for condensation settling, which means that unvaporized e-liquid can condense within the outlet. This reduces the amount of unvaporized e-liquid which reaches the mouthpiece and the user's mouth. In an example, the void occupies at least 5% of the total length of the outlet.

In some embodiments, the consumable is at least partially formed by an injection molding process.

Optionally, the consumable further comprises a window, so that a liquid level in the tank can be visually assessed through the window.

In some embodiments, the consumable further comprises a heating device for vaporizing the e-liquid to form the aerosol vapor, the heating device located in a fluid path between the tank and the mouthpiece.

According to a second aspect of the third mode, there is provided a smoking device comprising a consumable according to the first aspect.

A third aspect of the third mode is a filter for filtering unvaporized liquid out of the aerosol vapor of a consumable, wherein the filter is adapted to be coupled with the consumable according to the first aspect.

In some embodiments, the filter comprises a filtering portion made of a suitable material for removing unvaporized liquid from an aerosol stream. In some embodiments, the filter comprises an outer wall which encloses at least part of the filtering portion.

A fourth aspect of the third mode is a kit comprising the consumable according to the first aspect and a filter adapted to be coupled with the consumable. In some embodiments the kit further comprises a closure adapted to be removably attachable to the mouthpiece to cover the filter and retain it within the mouthpiece.

According to a fifth aspect of third mode, there is provided a method of manufacturing a consumable for a smoking substitute device, the method comprising integrally forming: a tank for storing an e-liquid; and a mouthpiece, the mouthpiece comprising a mouthpiece aperture, wherein the mouthpiece aperture is configured to be fluidly connected to the tank and the external surface of the mouthpiece is adapted for receiving a filter for filtering unvaporized liquid out of the aerosol vapor.

In some embodiments the method further comprises integrally forming an outlet with the tank and the mouthpiece, the outlet providing fluid connection between the tank and the mouthpiece aperture.

Optionally, the integrally forming is by an injection molding process.

According to a sixth aspect of the third mode, there is provided a manufacturing assembly comprising a first mold and a second mold, the first mold and second mold configured to be brought together to form a cavity, wherein the cavity has a shape such that when material is injected into the cavity, the material forms a consumable according to the first aspect.

The disclosure includes the combination of the aspects and preferred features described except where such a combination is clearly impermissible or expressly avoided.

Fourth Mode: An Aerosol Delivery Device for a Smoking Substitute System, Wherein a Pair of Contact Pins Having a Circular Cross Section Extend Through the Base of the Aerosol Delivery Device to Electrically Connect a Vaporizer to a Power Supply At its most general, the fourth mode of the present disclosure relates to an aerosol delivery device for a smoking substitute system, wherein a pair of contact pins having a circular cross section extend through the base of the aerosol delivery device to electrically connect a vaporizer to a power supply.

According to a first aspect of the fourth mode, there is provided an aerosol delivery device for a smoking substitute system, the aerosol delivery device comprising a vaporizer for vaporizing a vaporizable liquid, and a pair of contact pins for electrically connecting the vaporizer to a power supply, wherein the contact pins are embedded in a base portion of the aerosol delivery device, and each of the contact pins has a circular cross-section.

Providing contact pins embedded within the base portion of the aerosol delivery device may provide stability to the contact pins and thus ensure a reliable electrical connection between the power supply and the vaporizer housed inside the aerosol delivery device. Such a configuration may simplify the process of assembling the aerosol delivery device, and may even permit simplified automation of the assembly of the vaporizer with the base portion of the aerosol delivery device. The circular cross-section of each of the pair of contact pins may help to improve and simplify the assembly process of the aerosol delivery device and may also provide an improved seal between the contact pins and the base portion; thereby reducing the possibility of leaks (of vaporizable liquid) through the base portion.

Optional features of the present disclosure will now be set out. These are applicable singly or in any combination with any aspect of the present disclosure.

The device has an upper end comprising an outlet and a lower end comprising at least one inlet. The base portion is provided at the lower end of the device. The device has a longitudinal axis which extends between the upper and lower ends. The term "downstream" used herein is intended to refer to a longitudinal direction of the device towards the outlet. The term "upstream" used herein is intended to refer to a longitudinal direction of the device away from the outlet.

The device comprises a device airflow path extending from the at least one (upstream) inlet to the (downstream) outlet.

The terms "transverse" and "transversely" used herein are intended to refer to a direction perpendicular to the longitudinal axis of the device.

The contact pins may extend in a generally longitudinal direction. As such, they may be considered to be "unfolded" contact pins. Unfolded contact pins may generally be considered to have a longitudinal axis without any deflection greater than 90 degrees or 80 degrees or 70 degrees or 60 degrees or 50 degrees or 40 degrees of 30 degrees or 20 degrees or 10 degrees. Preferably the longitudinal axes of the contact pins have no deflection, i.e., the contact pins are substantially linear. The contact pins may extend through the base portion from lower (upstream) faces to upper (downstream) faces proximal the vaporizer.

The contact pins may be formed, for example, of plated metal. They may be formed of gold-plated metal. By providing unfolded contact pins, the plating may be less susceptible to wear.

The pins (e.g., the upper faces of the pins) may be aligned with each other in a transverse direction.

The vaporizer may be transversely elongated, e.g., it may comprise a transversely elongated wick and a heating element. The contact pins may be in electrical communication with the heating element. The pins (e.g., the upper faces of the pins) may be transversely aligned parallel to the vaporizer (e.g., parallel to the wick). The transversely aligned pins (e.g., the transversely aligned upper faces of the pins) may be aligned with the vaporizer (e.g., with the wick) in the axial (longitudinal) direction of the aerosol delivery device such that the wick overlies the contact pins (i.e., the upper faces of the contact pins) with the wick downstream of the pins.

The vaporizer may be positioned so that it overlies the axial center of the base portion (e.g., it extends transversely to intersect the longitudinal axis of the device). The axial center of the base portion may lie between the two contact pins.

Accordingly, the contact pins (e.g., the upper faces of the contact pins) may be equally spaced in the transverse direction either side of the central longitudinal axis of the aerosol delivery device.

The lowermost (upstream) surface of the base portion may have a generally rectangular profile with opposing transverse edges spaced by opposing front and rear edges (where the front to rear direction of the device extends perpendicular to both the longitudinal and transverse directions).

The contact pins (e.g., lower (upstream) faces of the contact pins) may be equally spaced from the front and rear edges on the lowermost surface of the base portion. A transverse spacing between a first of the pair of contact pins (e.g., a first of the lower faces of the pins) from the proximal (first) transverse edge may be equal to a transverse spacing between a second of the pair of contact pins (e.g., a second of the lower faces of the pins) from the proximal (second) transverse edge.

The at least one inlet may be provided on the lowermost surface of the base portion. There may be two air inlets provided on the lowermost surface of the base portion.

The heating element of the vaporizer may comprise a filament and each end of the filament may be electrically connected to a respective contact pin (e.g., to the upper faces of the contact pins). Specifically, the filament may extend between the pair of contact pins.

The filament may extend helically about the wick. The contact pins (e.g., the upper face of each contact pin) may be electrically connected to a respective end of the filament upstream of the wick.

The contact pins (i.e., the upper face of each contact pin) may be physically and electrically connected directly to the filament. Optionally, the contact pins may be connected to the filament by crimping, welding, or compressing.

The contact pins may have a circular cross-section along their entire length. Alternatively, the contact pins may have a circular cross-section along only part of their length.

Each contact pin may be substantially cylindrical. In other words, the cross-sectional shape and/or cross-sectional area of each contact pin may be substantially equal along the entire length of each respective contact pin. The contact pins may have substantially the same shape and/or size as each other.

Each of the contact pins may taper along at least part of their length towards the upper and/or lower face of each respective contact pin. In particular, each contact pin may taper in size towards the upper face (i.e., such that the cross-sectional area of the upper face of the contact pin is smaller than the cross-sectional area of the lower face of the contact pin). In this way, the vaporizer may be more easily electrically and physically connected to each of the contact pins.

The lower face of each contact pin may comprise an electrical interface for interfacing with a corresponding electrical interface of a main body of the smoking substitute system.

According to some embodiments, the aerosol delivery device may further comprise a vaporizing chamber. The vaporizer may be disposed within the vaporizing chamber and the upper faces of the contacts pins may be exposed within the vaporizing chamber.

In these embodiments, the device airflow path comprises at least one inlet airflow path extending from the at least one inlet (on the lowermost surface of the base portion) within a respective inlet channel to the vaporizing chamber and at least one chamber airflow path extending through the chamber.

The device airflow path may circumvent the vaporizer. Specifically, the chamber airflow path(s) may circumvent the vaporizer in the vaporizing chamber. In this way, the device airflow path may not pass through the vaporizer. Accordingly, the possibility of unvaporized liquid from the vaporizer being entrained in the airflow, and thus through the outlet of the device and into the mouth of a user, may be reduced or eliminated.

In some embodiments, the or each opening from the inlet channel(s) into the vaporizing chamber (and the or each inlet on the lowermost surface of the device) is offset from the central longitudinal axis of the aerosol delivery device, e.g., offset in the front to rear direction of the device (which is perpendicular to both the transverse and longitudinal direction).

Where there are two inlet airflow paths, the openings from the inlet channels into the vaporizing chamber (and each inlet on the lowermost surface of the device) may be spaced from each other in the front to rear direction of the device. They may be equally spaced from the central longitudinal axis of the aerosol delivery device on either side of the central longitudinal axis in a front to rear direction. They may be aligned with each other in the front to rear direction of the device.

The opening of the/each inlet channel into the vaporizing chamber may be offset from the vaporizer in the front to rear direction of the device. The opening of the/each inlet channel may be axially downstream of the vaporizer (i.e., closer to the outlet of the device).

In this way, airflow in the inlet airflow path may enter the vaporizing chamber downstream of the vaporizer, which may further help to reduce the amount of un-vaporized liquid entrained in the chamber airflow path towards the outlet of the device.

The opening(s) of the or each inlet channel may be elongated in the transverse direction such that it/they extend substantially parallel to the vaporizer (i.e., the wick of the vaporizer). Accordingly, the or each inlet channel may have a transversely elongated transverse cross-sectional profile. The or each inlet on the lowermost surface of the base portion may be elongated in the transverse direction such that it/they extend parallel to the front and rear edges of the lowermost surface of the base portion (and substantially parallel to the transverse axis aligning the (lower faces of the) contact pins on the lowermost surface of the base portion).

The aerosol delivery device may comprise a tank (reservoir) for containing the vaporizable liquid (e.g., an e-liquid) with the vaporizer being in fluid communication with the tank. The e-liquid may, for example, comprise a base liquid and, e.g., nicotine. The base liquid may include propylene glycol and/or vegetable glycerin.

The tank may be defined by a tank housing. At least a portion of the tank housing may be translucent. For example, the tank may comprise a window to allow a user to visually assess the quantity of e-liquid in the tank. The tank may be referred to as a "clearomizer" if it includes a window, or a "cartomizer" if it does not.

The base portion may be a base insert defining the inlet(s). The base insert may be inserted into an open lower end of the tank so as to seal against an inside surface of the tank housing. The base insert may comprise an inner, longitudinally-extending sleeve that defines wall(s) of the vaporizing chamber. The base insert may be configured to support the vaporizer within the vaporizing chamber. The base insert may define the inlet channels. The base insert may be formed of silicone.

The vaporizing chamber may comprise opposing parallel side walls that are substantially parallel to the longitudinal axis of the device, and a downstream wall extending transversely between the side walls. The walls (e.g., front and rear walls) of the vaporizing chamber may have at least one step formed therein, such that a portion of each (front/rear) wall is substantially perpendicular to the longitudinal axis of the device. The step(s) may be provided downstream of the vaporizer within the vaporizing chamber. The opening of the/each inlet channel may be formed in the step(s) of the wall(s) of the vaporizing chamber (i.e., the opening of the/each inlet channel may be formed in the step portion of the wall perpendicular to the longitudinal axis of the device).

The aerosol delivery device may comprise a passage extending to the outlet of the device, e.g., at a mouthpiece of the aerosol delivery device. The passage may extend from a passage opening in the vaporizing chamber to the outlet. In this respect, a user may draw fluid (e.g., air) from the inlet, through the inlet channel(s) and through the vaporizing chamber into the passage opening and through the passage by inhaling at the outlet (i.e., using the mouthpiece).

The passage may comprise passage walls extending within the tank such that the tank may surround the passage. The passage opening may be formed in the downstream wall of the vaporizing chamber. The inner sleeve of the base insert may seal against the passage walls.

The wick may comprise a porous material. The wick may be elongate and extend transversely across the vaporizing chamber between the wall(s) (e.g., side walls) of the vaporizing chamber. The wick may also comprise one or more portions in contact with liquid stored in the tank. For example, opposing transverse ends of the wick may protrude into the tank and a central portion (between the transverse ends) may extend across the vaporizing chamber. Thus, fluid may be drawn (e.g., by capillary action) along the wick, from the reservoir to the central portion of the wick.

The filament may be wound about the central portion of the wick. In operation, the power source may supply electricity to (i.e., apply a voltage across) the filament so as to heat the filament. This may cause liquid stored in the wick (i.e., drawn from the tank) to be heated so as to form a vapor and become entrained in the device airflow path. This vapor may subsequently cool to form an aerosol in the passage.

The aerosol delivery device may be in the form of a consumable.

In a second aspect of the fourth mode, there is provided a smoking substitute system comprising: the aerosol delivery device of the first aspect; and a main body comprising a power source, wherein the pair of contact pins electrically connect the heating element to the power source.

The consumable may be configured for engagement with the main body (i.e., so as to form a closed smoking substitute system). For example, the consumable may comprise components of the system that are disposable, and the main body may comprise non-disposable or non-consumable components (e.g., power supply, controller, sensor, etc.) that facilitate the delivery of aerosol by the consumable. In such an embodiment, the aerosol former (e.g., vaporizable e-liquid) may be replenished by replacing a used consumable with an unused consumable.

The main body and the consumable may be configured to be physically coupled together. For example, the consumable may be at least partially received in a recess of the main body, such that there is an interference fit (e.g., snap engagement) between the main body and the consumable. Alternatively, the main body and the consumable may be physically coupled together by screwing one onto the other, or through a bayonet fitting.

Thus, the aerosol delivery device may comprise one or more engagement portions for engaging with a main body. In this way, the lower end of the aerosol delivery device (e.g., the base portion) may be coupled with the main body, whilst the upper end of the aerosol delivery device may define a mouthpiece of the smoking substitute system.

The power source may be electrically connected (or connectable) to the vaporizer of the aerosol delivery device when engaged with the main body. The power source may be a battery (e.g., a rechargeable battery). A connector in the form of, e.g., a USB port may be provided for recharging this battery.

The consumable may comprise an electrical interface for interfacing with a corresponding electrical interface of the main body. As mentioned above, the lower face of each contact pin may comprise the electrical interface for interfacing with a corresponding electrical interface of the main body. One or both of the electrical interfaces may include one or more electrical contacts. The lower faces of the contact pins may provide the electrical contacts. Thus, when the main body is engaged with the consumable, the electrical interface may be configured to transfer electrical power from the power source to the heating element of the consumable. The electrical interface may also be used to identify the aerosol delivery device from a list of known types. For example, the consumable may have a certain concentration of nicotine and the electrical interface may be used to identify this. The electrical interface may additionally or alternatively be used to identify when a consumable is connected to the main body.

The main body may comprise an interface, which may, for example, be in the form of an RFID reader, a barcode or QR code reader. This interface may be able to identify a characteristic (e.g., a type) of a consumable engaged with the main body. In this respect, the consumable may include any one or more of an RFID chip, a barcode or QR code, or memory within which is an identifier, and which can be interrogated via the interface.

The aerosol delivery device or main body may comprise a controller, which may include a microprocessor. The controller may be configured to control the supply of power from the power source to the vaporizer of the aerosol delivery device (e.g., via the electrical contacts). A memory may be provided and may be operatively connected to the controller. The memory may include non-volatile memory. The memory may include instructions which, when implemented, cause the controller to perform certain tasks or steps of a method.

The main body or aerosol delivery device may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., Wi-Fi®, are also possible. The wireless interface may also be configured to communicate wirelessly with a remote server.

A puff sensor (i.e., airflow sensor) may be provided that is configured to detect a puff (i.e., inhalation from a user). The puff sensor may be operatively connected to the controller so as to be able to provide a signal to the controller that is indicative of a puff state (i.e., puffing or not puffing). The puff sensor may, for example, be in the form of a pressure sensor or an acoustic sensor. That is, the controller may control power supply to the heater of the consumable in response to a puff detection by the sensor. The control may be in the form of activation of the vaporizer in response to a detected puff. That is, the aerosol delivery device may be configured to be activated when a puff is detected by the puff sensor. The puff sensor may form part of the consumable or the main body.

In an alternative embodiment the device may be a non-consumable device in which an aerosol former (e.g., e-liquid) of the system may be replenished by re-filling the tank of the device (rather than replacing the consumable). In this embodiment, the consumable described above may instead be a non-consumable component that is integral with the main body. Thus the device may comprise the features of the main body described above. In this embodiment, the only consumable portion may be e-liquid contained in the tank of the device. Access to the tank (for re-filling of the e-liquid) may be provided via, e.g., an opening to the tank that is sealable with a closure (e.g., a cap).

According to a third aspect of the fourth mode, there is provided a smoking substitute system comprising the aerosol delivery device of the first aspect, and a main body comprising a power source, wherein the pair of contact pins electrically connect the heating element to the power source.

The disclosure includes the combination of the aspects and preferred features described except where such a combination is clearly impermissible or expressly avoided.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE DISCLOSURE

First Mode: An Aerosol Delivery Device in which a Baffle within a Vaporizing Chamber has a Face with a Barrier Adjacent an Aperture Through the Baffle Aspects and embodiments of a first mode of the present disclosure will now be discussed with reference to the accompanying figures. Further aspects and embodiments will be apparent to those skilled in the art. All documents mentioned in this text are incorporated herein by reference.

Figure 1A:
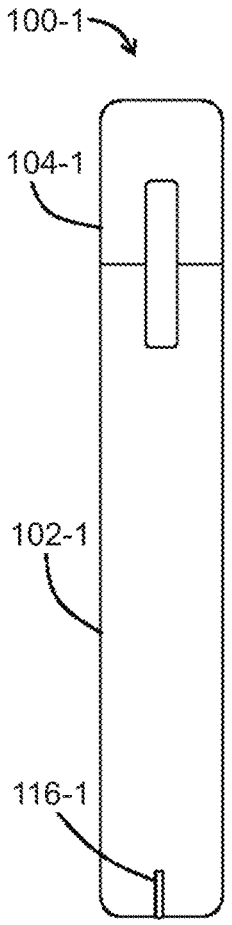
FIG. 1A is a front schematic view of a first mode of a smoking substitute system.

FIG. 1A shows a first embodiment of a first mode of a smoking substitute system 100-1. In this example, the smoking substitute system 100-1 includes a main body 102-1 and an aerosol delivery device in the form of a consumable 104-1. The consumable 104-1 may alternatively be referred to as a "pod", "cartridge" or "cartomizer". It should be appreciated that in other examples (i.e., open systems), the main body may be integral with the consumable such that the aerosol delivery device incorporates the main body. In such systems, a tank of the aerosol delivery device may be accessible for refilling the device.

Figure 1B:
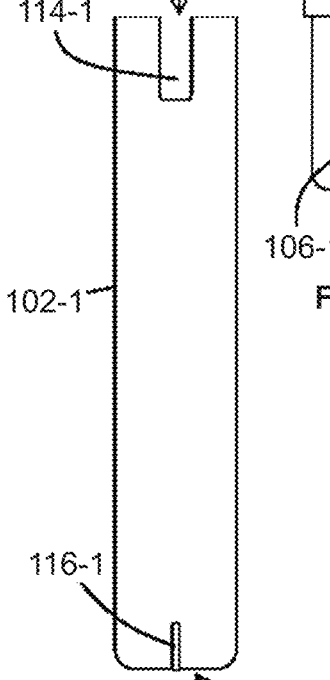
FIG. 1B is a front schematic view of a main body of the first mode of the system.
Figure 1C:
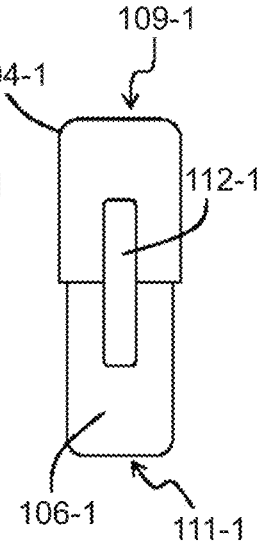
FIG. 1C is a front schematic view of a consumable of the first mode of the system.

In this example, the smoking substitute system 100-1 is a closed system vaping system, wherein the consumable 104-1 includes a sealed tank 106-1 and is intended for single-use only. The consumable 104-1 is removably engageable with the main body 102-1 (i.e., for removal and replacement). FIG. 1A shows the smoking substitute device 100-1 with the main body 102-1 physically coupled to the consumable 104-1, FIG. 1B shows the main body 102-1 of the smoking substitute system 100-1 without the consumable 104-1, and FIG. 1C shows the consumable 104-1 of the smoking substitute device 100-1 without the main body 102-1.

The main body 102-1 and the consumable 104-1 are configured to be physically coupled together by pushing the consumable 104-1 into a cavity at an upper end 108-1 of the main body 102-1, such that there is an interference fit between the main body 102-1 and the consumable 104-1. In other examples, the main body 102-1 and the consumable may be coupled by screwing one onto the other, or through a bayonet fitting.

The consumable 104-1 includes a mouthpiece (not shown in FIG. 1A, 1B, or 1C) at an upper end 109-1 of the consumable 104-1, and one or more air inlets (not shown) in fluid communication with the mouthpiece such that air can be drawn into and through the consumable 104-1 when a user inhales through the mouthpiece. The tank 106-1 containing e-liquid is located at the lower end 111-1 of the consumable 104-1.

The tank 106-1 includes a window 112-1, which allows the amount of e-liquid in the tank 106-1 to be visually assessed. The main body 102-1 includes a slot 114-1 so that the window 112-1 of the consumable 104-1 can be seen whilst the rest of the tank 106-1 is obscured from view when the consumable 104-1 is inserted into the cavity at the upper end 108-1 of the main body 102-1.

The lower end 110-1 of the main body 102-1 also includes a light 116-1 (e.g., an LED) located behind a small translucent cover. The light 116-1 may be configured to illuminate when the smoking substitute system 100-1 is activated. Whilst not shown, the consumable 104-1 may identify itself to the main body 102-1, via an electrical interface, RFID chip, or barcode.

Figure 2A:
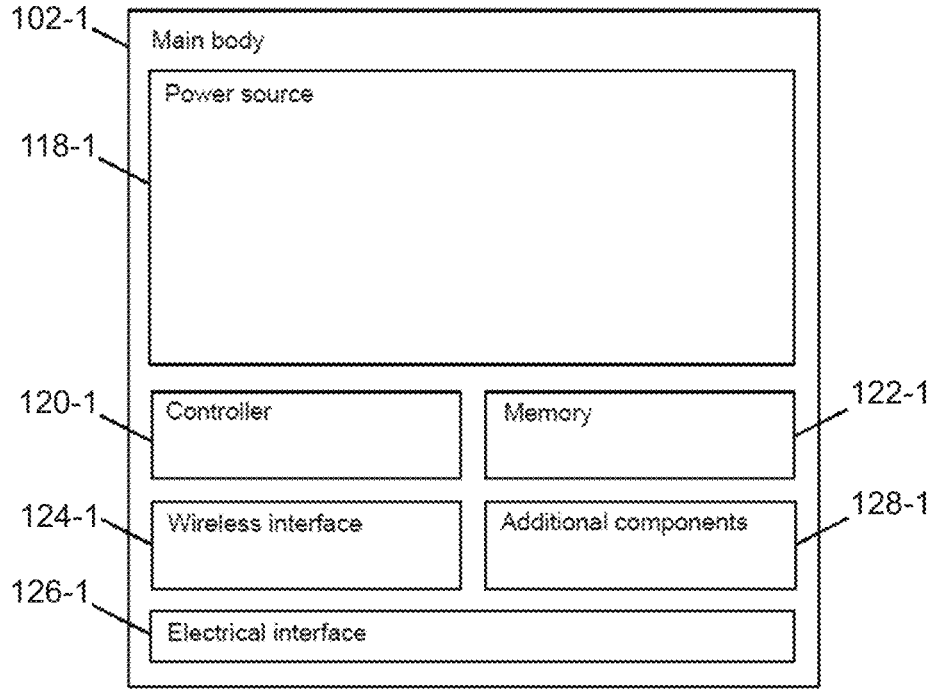
FIG. 2A is a schematic of the components of the main body of the first mode of the system.
Figure 2B:
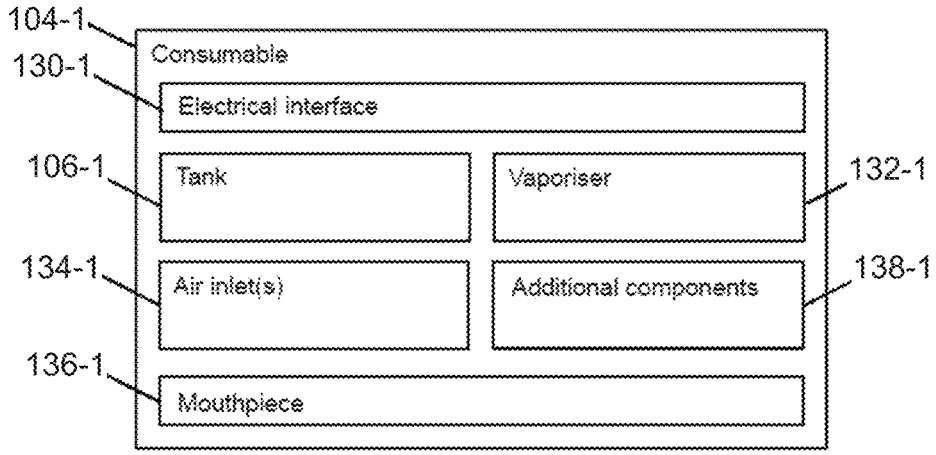
FIG. 2B is a schematic of the components of the consumable of the first mode of the system.

FIGS. 2A and 2B are schematic drawings of the main body 102-1 and consumable 104-1. As is apparent from FIG. 2A, the main body 102-1 includes a power source 118-1, a controller 120-1, a memory 122-1, a wireless interface 124-1, an electrical interface 126-1, and, optionally, one or more additional components 128-1.

The power source 118-1 is preferably a battery, more preferably a rechargeable battery. The controller 120-1 may include a microprocessor, for example. The memory 122-1 preferably includes non-volatile memory. The memory may include instructions which, when implemented, cause the controller 120-1 to perform certain tasks or steps of a method.

The wireless interface 124-1 is preferably configured to communicate wirelessly with another device, for example a mobile device, e.g., via Bluetooth®. To this end, the wireless interface 124-1 could include a Bluetooth® antenna. Other wireless communication interfaces, e.g., Wi-Fi®, are also possible. The wireless interface 124-1 may also be configured to communicate wirelessly with a remote server.

The electrical interface 126-1 of the main body 102-1 may include one or more electrical contacts. The electrical interface 126-1 may be located in a base of the aperture in the top end 108-1 of the main body 102-1. When the main body 102-1 is physically coupled to the consumable 104-1, the electrical interface 126-1 is configured to transfer electrical power from the power source 118-1 to the consumable 104-1 (i.e., upon activation of the smoking substitute system 100-1).

The electrical interface 126-1 may be configured to receive power from a charging station when the main body 102-1 is not physically coupled to the consumable 104-1 and is instead coupled to the charging station. The electrical interface 126-1 may also be used to identify the consumable 104-1 from a list of known consumables. For example, the consumable 104-1 may be a particular flavor and/or have a certain concentration of nicotine (which may be identified by the electrical interface 126-1). This can be indicated to the controller 120-1 of the main body 102-1 when the consumable is connected to the main body 102-1. Additionally, or alternatively, there may be a separate communication interface provided in the main body 102-1 and a corresponding communication interface in the consumable 104-1 such that, when connected, the consumable 104-1 can identify itself to the main body 102-1.

The additional components 128-1 of the main body 102-1 may comprise the light 116-1 discussed above.

The additional components 128-1 of the main body 102-1 may also comprise a charging port (e.g., USB or micro-USB port) configured to receive power from the charging station (i.e., when the power source 118-1 is a rechargeable battery). This may be located at the lower end 110-1 of the main body 102-1. Alternatively, the electrical interface 126-1 discussed above may be configured to act as a charging port configured to receive power from the charging station such that a separate charging port is not required.

The additional components 128-1 of the main body 102-1 may, if the power source 118-1 is a rechargeable battery, include a battery charging control circuit, for controlling the charging of the rechargeable battery. However, a battery charging control circuit could equally be located in the charging station (if present).

The additional components 128-1 of the main body 102-1 may include a sensor, such as an airflow (i.e., puff) sensor for detecting airflow in the smoking substitute system 100-1, e.g., caused by a user inhaling through a mouthpiece 136-1 of the consumable 104-1. The smoking substitute system 100-1 may be configured to be activated when airflow is detected by the airflow sensor. This sensor could alternatively be included in the consumable 104-1. The airflow sensor can be used to determine, for example, how heavily a user draws on the mouthpiece or how many times a user draws on the mouthpiece in a particular time period.

The additional components 128-1 of the main body 102-1 may include a user input, e.g., a button. The smoking substitute system 100-1 may be configured to be activated when a user interacts with the user input (e.g., presses the button). This provides an alternative to the airflow sensor as a mechanism for activating the smoking substitute system 100-1.

As shown in FIG. 2B, the consumable 104-1 includes the tank 106-1, an electrical interface 130-1, a vaporizer 132-1, one or more air inlets 134-1, a mouthpiece 136-1, and one or more additional components 138-1.

The electrical interface 130-1 of the consumable 104-1 may include one or more electrical contacts. The electrical interface 126-1 of the main body 102-1 and an electrical interface 130-1 of the consumable 104-1 are configured to contact each other and thereby electrically couple the main body 102-1 to the consumable 104-1 when the lower end 110-1 of the consumable 104-1 is inserted into the upper end 108-1 of the main body 102-1 (as shown in FIG. 1A). In this way, electrical energy (e.g., in the form of an electrical current) is able to be supplied from the power source 118-1 in the main body 102-1 to the vaporizer 132-1 in the consumable 104-1.

The vaporizer 132-1 is configured to heat and vaporize e-liquid contained in the tank 106-1 using electrical energy supplied from the power source 118-1. As will be described further below, the vaporizer 132-1 includes a heating filament and a wick. The wick draws e-liquid from the tank 106-1 and the heating filament heats the e-liquid to vaporize the e-liquid.

The one or more air inlets 134-1 are preferably configured to allow air to be drawn into the smoking substitute system 100-1, when a user inhales through the mouthpiece 136-1. When the consumable 104-1 is physically coupled to the main body 102-1, the air inlets 134-1 receive air, which flows to the air inlets 134-1 along a gap between the main body 102-1 and the bottom end 110-1 of the consumable 104-1.

In operation, a user activates the smoking substitute system 100-1, e.g., through interaction with a user input forming part of the main body 102-1 or by inhaling through the mouthpiece 136-1 as described above. Upon activation, the controller 120-1 may supply electrical energy from the power source 118-1 to the vaporizer 132-1 (via electrical interfaces 126-1, 130-1), which may cause the vaporizer 132-1 to heat e-liquid drawn from the tank 106-1 to produce a vapor which is inhaled by a user through the mouthpiece 136-1.

An example of one of the one or more additional components 138-1 of the consumable 104-1 is an interface for obtaining an identifier of the consumable 104-1. As discussed above, this interface may be, for example, an RFID reader, a barcode, a QR code reader, or an electronic interface which is able to identify the consumable. The consumable 104-1 may, therefore include any one or more of an RFID chip, a barcode or QR code, or memory within which is an identifier, and which can be interrogated via the electronic interface in the main body 102-1.

It should be appreciated that the smoking substitute system 100-1 shown in FIGS. 1A to 2B is just one exemplary implementation of a smoking substitute system. For example, the system could otherwise be in the form of an entirely disposable (single-use) system or an open system in which the tank is refillable (rather than replaceable).

Figure 3A:
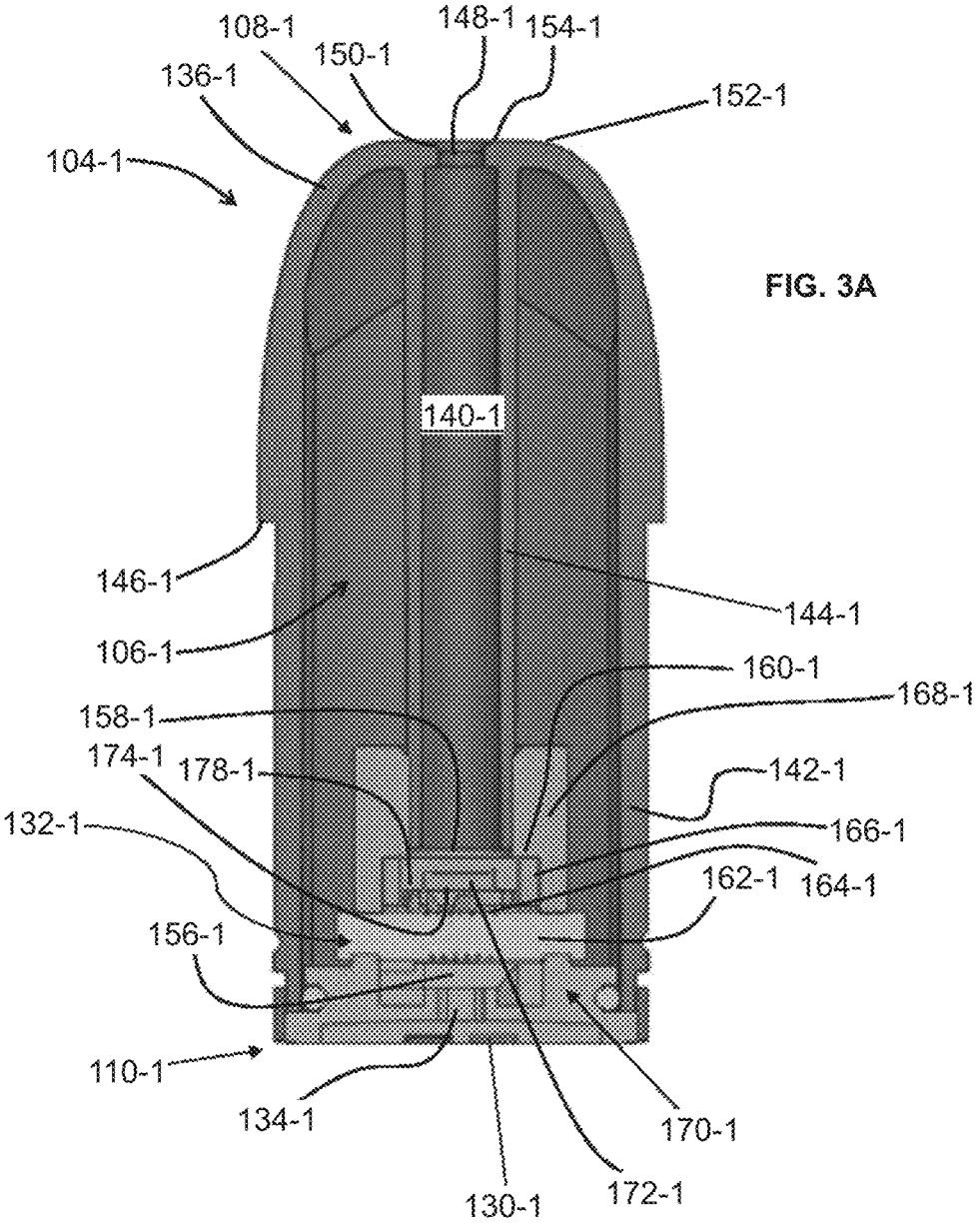
FIG. 3A is a section view of the consumable of the first mode of the system.

FIG. 3A is a section view of the consumable 104-1 described above. The consumable 104-1 comprises a tank 106-1 for storing e-liquid, a mouthpiece 136-1 and a passage 140-1 extending along a longitudinal axis of the consumable 104-1. In the illustrated embodiment the passage 140-1 is in the form of a tube having a substantially circular transverse cross-section (i.e., transverse to the longitudinal axis). The tank 106-1 surrounds the passage 140-1, such that the passage 140-1 extends centrally through the tank 106-1.

A tank housing 142-1 of the tank 106-1 defines an outer casing of the consumable 104-1, whilst a passage wall 144-1 defines the passage 140-1. The tank housing 142-1 extends from the lower end 111-1 of the consumable 104-1 to the mouthpiece 136-1 at the upper end 109-1 of the consumable 104-1. At the junction between the mouthpiece 136-1 and the tank housing 142-1, the mouthpiece 136-1 is wider than the tank housing 142-1, so as to define a lip 146-1 that overhangs the tank housing 142-1. This lip 146-1 acts as a stop feature when the consumable 104-1 is inserted into the main body 102-1 (i.e., by contact with an upper edge of the main body 102-1).

The tank 106-1, the passage 140-1 and the mouthpiece 136-1 are integrally formed with each other so as to form a single unitary component. As will be described further below with respect to FIG. 4, this component may be formed by way of an injection molding process and, for example, may be formed of a thermoplastic material such as polypropylene.

Although not immediately apparent from the figures, the tank housing 142-1 tapers, such that the thickness of the tank housing 142-1 decreases in a first demolding direction (as will be discussed further with respect to FIG. 4). In FIG. 3A the first demolding direction is in a downward direction away from the mouthpiece 136-1. This means that, aside from a small number of indents (which provide physical connection between the consumable 104-1 and the main body 102-1), the thickness of the tank housing 142-1 decreases with increasing distance away from the mouthpiece 136-1. In particular, the tank housing 142-1 tapers in this way, because internal and external surfaces of the tank housing 142-1 are angled with respect to the first demolding direction. This tapering assists in forming the tank housing 142-1 and passage wall 144-1 as a single (i.e., unitary) component.

Like the tank housing 142-1, the passage wall 144-1 is also tapered such that the thickness of the passage wall 144-1 decreases along the first demolding direction. Again, the thickness of the passage wall 144-1 decreases due to internal and external surfaces of the passage wall 144-1 being angled with respect to the first demolding direction. As a result of the tapering of the passage wall 144-1, the passage 140-1 has an internal diameter that decreases in a downstream direction (i.e., an upward direction in FIG. 3A). For example, the passage 140-1 has an internal width less than 4.0 mm and greater than 3.0 mm at an upstream end of the passage 140-1 (e.g., approximately 3.6 mm). On the other hand, the passage 140-1 has an internal width of less than 3.8 mm and greater than 2.8 mm at the downstream end of the passage 140-1 (e.g., approximately 3.4 mm).

The mouthpiece 136-1 comprises a mouthpiece aperture 148-1 defining an outlet of the passage 140-1. The mouthpiece aperture 148-1 has a radially inwardly directed inner surface 150-1, which joins an outer surface 152-1 of the mouthpiece 136-1 (i.e., a surface which contacts a user's lips in use) at an outer edge 154-1 of the mouthpiece aperture 148-1. At this outer edge 154-1, the included angle between the inner surface 150-1 of the mouthpiece aperture 148-1 and the outer surface 152-1 of the mouthpiece 136-1 (i.e., the "mouthpiece angle") is greater than 90 degrees. In the illustrated embodiment, this is due to the outer edge 154-1 being rounded. This edge 154-1 may otherwise be chamfered or beveled.

The vaporizer 132-1 is located in a vaporizing chamber 156-1 of the consumable 104-1. The vaporizing chamber 156-1 is downstream of the inlet 134-1 of the consumable 104-1 and is fluidly connected to the mouthpiece aperture 148-1 (i.e., outlet) by the passage 140-1. In particular, the passage 140-1 extends between the mouthpiece aperture 148-1 and an opening 158-1 from the chamber 156-1. This opening 158-1 is formed in a downstream (i.e., upper) wall 160-1 of the chamber 156-1.

The vaporizer 132-1 comprises a porous wick 162-1 and a heater filament 164-1 coiled around the porous wick 162-1. As is apparent from FIG. 3A, the wick 162-1 extends transversely across the chamber 156-1 between sidewalls 166-1 of the chamber 156-1 which form part of an inner sleeve 168-1 of an insert 170-1 that defines the lower end 111-1 of the consumable 104-1 that connects with the main body 102-1. The insert 170-1 is inserted into an open lower end of the tank 106-1 so as to seal against the tank housing 142-1.

In this way, the inner sleeve 168-1 projects into the tank 106-1 and seals with the passage 140-1 (around the passage wall 144-1) so as to separate the chamber 156-1 from the e-liquid in the tank 106-1. Ends of the wick 162-1 project through apertures in the inner sleeve 168-1 and into the tank 106-1 so as to be in contact with the e-liquid in the tank 106-1. In this way, e-liquid is transported along the wick 162-1 (e.g., by capillary action) to a central portion of the wick 162-1. The transported e-liquid is heated by the heater filament 164-1 (when activated, e.g., by detection of inhalation), which causes the e-liquid to be vaporized and to be entrained in air flowing in the vaporizing chamber 156-1. This vaporized liquid may cool to form an aerosol in the passage 140-1, which may then be inhaled by a user.

In some cases, unvaporized liquid can be carried by air flowing through the chamber 156-1. This may be undesirable for a user. To reduce or avoid this, the consumable 104-1 comprises a baffle 172-1 having an upstream face 174-1, which is shown in more detail in FIGS. 3B, 3C, and 3D.

The baffle 172-1 extends across the chamber 156-1 so as to be interposed between the vaporizer 132-1 and the passage opening 158-1. In this way, unvaporized liquid from the wick 162-1 may collect on the upstream (i.e., lower) face 174-1 of the baffle 172-1 rather than entering the passage opening 158-1. The baffle 172-1 also causes airflow from the vaporizer 132-1 to the passage opening 158-1 to be redirected around the baffle 172-1. The baffle 172-1 comprises two opposing upstream edges 176-1 around which the airflow is redirected. These upstream edges 176-1 and the sidewalls 166-1 of the chamber 156-1 define two respective apertures 178-1 spaced either side of the baffle 172-1.

Upon inhalation by a user at the mouthpiece aperture 148-1, air flows along the bifurcated chamber airflow path around the wick 162-1, through the apertures 178-1 and into the passage 140-1 via the passage opening 158-1.

Figure 3B:
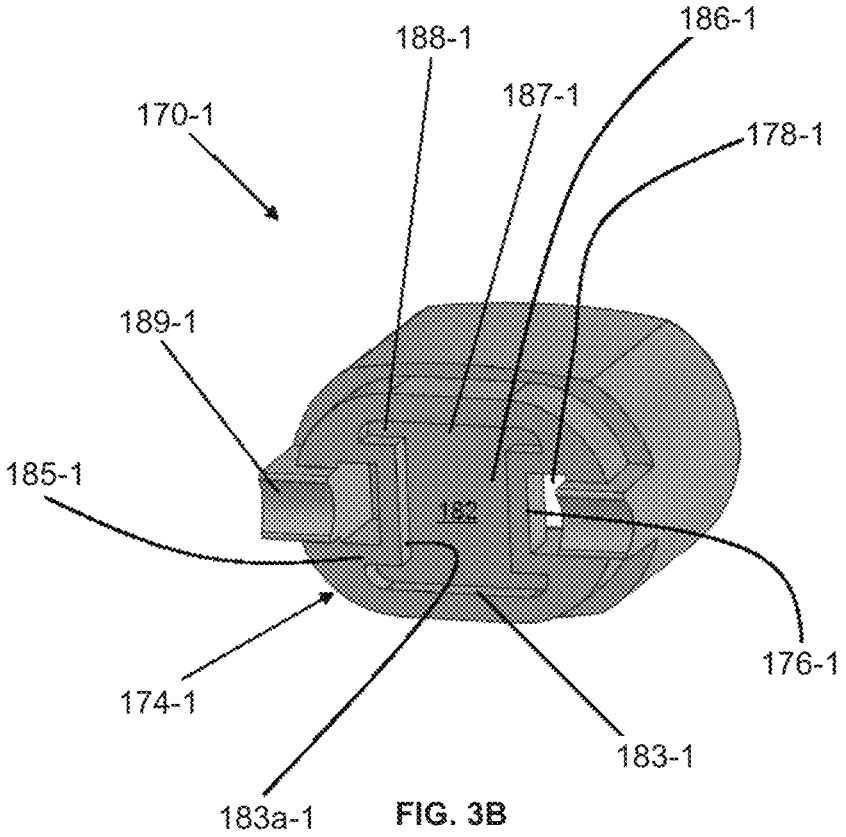
FIG. 3B is a perspective view of the upstream face of the baffle of the first mode of the system.

FIG. 3B shows a first embodiment of the upstream face 174-1 of the baffle 172-1 which is integral with a silicone insert 170-1.

The upstream end face 174-1 comprises a planar recessed surface 182-1 that is surrounded by vertical recess walls 183*a*-1 which extends (generally longitudinally) from the recessed surface 182-1 to a perimeter surface 185-1 of the upstream end face 174-1 of the baffle. The perimeter surface 185-1 surrounds the recessed surface 182-1 and is flush with the upstream transverse edges 176-1 of the baffle 172-1 that define the apertures 178-1.

The recessed surface 182-1 has a waist portion 186-1 interposed between the apertures 178-1. The waist portion 186-1 is defined by opposing transverse recess walls 183*b*-1 that extend in a front to back direction of the device (perpendicular to the transverse and longitudinal directions). The transverse recess walls 183*b*-1 are adjacent the apertures 178-1. The waist portion 186-1 has a smaller transverse width than two transversely elongated channels 187-1 that are provided on opposing sides of the waist portion 186-1 in a front to back direction of the device (perpendicular to the transverse and longitudinal directions). The channels 187-1 extend transversely from the waist portion 186-1 in both transverse directions to form four transverse pockets 188-1 that flank the apertures 178-1 in a front to rear direction.

Although not shown in FIG. 3B, the wick extends transversely facing the upstream face 174-1 of the baffle 172-1. The insert 170-1 comprises mounts 189-1 for mounting the wick. The transverse recess walls 183*b*-1 are perpendicular (in a front to back direction) relative to the wick.

When unvaporized liquid collects on the recessed surface 182-1, it is prevented from being swept or sucked (by the airflow in the chamber airflow path) from the recessed surface 182-1 by the transverse recess walls 183*b*-1 adjacent the apertures. The unvaporized liquid may be swept into and retained within the transverse pockets 188-1.

Figure 3C:
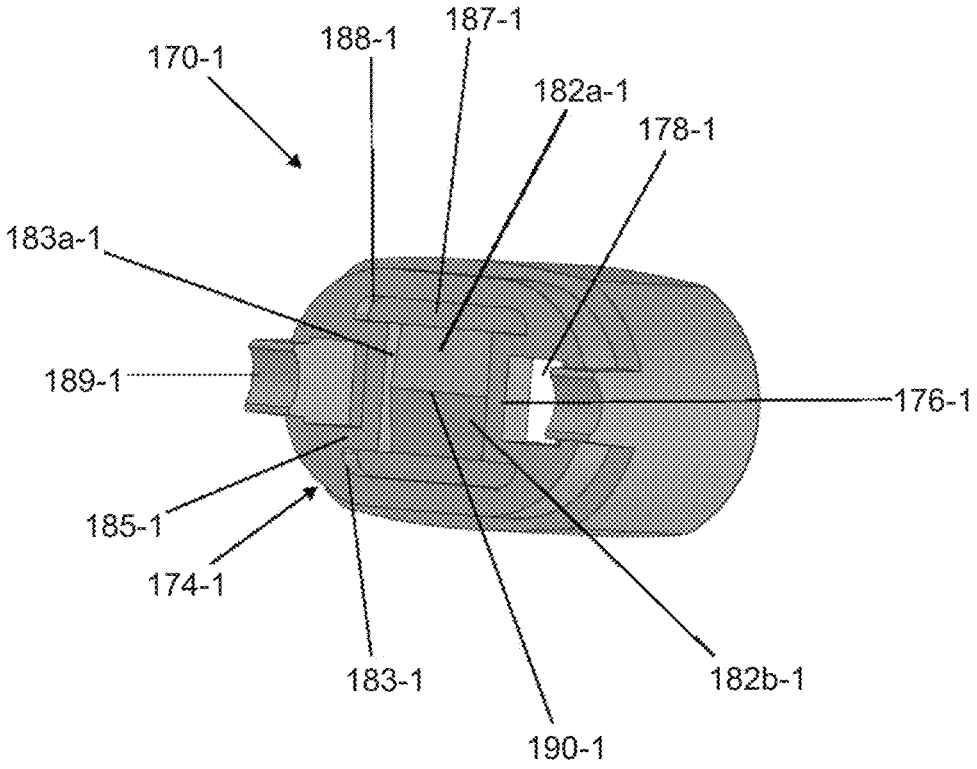
FIG. 3C is another perspective view of the upstream face of the baffle of the first mode of the system.

FIG. 3C shows a second embodiment of the upstream face 174-1 of the baffle 172-1.

The recessed surface comprises two sloped surfaces 182*a*-1, 182*b*-1 which define the waist portion 186-1 of the recessed surface 182-1, 182*a*-1 and which are joined at a transverse ridge 190-1. Each sloped surface 182*a*-1, 182*b*-1 slopes to a respective transverse gutter, the gutters being provided in the transverse channels 187-1 either side (in a front to back direction of the device) of the waist portion 186-1. The vertical transverse recess walls 183*b*-1 are perpendicular (in a front to back direction) to the ridge 190-1. The transverse ridge 190-1 and gutters in the channels 187-1 are parallel to the recess walls 183*b*-1. The transverse ridge 190-1 is longitudinally aligned with the wick.

When unvaporized liquid collects on the sloped surfaces 182*a*-1, 182*b*-1, it is swept (by the airflow in the chamber airflow path) into the gutters within the channels 187-1. The liquid is retained within the gutters (and transverse pockets 188-1) preventing it from being sucked through the apertures 178-1.

Figure 3D:
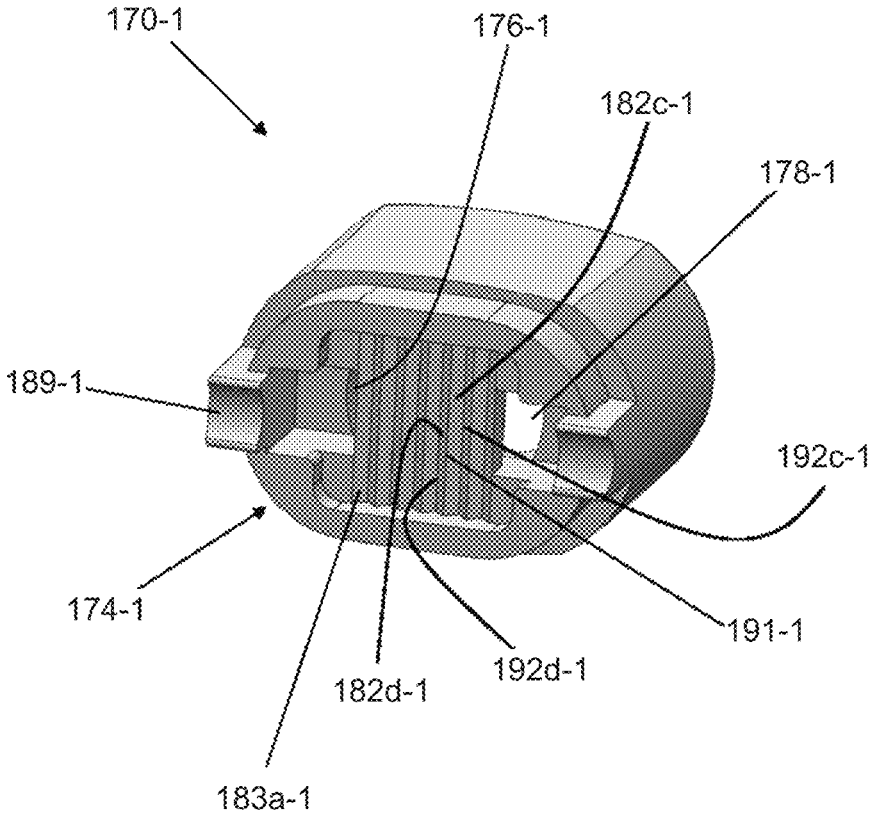
FIG. 3D is another perspective view of the upstream face of the baffle of the first mode of the system.

FIG. 3D shows a third embodiment of the upstream face 174-1 of the baffle 172-1.

In this embodiments, the recessed surface comprise a plurality of pairs of sloped surfaces 182*c*-1, 182*d*-1. Each pair of sloped surfaces 182*c*-1, 182*d*-1 meet at a respective ridge 191-1 such that there are a plurality of ridges 191-1 which extend in a front to back direction parallel to the transverse recess walls 183*b*-1. In this embodiment, the transverse recess walls 183*b*-1 are sloped from the upstream transverse edge 176-1 of the baffle. The each of the sloped surfaces 182*c*-1, 182*d*-1 slope to a respective gutter 192*c*-1, 192*d*-1. The gutters 192*c*-1, 192*d*-1 are parallel to the ridge 191-1 and extend in a front to back direction parallel to the transverse recess walls 183*b*-1. The ridges 191-1 and gutters 192*c*-1, 192*d*-1 are perpendicular the wick.

When unvaporized liquid collects on the sloped surfaces 182*c*-1, 182*d*-1, it is swept (by the airflow in the chamber airflow path) into the gutters 192*c*-1, 192*d*-1. The liquid is retained within the gutters preventing it from being sucked through the apertures 178-1.

Figure 4:
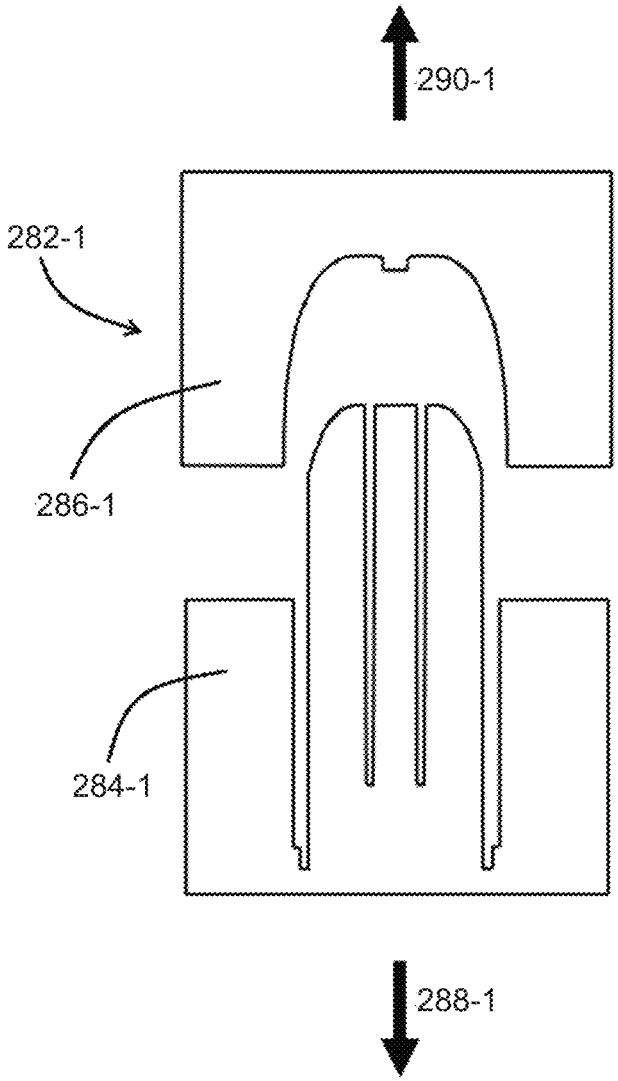
FIG. 4 is a section view of a manufacturing assembly for manufacturing the consumable of the first mode of the system.

FIG. 4 shows a drawing of a manufacturing assembly 282-1 which is used to manufacture the consumable 104-1. The manufacturing assembly 282-1 comprises a first mold 284-1 and a second mold 286-1.

The first mold 284-1 has a shape which complements that of a first end of the integrally formed tank housing 142-1 and mouthpiece 136-1. The first mold 284-1 therefore has a shape which matches the inner surfaces defining the tank 106-1.

The second mold 286-1 has a shape which complements that of a second end of the integrally formed tank housing 142-1 and mouthpiece 136-1. The second mold 286-1 has a shape which matches the outer surface of the mouthpiece 136-1 and the inner surface of the mouthpiece aperture 148-1.

When the first mold 284-1 and the second mold 286-1 are brought together, they define a closed cavity which has the shape of the tank housing 142-1, the mouthpiece 136-1 and the passage walls 144-1.

To manufacture these components, heated material is injected into the cavity between the first mold 284-1 and the second mold 286-1. At this point, the first mold 284-1 and the second mold 286-1 meet at a boundary between external surfaces of the mouthpiece 136-1 and the tank housing 142-1.

The material is subsequently cooled, and the first mold 284-1 and the second mold 286-1 are separated, with the first mold 284-1 travelling in the first demolding direction 288-1 (i.e., away from the second mold 286-1) and the second mold 286-1 travelling in a second demolding direction 290-1 (i.e., away from the first mold 284-1 and opposite to the first demolding direction 288-1). For a particular component, a demolding direction is a direction along which a mold which contacts that component is removed during an injection molding process.

The insert 170-1 and any additional components are subsequently inserted into the tank 106-1.

Second Mode: An Aerosol Delivery Device Having a Filter within a Passage and an Air Gap Between the Filter and a Wall of the Passage Aspects and embodiments of the second mode of the present disclosure will now be discussed with reference to the accompanying figures. Further aspects and embodiments will be apparent to those skilled in the art. All documents mentioned in this text are incorporated herein by reference.

Figure 5A:
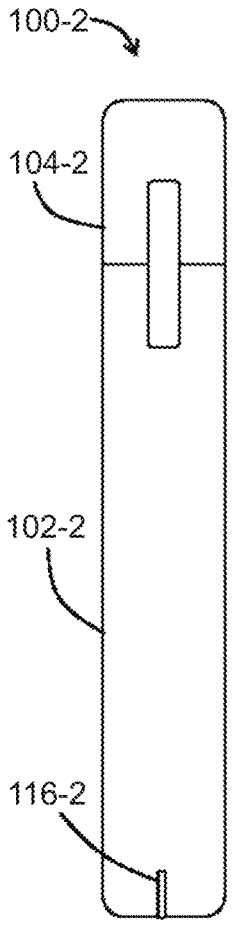
FIG. 5A is a front schematic view of a second mode of the smoking substitute system.

FIG. 5A shows a first embodiment of a smoking substitute system 100-2. In this example, the smoking substitute system 100-2 includes a main body 102-2 and an aerosol delivery device in the form of a consumable 104-2. The consumable 104-2 may alternatively be referred to as a "pod", "cartridge" or "cartomizer". It should be appreciated that in other examples (i.e., open systems), the main body may be integral with the consumable such that the aerosol delivery device incorporates the main body. In such systems, a tank of the aerosol delivery device may be accessible for refilling the device.

Figure 5B:
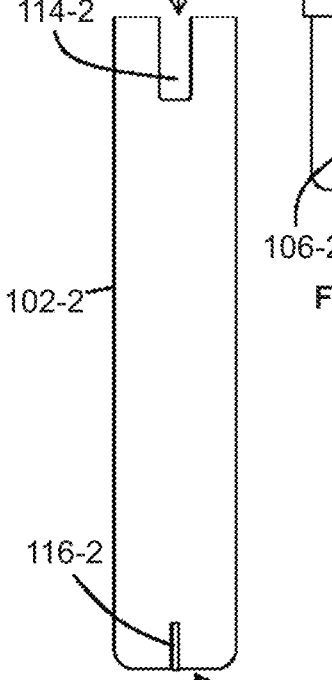
FIG. 5B is a front schematic view of a main body of the second mode of the system.
Figure 5C:
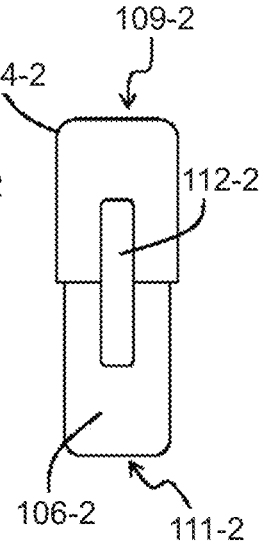
FIG. 5C is a front schematic view of a consumable of the second mode of the system.

In this example, the smoking substitute system 100-2 is a closed system vaping system, wherein the consumable 104-2 includes a sealed tank 106-2 and is intended for single-use only. The consumable 104-2 is removably engageable with the main body 102-2 (i.e., for removal and replacement). FIG. 5A shows the smoking substitute device 100-2 with the main body 102-2 physically coupled to the consumable 104-2, FIG. 5B shows the main body 102-2 of the smoking substitute system 100-2 without the consumable 104-2, and FIG. 5C shows the consumable 104-2 of the smoking substitute system 100-2 without the main body 102-2.

The main body 102-2 and the consumable 104-2 are configured to be physically coupled together by pushing the consumable 104-2 into a cavity at an upper end 108-2 of the main body 102-2, such that there is an interference fit between the main body 102-2 and the consumable 104-2. In other examples, the main body 102-2 and the consumable may be coupled by screwing one onto the other, or through a bayonet fitting.

The consumable 104-2 includes a mouthpiece (not shown in FIGS. 5A-5C) at an upper end 109-2 of the consumable 104-2, and one or more air inlets (not shown) in fluid communication with the mouthpiece such that air can be drawn into and through the consumable 104-2 when a user inhales through the mouthpiece. The tank 106-2 containing e-liquid is located at the lower end 111-2 of the consumable 104-2.

The tank 106-2 includes a window 112-2, which allows the amount of e-liquid in the tank 106-2 to be visually assessed. The main body 102-2 includes a slot 114-2 so that the window 112-2 of the consumable 104-2 can be seen whilst the rest of the tank 106-2 is obscured from view when the consumable 104-2 is inserted into the cavity at the upper end 108-2 of the main body 102-2.

The lower end 110-2 of the main body 102-2 also includes a light 116-2 (e.g., an LED) located behind a small translucent cover. The light 116-2 may be configured to illuminate when the smoking substitute system 100-2 is activated. Whilst not shown, the consumable 104-2 may identify itself to the main body 102-2, via an electrical interface, RFID chip, or barcode.

Figure 6A:
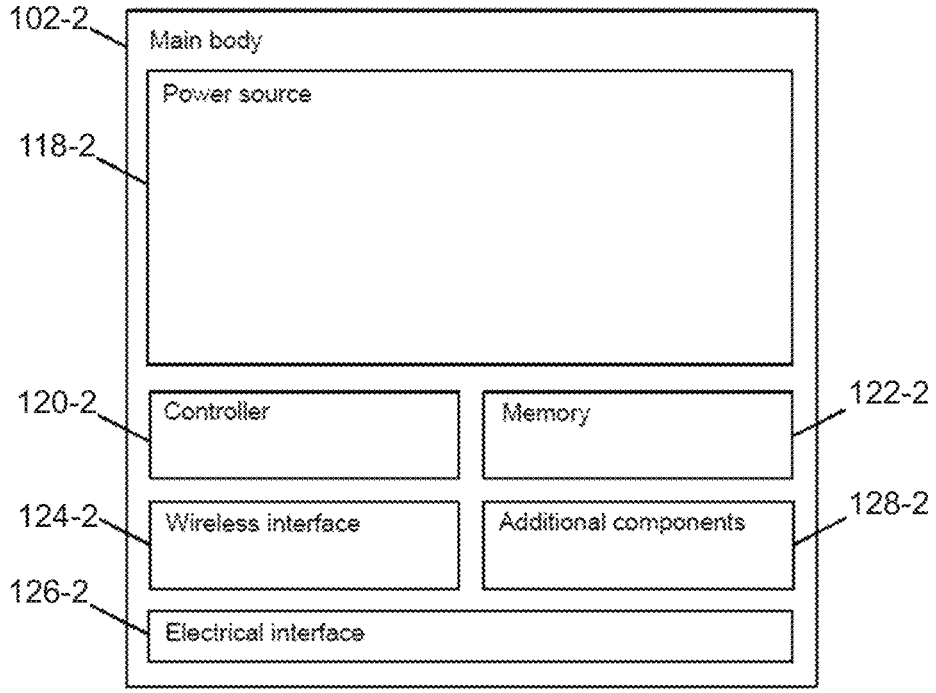
FIG. 6A is a schematic of the components of the main body of the second mode of the system.
Figure 6B:
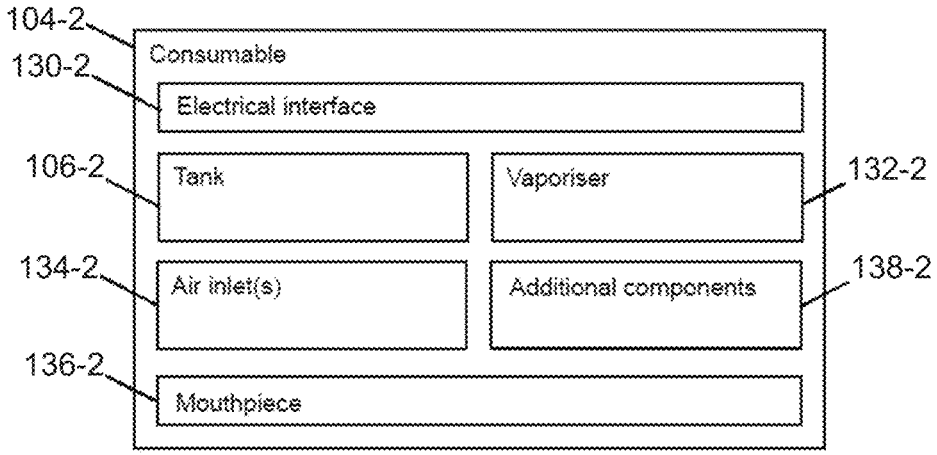
FIG. 6B is a schematic of the components of the consumable of the second mode of the system.

FIGS. 6A-6B are schematic drawings of the main body 102-2 and consumable 104-2. As is apparent from FIG. 6A, the main body 102-2 includes a power source 118-2, a controller 120-2, a memory 122-2, a wireless interface 124-2, an electrical interface 126-2, and, optionally, one or more additional components 128-2.

The power source 118-2 is preferably a battery, more preferably a rechargeable battery. The controller 120-2 may include a microprocessor, for example. The memory 122-2 preferably includes non-volatile memory. The memory may include instructions which, when implemented, cause the controller 120-2 to perform certain tasks or steps of a method.

The wireless interface 124-2 is preferably configured to communicate wirelessly with another device, for example a mobile device, e.g., via Bluetooth®. To this end, the wireless interface 124-2 could include a Bluetooth® antenna. Other wireless communication interfaces, e.g., Wi-Fi®, are also possible. The wireless interface 124-2 may also be configured to communicate wirelessly with a remote server.

The electrical interface 126-2 of the main body 102-2 may include one or more electrical contacts. The electrical interface 126-2 may be located in a base of the aperture in the upper end 108-2 of the main body 102-2. When the main body 102-2 is physically coupled to the consumable 104-2, the electrical interface 126-2 is configured to transfer electrical power from the power source 118-2 to the consumable 104-2 (i.e., upon activation of the smoking substitute system 100-2).

The electrical interface 126-2 may be configured to receive power from a charging station when the main body 102-2 is not physically coupled to the consumable 104-2 and is instead coupled to the charging station. The electrical interface 126-2 may also be used to identify the consumable 104-2 from a list of known consumables. For example, the consumable 104-2 may be a particular flavor and/or have a certain concentration of nicotine (which may be identified by the electrical interface 126-2). This can be indicated to the controller 120-2 of the main body 102-2 when the consumable 104-2 is connected to the main body 102-2. Additionally, or alternatively, there may be a separate communication interface provided in the main body 102-2 and a corresponding communication interface in the consumable 104-2 such that, when connected, the consumable 104-2 can identify itself to the main body 102-2.

The additional components 128-2 of the main body 102-2 may comprise the light 116-2 discussed above.

The additional components 128-2 of the main body 102-2 may also comprise a charging port (e.g., USB or micro-USB port) configured to receive power from the charging station (i.e., when the power source 118-2 is a rechargeable battery). This may be located at the lower end 110-2 of the main body 102-2. Alternatively, the electrical interface 126-2 discussed above may be configured to act as a charging port configured to receive power from the charging station such that a separate charging port is not required.

The additional components 128-2 of the main body 102-2 may, if the power source 118-2 is a rechargeable battery, include a battery charging control circuit, for controlling the charging of the rechargeable battery. However, a battery charging control circuit could equally be located in the charging station (if present).

The additional components 128-2 of the main body 102-2 may include a sensor, such as an airflow (i.e., puff) sensor for detecting airflow in the smoking substitute system 100-2, e.g., caused by a user inhaling through a mouthpiece 136-2 of the consumable 104-2. The smoking substitute system 100-2 may be configured to be activated when airflow is detected by the airflow sensor. This sensor could alternatively be included in the consumable 104-2. The airflow sensor can be used to determine, for example, how heavily a user draws on the mouthpiece or how many times a user draws on the mouthpiece in a particular time period.

The additional components 128-2 of the main body 102-2 may include a user input, e.g., a button. The smoking substitute system 100-2 may be configured to be activated when a user interacts with the user input (e.g., presses the button). This provides an alternative to the airflow sensor as a mechanism for activating the smoking substitute system 100-2.

As shown in FIG. 6B, the consumable 104-2 includes the tank 106-2, an electrical interface 130-2, a vaporizer 132-2, one or more air inlets 134-2, a mouthpiece 136-2, and one or more additional components 138-2.

The electrical interface 130-2 of the consumable 104-2 may include one or more electrical contacts. The electrical interface 126-2 of the main body 102-2 and an electrical interface 130-2 of the consumable 104-2 are configured to contact each other and thereby electrically couple the main body 102-2 to the consumable 104-2 when the lower end 111-2 of the consumable 104-2 is inserted into the upper end 108-2 of the main body 102-2 (as shown in FIG. 5A). In this way, electrical energy (e.g., in the form of an electrical current) is able to be supplied from the power source 118-2 in the main body 102-2 to the vaporizer 132-2 in the consumable 104-2.

The vaporizer 132-2 is configured to heat and vaporize e-liquid contained in the tank 106-2 using electrical energy supplied from the power source 118-2. As will be described further below, the vaporizer 132-2 includes a heating filament and a wick. The wick draws e-liquid from the tank 106-2 and the heating filament heats the e-liquid to vaporize the e-liquid.

The one or more air inlets 134-2 are preferably configured to allow air to be drawn into the smoking substitute system 100-2, when a user inhales through the mouthpiece 136-2. When the consumable 104-2 is physically coupled to the main body 102-2, the air inlets 134-2 receive air, which flows to the air inlets 134-2 along a gap between the main body 102-2 and the lower end 111-2 of the consumable 104-2.

In operation, a user activates the smoking substitute device 100-2, e.g., through interaction with a user input forming part of the main body 102-2 or by inhaling through the mouthpiece 136-2 as described above. Upon activation, the controller 120-2 may supply electrical energy from the power source 118-2 to the vaporizer 132-2 (via electrical interfaces 126-2, 130-2), which may cause the vaporizer 132-2 to heat e-liquid drawn from the tank 106-2 to produce a vapor which is inhaled by a user through the mouthpiece 136-2.

An example of one of the one or more additional components 138-2 of the consumable 104-2 is an interface for obtaining an identifier of the consumable 104-2. As discussed above, this interface may be, for example, an RFID reader, a barcode, a QR code reader, or an electronic interface which is able to identify the consumable. The consumable 104-2 may, therefore include any one or more of an RFID chip, a barcode or QR code, or memory within which is an identifier, and which can be interrogated via the electronic interface in the main body 102-2.

It should be appreciated that the smoking substitute system 100-2 shown in FIGS. 5A-6B is just one exemplary implementation of a smoking substitute system. For example, the system could otherwise be in the form of an entirely disposable (single-use) system or an open system in which the tank is refillable (rather than replaceable).

Figure 7A:
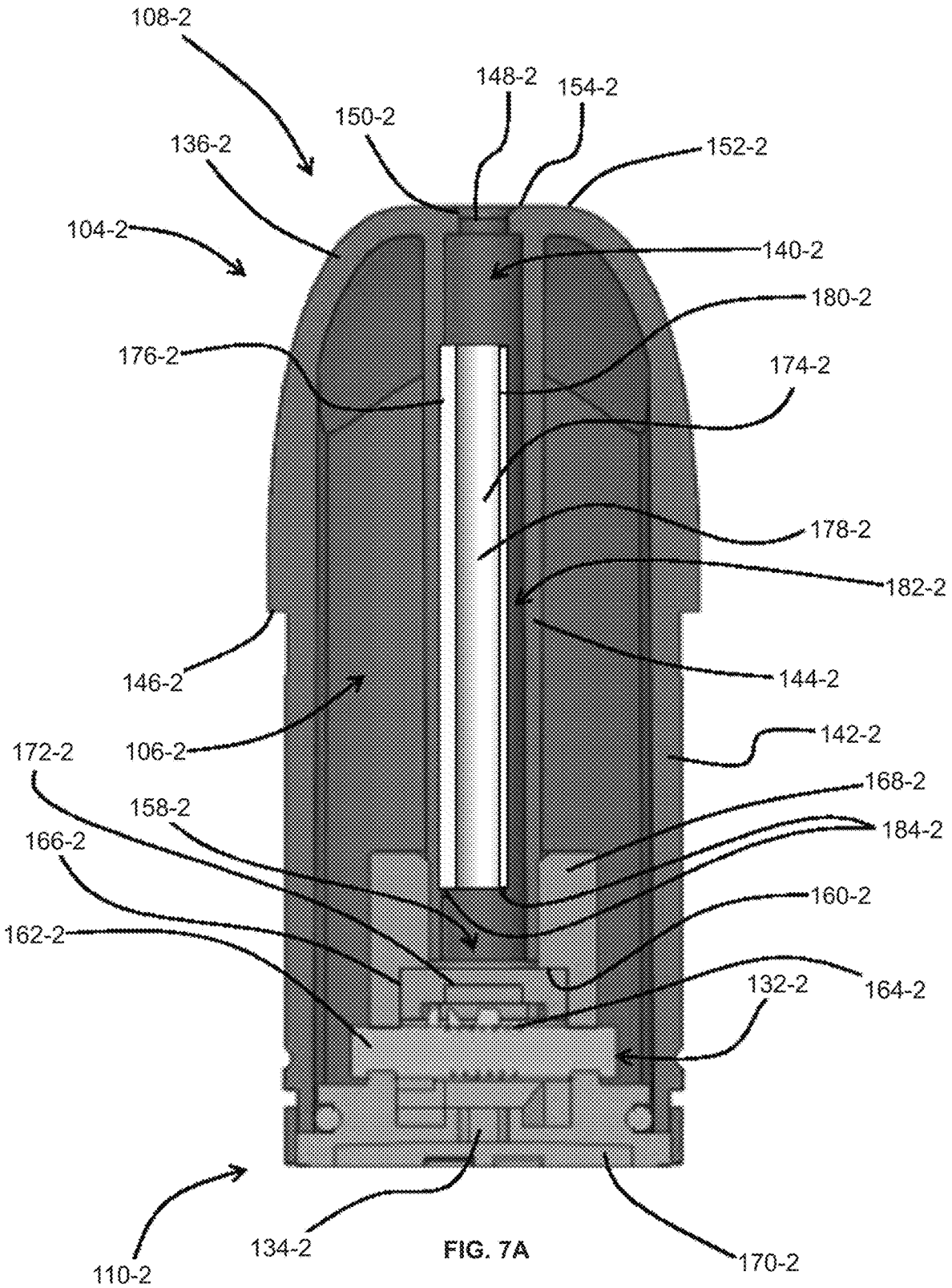
FIG. 7A is a section view of the consumable of the second mode of the system.

FIG. 7A is a section view of the consumable 104-2 described above. The consumable 104-2 comprises a tank 106-2 for storing e-liquid, a mouthpiece 136-2 and a passage 140-2 extending along a longitudinal axis of the consumable 104-2. In the illustrated embodiment the passage 140-2 is in the form of a tube having a substantially circular transverse cross-section (i.e., transverse to the longitudinal axis). The tank 106-2 surrounds the passage 140-2, such that the passage 140-2 extends centrally through the tank 106-2.

A tank housing 142-2 of the tank 106-2 defines an outer casing of the consumable 104-2, whilst a passage wall 144-2 defines the passage 140-2. The tank housing 142-2 extends from the lower end 111-2 of the consumable 104-2 to the mouthpiece 136-2 at the upper end 109-2 of the consumable 104-2. At the junction between the mouthpiece 136-2 and the tank housing 142-2, the mouthpiece 136-2 is wider than the tank housing 142-2, so as to define a lip 146-2 that overhangs the tank housing 142-2. This lip 146-2 acts as a stop feature when the consumable 104-2 is inserted into the main body 102-2 (i.e., by contact with an upper edge of the main body 102-2).

The tank 106-2, the passage 140-2 and the mouthpiece 136-2 are integrally formed with each other so as to form a single unitary component. As will be described further below with respect to FIG. 8, this component may be formed by way of an injection molding process and, for example, may be formed of a thermoplastic material such as polypropylene.

Although not immediately apparent from the figures, the tank housing 142-2 tapers, such that the thickness of the tank housing 142-2 decreases in a first demolding direction (as will be discussed further with respect to FIG. 8). In FIG. 7A the first demolding direction is in a downward direction away from the mouthpiece 136-2. This means that, aside from a small number of indents (which provide physical connection between the consumable 104-2 and the main body 102-2), the thickness of the tank housing 142-2 decreases with increasing distance away from the mouthpiece 136-2. In particular, the tank housing 142-2 tapers in this way, because internal and external surfaces of the tank housing 142-2 are angled with respect to the first demolding direction. This tapering assists in forming the tank housing 142-2 and passage wall 144-2 as a single (i.e., unitary) component.

Like the tank housing 142-2, the passage wall 144-2 is also tapered such that the thickness of the passage wall 144-2 decreases along the first demolding direction. Again, the thickness of the passage wall 144-2 decreases due to internal and external surfaces of the passage wall 144-2 being angled with respect to the first demolding direction. As a result of the tapering of the passage wall 144-2, the passage 140-2 has an internal diameter that decreases in a downstream direction (i.e., an upward direction in FIG. 7A). For example, the passage 140-2 has an internal width less than 4.0 mm and greater than 3.0 mm at an upstream end of the passage 140-2 (e.g., approximately 3.6 mm). On the other hand, the passage 140-2 has an internal width of less than 3.8 mm and greater than 2.8 mm at the downstream end of the passage 140-2 (e.g., approximately 3.4 mm).

The mouthpiece 136-2 comprises a mouthpiece aperture 148-2 defining an outlet of the passage 140-2. The mouthpiece aperture 148-2 has a radially inwardly directed inner surface 150-2, which joins an outer surface 152-2 of the mouthpiece 136-2 (i.e., a surface which contacts a user's lips in use) at an outer edge 154-2 of the mouthpiece aperture 148-2. At this outer edge 154-2, the included angle between the inner surface 150-2 of the mouthpiece aperture 148-2 and the outer surface 152-2 of the mouthpiece 136-2 (i.e., the "mouthpiece angle") is greater than 90 degrees. In the illustrated embodiment, this is due to the outer edge 154-2 being rounded. This edge 154-2 may otherwise be chamfered or beveled.

The vaporizer 132-2 is located in a vaporizing chamber 156-2 of the consumable 104-2. The vaporizing chamber 156-2 is downstream of the inlet 134-2 of the consumable 104-2 and is fluidly connected to the mouthpiece aperture 148-2 (i.e., outlet) by the passage 140-2. In particular, the passage 140-2 extends between the mouthpiece aperture 148-2 and an opening 158-2 from the chamber 156-2. This opening 158-2 is formed in a downstream (i.e., upper) wall 160-2 of the chamber 156-2.

The vaporizer 132-2 comprises a porous wick 162-2 and a heater filament 164-2 coiled around the porous wick 162-2. As is apparent from FIGS. 7A-7B, the wick 162-2 extends transversely across the chamber 156-2 between sidewalls 166-2 of the chamber 156-2 which form part of an inner sleeve 168-2 of an insert 170-2 that defines the lower end 111-2 of the consumable 104-2 (i.e., that connects with the main body 102-2). The insert 170-2 is inserted into an open lower end of the tank 106-2 so as to seal against the tank housing 142-2.

In this way, the inner sleeve 168-2 projects into the tank 106-2 and seals with the passage 140-2 (around the passage wall 144-2) so as to separate the chamber 156-2 from the e-liquid in the tank 106-2. Ends of the wick 162-2 project through apertures in the inner sleeve 168-2 and into the tank 106-2 so as to be in contact with the e-liquid in the tank 106-2. In this way, e-liquid is transported along the wick 162-2 (e.g., by capillary action) to a central portion of the wick 162-2 that is exposed to airflow through the chamber 156-2. The transported e-liquid is heated by the heater filament 164-2 (when activated, e.g., by detection of inhalation), which causes the e-liquid to be vaporized and to be entrained in air flowing past the wick 162-2. This vaporized liquid may cool to form an aerosol in the passage 140-2, which may then be inhaled by a user.

In some cases, un-vaporized liquid can be carried by air flowing through the chamber 156-2. This may be undesirable for a user. To reduce this, the consumable 104-2 comprises a baffle 172-2. The baffle 172-2 extends across the chamber 156-2 so as to be interposed between the vaporizer 132-2 and the passage opening 158-2. In this way, un-vaporized liquid from the wick 162-2 may collect on an upstream (i.e., lower) planar surface of the baffle 172-2 rather than entering the passage 140-2.

Whilst the baffle 172-2 may restrict the flow of some un-vaporized liquid into the passage 140-2, some liquid may still enter the passage 140-2. In order to prevent (or at least restrict) this un-vaporized liquid from being inhaled by a user (through the mouthpiece aperture 148-2), the consumable 104-2 comprises an elongate filter 174-2 extending longitudinally within the passage 140-2.

Figure 7B:
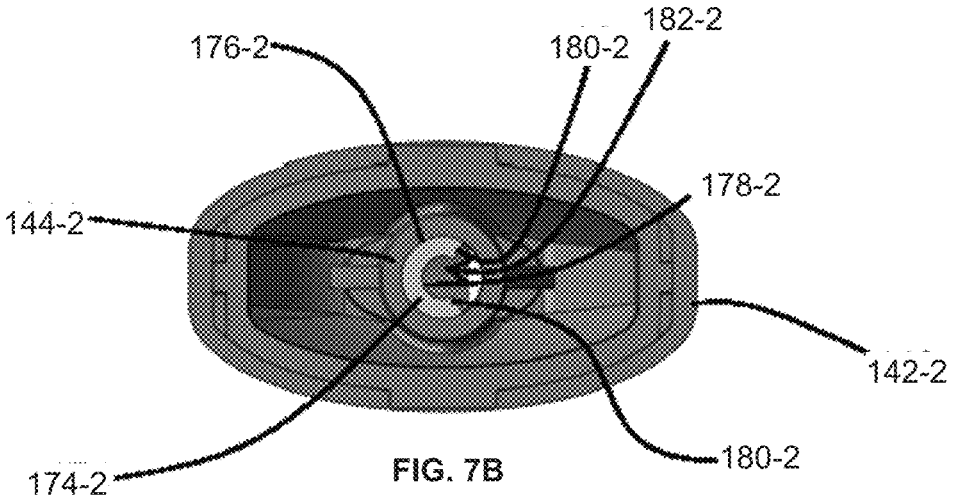
FIG. 7B is a bottom view of a tank and passage of the consumable of the second mode of the system.

As is particularly apparent from FIG. 7B, the filter 174-2 has a cross-sectional shape that is an annulus sector (i.e., a portion of an annulus). In particular, the central angle of the annulus sector is approximately 240 degrees. This cross-sectional shape is consistent for the length of the filter 174-2. In this way, the filter 174-2 may be formed by way of, e.g., an extrusion process. In particular, the filter 174-2 comprises an outer circumferential surface 176-2 that lies against an inner surface of the passage wall 144-2, an inner circumferential surface 178-2 that is spaced inwardly from the outer circumferential surface 176-2 and two end surfaces 180-2 that join the inner 178-2 and outer 176-2 circumferential surfaces. The inner circumferential surface 178-2 and the end surfaces 180-2 are each spaced from the inner surface of the passage wall 144-2. This space defines an elongate airflow path 182-2 that extends longitudinally between the filter 174-2 and the passage wall 144-2. This airflow path 182-2 helps to reduce pressure drop (caused by the presence of the filter) through the passage 140-2.

The filter 174-2 is partly retained in the passage 140-2 by its shape (including, e.g., the contact between the passage wall 144-2 and the outer circumferential surface 176-2). The filter 174-2 is retained against upstream movement in the passage 140-2 by a retainer arrangement in the form of a plurality of projections 184-2 extending inwardly from the passage wall 144-2. Whilst not apparent from FIG. 7B, these projections 184-2 each comprise a retaining surface extending transversely inwardly from the passage wall 144-2, and a sloped surface extending (upstream) from an inner edge of the retaining surface to the passage wall 144-2. The sloped surface allows the filter 174-2 to be inserted into the passage 140-2 via the opening 158-2 (e.g., during manufacture).

Whilst the illustrated filter 174-2 has a cross-sectional shape that is an annulus sector, other shapes may be used in order to provide an airflow path between the filter and the passage wall. Two variations of the filter 174-2 are illustrated in FIGS. 8-9. Similar reference numerals have been used in these figures to denote similar features.

Figure 8:
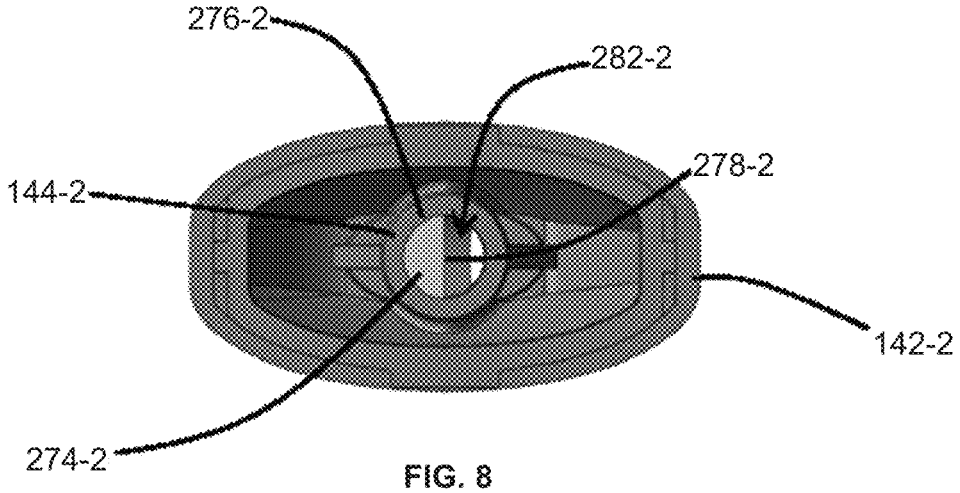
FIG. 8 is a variation of a filter for use in the consumable of the second mode of the system.
Figure 9:
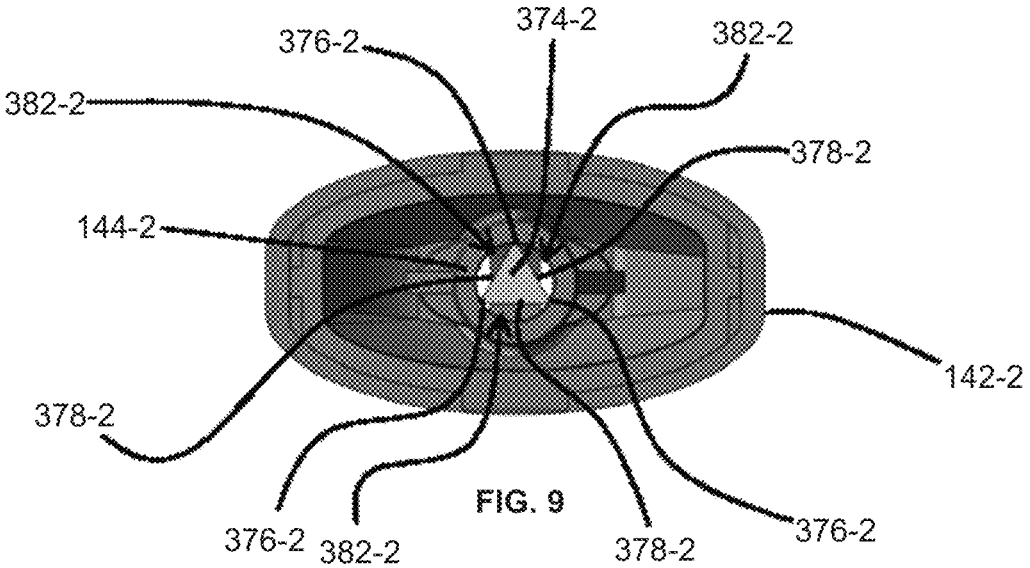
FIG. 9 is a further variation of a filter for use in the consumable of the second mode of the system.

In FIG. 8, the filter 274-2 has a cross-sectional shape that is a circle sector (in this case having a central angle of 180 degrees so as to be a semi-circle). In other embodiments the circle sector may have a different central angle (such as an angle greater than 180 degrees). The filter 274-2 comprises a circumferential surface 276-2 that contacts an inner surface of the passage wall 144-2, and a planar (diametrical) surface 278-2 that extends diametrically across the passage 140-2. The planar surface 278-2 is spaced from the inner surface of the passage wall 144-2 so as to define an airflow path 282-2 between the filter 274-2 and the passage wall 144-2.

In FIG. 9, the filter 374-2 has a cross-sectional shape that is a triangle. The filter 374-2 comprises three longitudinal edges 376-2 and three planar surfaces 378-2 extending between the longitudinal edges 376-2. Each longitudinal edge 376-2 contacts the passage wall 144-2 so as to help retain the filter 374-2 in the passage 140-2. Each of the planar surfaces 378-2 is spaced from the inner surface of the passage wall 344-2 so as to define a respective airflow path extending longitudinally between the filter 374-2 and the passage wall 144-2. Thus, in this embodiment, three airflow paths extend between the filter 374-2 and the passage wall 144-2.

Figure 10:
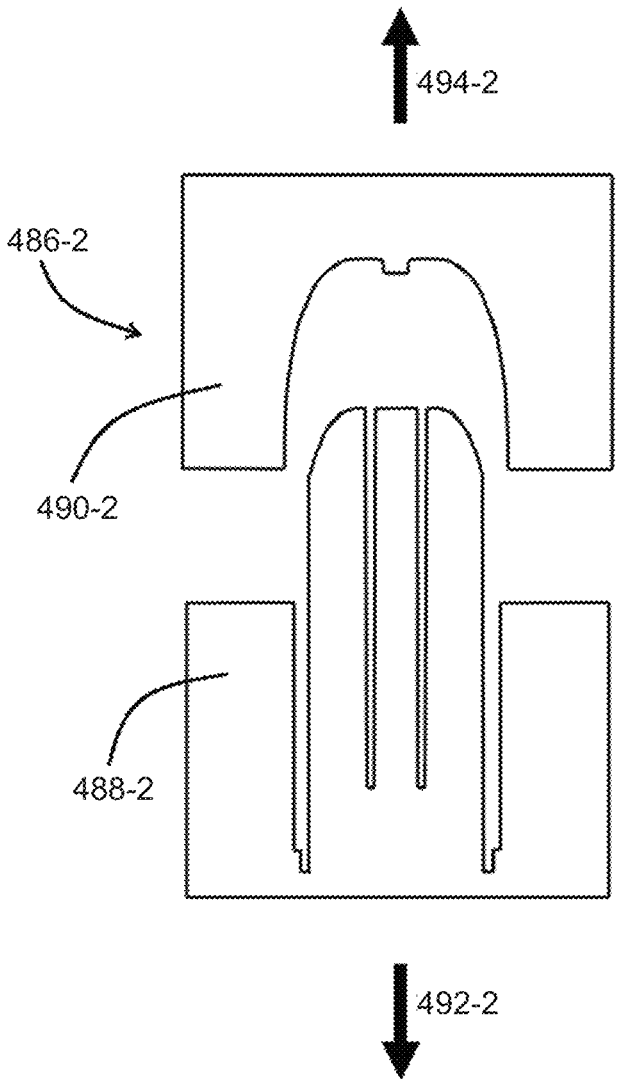
FIG. 10 is a section view of a manufacturing assembly for manufacturing the consumable of the second mode of the system.

FIG. 10 shows a drawing of a manufacturing assembly 486-2 which is used to manufacture the consumable 104-2 described above. The manufacturing assembly 486-2 comprises a first mold 488-2 and a second mold 490-2.

The first mold 488-2 has a shape which complements that of a first end of the integrally formed tank housing 142-2 and mouthpiece 136-2. The first mold 488-2 therefore has a shape which matches the inner surfaces defining the tank 106-2.

The second mold 490-2 has a shape which complements that of a second end of the integrally formed tank housing 142-2 and mouthpiece 136-2. The second mold 490-2 has a shape which matches the outer surface of the mouthpiece 136-2 and the inner surface of the mouthpiece aperture 148-2.

When the first mold 488-2 and the second mold 490-2 are brought together, they define a closed cavity which has the shape of the tank housing 142-2, the mouthpiece 136-2 and the passage walls 144-2.

To manufacture these components, heated material is injected into the cavity between the first mold 488-2 and the second mold 490-2. At this point, the first mold 488-2 and the second mold 490-2 meet at a boundary between external surfaces of the mouthpiece 136-2 and the tank housing 142-2.

The material is subsequently cooled, and the first mold 488-2 and the second mold 490-2 are separated, with the first mold 488-2 travelling in a first demolding direction 492-2 (i.e., away from the second mold 490-2) and the second mold 490-2 travelling in a second demolding direction 494-2 (i.e., away from the first mold 488-2 and opposite to the first demolding direction 492-2). For a particular component, a demolding direction is a direction along which a mold which contacts that component is removed during an injection molding process.

The filter 174-2 is then inserted in the passage 140-2 via the passage opening 158-2. Subsequently, the insert 170-2 (e.g., including the vaporizer) and any additional components are inserted into the tank 106-2 to form the consumable 104-2.

Third Mode: A Consumable for a Smoking Substitute Device in which a Tank and a Mouthpiece are Integrally Formed Wherein the External Surface of the Consumable is Adapted for Receiving a Filter for Filtering Unvaporized Liquid Out of the Aerosol Vapor Aspects and embodiments of the third mode of the present disclosure will now be discussed with reference to the accompanying figures. Further aspects and embodiments will be apparent to those skilled in the art. All documents mentioned in this text are incorporated herein by reference.

Figure 11A:
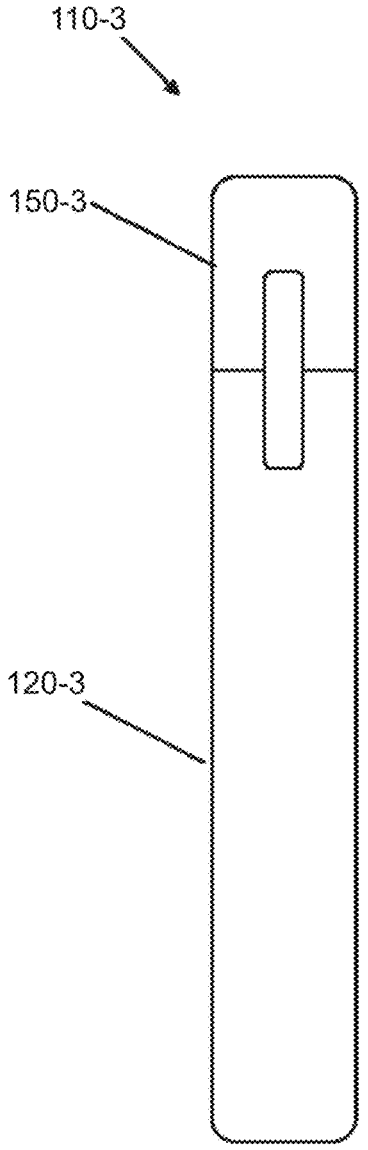
FIG. 11A is a side view of a third mode of the smoking substitute device.

FIG. 11A shows a smoking substitute device 110-3. In this example, the smoking substitute device 110-3 includes a main body 120-3 and a consumable 150-3. The consumable 150-3 may alternatively be referred to as a "pod". The consumable may also be referred to as a cartridge or cartomizer.

In this example, the smoking substitute device 110-3 is a closed system vaping device, wherein the consumable 150-3 includes a liquid reservoir or sealed tank 156-3 and is intended for one-use only.

FIG. 11A shows the smoking substitute device 110-3 with the main body 120-3 physically coupled to the consumable 150-3.

Figure 11B:
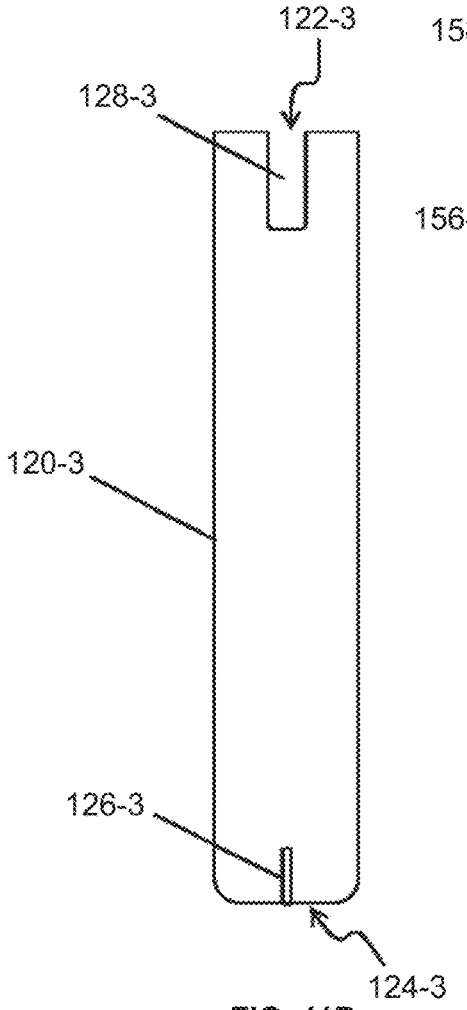
FIG. 11B is a side view of main body of the third mode of the device.

FIG. 11B shows the main body 120-3 of the smoking substitute device 110-3 without the consumable 150-3.

Figure 11C:
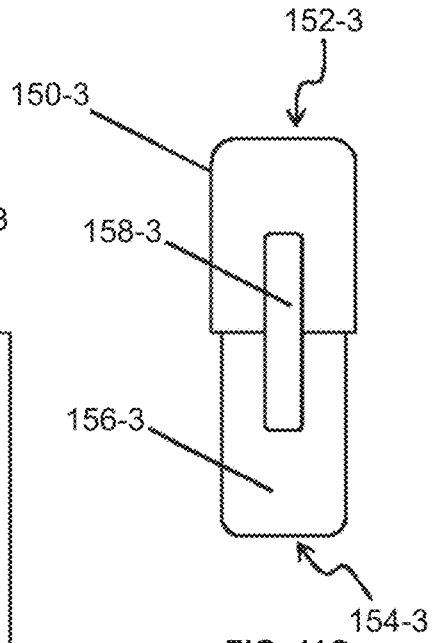
FIG. 11C is a side view of consumable of the third mode of the device.

FIG. 11C shows the consumable 150-3 of the smoking substitute device 110-3 without the main body 120-3.

The main body 120-3 and the consumable 150-3 are configured to be physically coupled together, in this example by pushing the consumable 150-3 into an aperture in a top end 122-3 of the main body 120-3, such that there is an interference fit between the main body 120-3 and the consumable 150-3. In other examples, the main body 120-3 and the consumable could be physically coupled together by screwing one onto the other, or through a bayonet fitting, for example. An optional light 126-3, e.g., an LED, located behind a small translucent cover, is located a bottom end 124-3 of the main body 120-3. The light 126-3 may be configured to illuminate when the smoking substitute device 110-3 is activated.

The consumable 150-3 includes a mouthpiece (not shown in FIGS. 11A-11C) at a top end 152-3 of the consumable 150-3, as well as one or more air inlets (not shown) so that air can be drawn into the smoking substitute device 110-3 when a user inhales through the mouthpiece. At a bottom end 154-3 of the consumable 150-3, there is located a tank 156-3 that contains e-liquid. The tank 156-3 may be a translucent body, for example.

The tank 156-3 preferably includes a window 158-3, so that the amount of e-liquid in the tank 156-3 can be visually assessed. The main body 120-3 includes a slot 128-3 so that the window 158-3 of the consumable 150-3 can be seen whilst the rest of the tank 156-3 is obscured from view when the consumable 150-3 is inserted into the aperture in the top end 122-3 of the main body 120-3.

The tank 156-3 may be referred to as a "clearomizer" if it includes a window 158-3, or a "cartomizer" if it does not.

The consumable 150-3 may identify itself to the main body 120-3, via an electrical interface, RFID chip, or barcode.

Figure 12A:
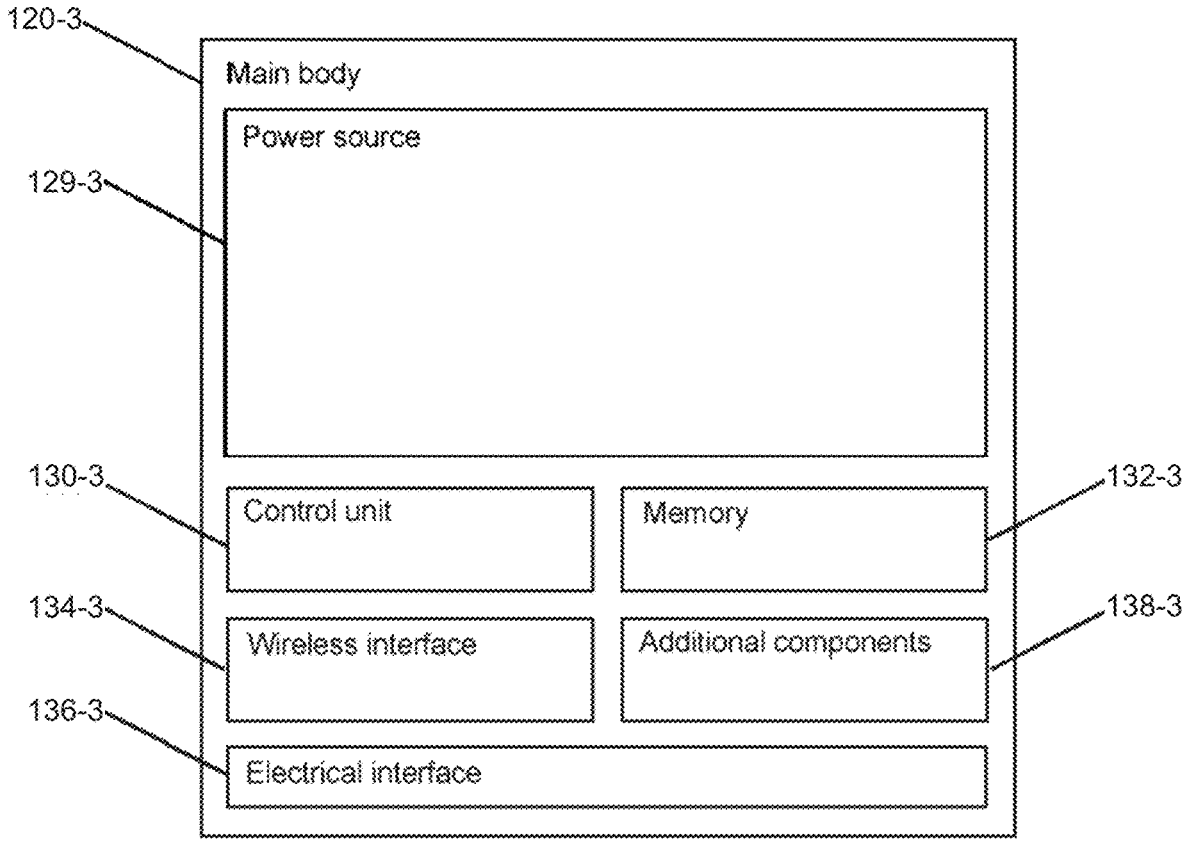
FIG. 12A is a schematic drawing of the main body of the third mode of the device.

FIG. 12A is a schematic drawing of the main body 120-3 of the smoking substitute device 110-3.

Figure 12B:
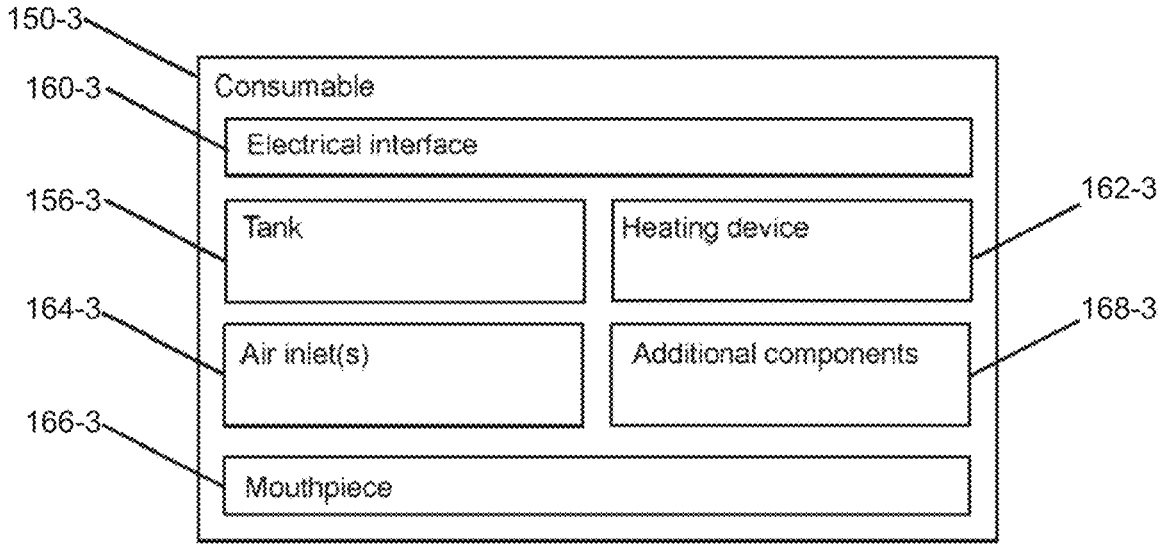
FIG. 12B is a schematic drawing of the consumable of the third mode of the device.

FIG. 12B is a schematic drawing of the consumable 150-3 of the smoking substitute device 110-3.

As shown in FIG. 12A, the main body 120-3 includes a power source 129-3, a control unit 130-3, a memory 132-3, a wireless interface 134-3, an electrical interface 136-3, and, optionally, one or more additional components 138-3.

The power source 129-3 is preferably a battery, more preferably a rechargeable battery.

The control unit 130-3 may include a microprocessor, for example.

The memory 132-3 is preferably includes non-volatile memory. The memory may include instructions which, when implemented, cause the control unit 130-3 to perform certain tasks or steps of a method.

The wireless interface 134-3 is preferably configured to communicate wirelessly with another device, for example a mobile device, e.g., via Bluetooth®. To this end, the wireless interface 134-3 could include a Bluetooth® antenna. Other wireless communication interfaces, e.g., Wi-Fi®, are also possible. The wireless interface 134-3 may also be configured to communicate wirelessly with a remote server.

The electrical interface 136-3 of the main body 120-3 may include one or more electrical contacts. The electrical interface 136-3 may be located in, and preferably at the bottom of, the aperture in the top end 122-3 of the main body 120-3. When the main body 120-3 is physically coupled to the consumable 150-3, the electrical interface 136-3 may be configured to pass electrical power from the power source 129-3 to (e.g., a heating device of) the consumable 150-3 when the smoking substitute device 110-3 is activated, e.g., via the electrical interface 160-3 of the consumable 150-3 (discussed below). The electrical interface may be configured to receive power from a charging station, when the main body 120-3 is not physically coupled to the consumable 150-3 and is instead coupled to the charging station. The electrical interface 136-3 may also be used to identify the consumable 150-3 from a list of known consumables. For example, the consumable may be a particular flavor and/or have a certain concentration of nicotine. This can be identified to the control unit 130-3 of the main body 120-3 when the consumable is connected to the main body. Additionally, or alternatively, there may be a separate communication interface provided in the main body 120-3 and a corresponding communication interface in the consumable 150-3 such that, when connected, the consumable can identify itself to the main body 120-3.

The additional components 138-3 of the main body 120-3 may comprise the optional light 126-3 discussed above.

The additional components 138-3 of the main body 120-3 may, if the power source 129-3 is a rechargeable battery, comprise a charging port configured to receive power from the charging station. This may be located at the bottom end 124-3 of the main body 120-3. Alternatively, the electrical interface 136-3 discussed above is configured to act as a charging port configured to receive power from the charging station such that a separate charging port is not required.

The additional components 138-3 of the main body 120-3 may, if the power source 129-3 is a rechargeable battery, include a battery charging control circuit, for controlling the charging of the rechargeable battery. However, a battery charging control circuit could equally be located in the charging station (if present).

The additional components 138-3 of the main body 120-3 may include an airflow sensor for detecting airflow in the smoking substitute device 110-3, e.g., caused by a user inhaling through a mouthpiece 166-3 (discussed below) of the smoking substitute device 110-3. The smoking substitute device 110-3 may be configured to be activated when airflow is detected by the airflow sensor. This optional sensor could alternatively be included in the consumable 150-3 (though this is less preferred where the consumable 150-3 is intended to be disposed of after use, as in this example). The airflow sensor can be used to determine, for example, how heavily a user draws on the mouthpiece or how many times a user draws on the mouthpiece in a particular time period.

The additional components 138-3 of the main body 120-3 may include an actuator, e.g., a button. The smoking substitute device 110-3 may be configured to be activated when the actuator is actuated. This provides an alternative to the airflow sensor noted, as a mechanism for activating the smoking substitute device 110-3.

As shown in FIG. 12B, the consumable 150-3 includes the tank 156-3, an electrical interface 160-3, a heating device 162-3, one or more air inlets 164-3, a mouthpiece 166-3, and, optionally, one or more additional components 168-3.

The electrical interface 160-3 of the consumable 150-3 may include one or more electrical contacts. The electrical interface 136-3 of the main body 120-3 and an electrical interface 160-3 of the consumable 150-3 are preferably configured to contact each other and thereby electrically couple the main body 120-3 to the consumable 150-3 when the bottom end 154-3 of the consumable 150-3 is inserted into the top end of the main body 120-3 (as shown in FIG. 11A) to physically coupled the consumable 150-3 to the main body 120-3. In this way, electrical energy (e.g., in the form of an electrical current) is able to be supplied from the power source 129-3 in the main body 120-3 to the heating device 162-3 in the consumable 150-3.

The heating device 162-3 is preferably configured to heat e-liquid contained in the tank 156-3, e.g., using electrical energy supplied from the power source 129-3, in order to vaporize the e-liquid. In one example, the heating device 162-3 includes a heating filament and a wick, wherein a first portion of the wick extends into the tank 156-3 in order to draw e-liquid out from the tank 156-3, and wherein the heating filament coils around a second portion of the wick located outside the tank 156-3. In this example, the heating filament is configured to heat up e-liquid drawn out of the tank 156-3 by the wick to produce an aerosol vapor.

The one or more air inlets 164-3 are preferably configured to allow air to be drawn into the smoking substitute device 110-3, when a user inhales through the mouthpiece 166-3. When the consumable 150-3 is physically coupled to the main body 120-3, the air inlet 164-3 receives air which flows from the top end 122-3 of the main body 120-3, between the main body 120-3 and the bottom end 154-3 of the consumable 150-3.

In use, a user activates the smoking substitute device 110-3, e.g., through actuating an actuator included in the main body 120-3 or by inhaling through the mouthpiece 166-3 as described above. Upon activation, the control unit 130-3 may supply electrical energy from the power source 129-3 to the heating device 162-3 (via electrical interfaces 136-3, 160-3), which may cause the heating device 162-3 to heat e-liquid drawn from the tank 156-3 to produce a vapor which is inhaled by a user through the mouthpiece 166-3.

As an example of one of the one or more additional components 168-3, an interface for obtaining an identifier of the consumable may be provided. As discussed above, this interface may be, for example, an RFID reader, a barcode or QR code reader, or an electronic interface which is able to identify the consumable to the main body. The consumable may, therefore, include any one or more of an RFID chip, a barcode or QR code, or memory within which is an identifier, and which can be interrogated via the electronic interface in the main body.

Of course, a skilled reader would readily appreciate that the smoking substitute device 110-3 shown in FIGS. 11A-11C and FIGS. 12A-12B shows just one example implementation of a smoking substitute device, and that other forms of smoking substitute device could be used.

As another example, an entirely disposable (one use) smoking substitute device could be used as the smoking substitute device.

Figure 13A:
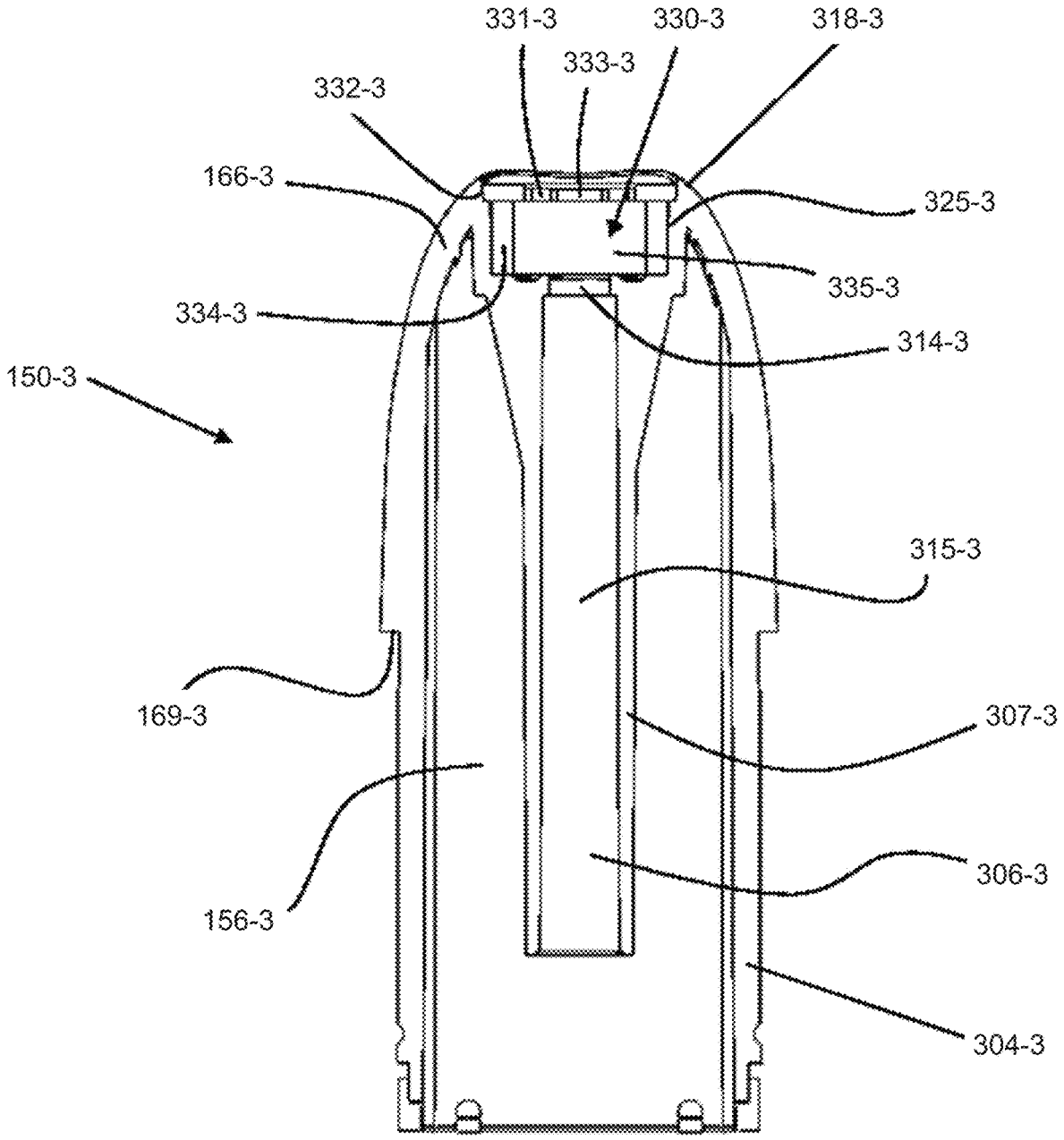
FIG. 13A is a cross-sectional view of the consumable of the third mode of the device.

FIG. 13A shows a cross-sectional view of a consumable 150-3. The consumable comprises a tank 156-3 for storing e-liquid, a mouthpiece 166-3 and an outlet 306-3, which in this example is a chimney or tube. The tank 156-3 surrounds the outlet 306-3, with the outlet extending through a central portion of the tank 156-3. The outlet 306-3 has a substantially circular cross-section. The outlet 306-3 defines a central void 315-3 which extends along the entire length of the outlet.

The tank 156-3 is provided by an outer casing of the consumable 150-3, and for clarity details of the heating device are omitted. The outer casing of the consumable 150-3 comprises a tank wall 304-3. The tank wall 304-3 extends completely around the outlet 306-3 to define the tank 156-3 in the form of an annulus between the outlet 306-3 and the tank wall 304-3. The tank wall 304-3 extends from the bottom of the consumable up to the mouthpiece 166-3. Where the tank wall 304-3 meets the mouthpiece 166-3, the mouthpiece 166-3 has a larger outer width than the tank 156-3, which means that there is a lip 169-3 around the bottom of the mouthpiece 166-3.

The tank wall 304-3 tapers, which means that it has a thickness which decreases. The thickness of the tank wall 304-3 decreases along a first demolding direction, as defined below with respect to FIG. 14. The first demolding direction is a downward direction in FIG. 13A, which is a direction away from the mouthpiece 166-3. This means that, aside from a small number of indents (for example, to provide physical connection between the consumable 150-3 and the main body 120-3), the thickness of the tank wall 304-3 generally decreases with increasing distance along the first demolding direction.

The thickness of the tank wall 304-3 decreases due to internal surfaces of the tank wall 304-3 being angled to the first demolding direction at a first tank draft angle. Additionally, the thickness of the tank wall 304-3 decreases due to external surfaces of the tank wall 304-3 being angled to the first demolding direction at a second tank draft angle.

The first tank draft angle is preferably at least 0.5 degrees. The second tank draft angle is preferably at least 0.5 degrees.

The first tank draft angle is preferably not more than 3.5 degrees. The second tank draft angle is preferably not more than 3.5 degrees.

It will be appreciated that the first tank draft angle and the second tank draft angle need not be the same as each other and may be selected independently according to the above draft angles. In fact, one of the first tank draft angle and the second tank draft angle may be substantially 0 degrees, while the other may vary as described above.

Similarly, the outlet 306-3 comprises an outlet wall 307-3. The outlet wall 307-3 extends fully around the circular cross-section of the outlet 306-3 to provide the outlet 306-3. The outlet wall 307-3 tapers, which means that it has a thickness which decreases. The thickness of the outlet wall 307-3 decreases along the first demolding direction, as defined below with respect to FIG. 14. As before, the first demolding direction is a downward direction in FIG. 13A, which is a direction away from the mouthpiece 166-3. This means that the thickness of the outlet wall 307-3 generally decreases along the first demolding direction. The thickness of the outlet wall 307-3 decreases due to an inner surface of the outlet wall 307-3 being angled to the first demolding direction at a first outlet draft angle. Additionally, the thickness of the outlet wall 307-3 decreases due to an external surface of the outlet wall 307-3 being angled to the first demolding direction at a second outlet draft angle.

The first outlet draft angle is preferably at least 0.5 degrees. The second outlet draft angle is preferably at least 0.5 degrees.

The first outlet draft angle is preferably not more than 3.5 degrees. The second outlet draft angle is preferably not more than 3.5 degrees.

It will be appreciated that the first outlet draft angle and the second outlet draft angle need not be the same as each other and may be selected independently according to the above draft angles. In fact, one of the first outlet draft angle and the second outlet draft angle may be substantially 0 degrees, while the other may vary as described above.

Similarly, the outlet draft angles and tank draft angles may be selected independently from each other according to the above draft angles.

The outlet 306-3 has an internal width (i.e., a width/diameter of a passage through the outlet 306-3) which generally decreases in a downstream direction (i.e., downstream with respect to the fluid flow when a user inhales, which is an upward direction in FIG. 13A). The downstream direction is a direction towards the mouthpiece 166-3 and, in this example, is an opposite direction to the first demolding direction. This decrease in width occurs due to the second outlet draft angle described above.

A difference between the internal width at the downstream end of the outlet 306-3 and the internal width at the upstream end of the outlet 306-3 is more than 0.10 mm. More specifically, the difference between the internal width at the downstream end of the outlet 306-3 and the internal width at the upstream end of the outlet 306-3 is more than 0.12 mm. More specifically, the difference between the internal width at the downstream end of the outlet 306-3 and the internal width at the upstream end of the outlet 306-3 is more than 0.14 mm. More specifically, the difference between the internal width at the downstream end of the outlet 306-3 and the internal width at the upstream end of the outlet 306-3 is more than 0.16 mm. More specifically, the difference between the internal width at the downstream end of the outlet 306-3 and the internal width at the upstream end of the outlet 306-3 is more than 0.18 mm.

The difference between the internal width at the downstream end of the outlet 306-3 and the internal width at the upstream end of the outlet 306-3 is not more than 0.30 mm. More specifically, the difference between the internal width at the downstream end of the outlet 306-3 and the internal width at the upstream end of the outlet 306-3 is not more than 0.28 mm. More specifically, the difference between the internal width at the downstream end of the outlet 306-3 and the internal width at the upstream end of the outlet 306-3 is not more than 0.26 mm. More specifically, the difference between the internal width at the downstream end of the outlet 306-3 and the internal width at the upstream end of the outlet 306-3 is not more than 0.24 mm. More specifically, the difference between the internal width at the downstream end of the outlet 306-3 and the internal width at the upstream end of the outlet 306-3 is not more than 0.22 mm.

More specifically, the difference between the internal width at the downstream end of the outlet 306-3 and the internal width at the upstream end of the outlet 306-3 is substantially 0.20 mm. The outlet 306-3 is substantially 30 mm long. In other examples, the outlet 306-3 may have a length less than 30 mm.

The airway has an internal width less than 5.0 mm at an upstream end of the outlet 306-3. More specifically, the airway has an internal width less than 4.5 mm at the upstream end of the outlet 306-3. More specifically, the airway has an internal width less than 4.2 mm at the upstream end of the outlet 306-3. More specifically, the airway has an internal width less than 4.0 mm at the upstream end of the outlet 306-3. More specifically, the airway has an internal width less than 3.8 mm at the upstream end of the outlet 306-3.

The airway has an internal width greater than 2.0 mm at the upstream end of the outlet 306-3. More specifically, the airway has an internal width greater than 2.5 mm at the upstream end of the outlet 306-3. More specifically, the airway has an internal width greater than 3.0 mm at the upstream end of the outlet 306-3. More specifically, the airway has an internal width greater than 3.2 mm at the upstream end of the outlet 306-3. More specifically, the airway has an internal width greater than 3.4 mm at the upstream end of the outlet 306-3.

More specifically, the airway has an internal width of substantially 3.6 mm at the upstream end of the outlet 306-3.

The airway has an internal width less than 4.8 mm at a downstream end of the outlet 306-3. More specifically, the airway has an internal width less than 4.3 mm at the downstream end of the outlet 306-3. More specifically, the airway has an internal width less than 4.0 mm at the downstream end of the outlet 306-3. More specifically, the airway has an internal width less than 3.8 mm at the downstream end of the outlet 306-3. More specifically, the airway has an internal width less than 3.6 mm at the downstream end of the outlet 306-3.

The airway has an internal width greater than 1.8 mm at the downstream end of the outlet 306-3. More specifically, the airway has an internal width greater than 2.3 mm at the upstream end of the outlet 306-3. More specifically, the airway has an internal width greater than 2.8 mm at the downstream end of the outlet 306-3. More specifically, the airway has an internal width greater than 3.0 mm at the downstream end of the outlet 306-3. More specifically, the airway has an internal width greater than 3.2 mm at the downstream end of the outlet 306-3.

More specifically, the airway has an internal width of substantially 3.4 mm at a downstream end of the outlet 306-3.

The mouthpiece 166-3 comprises a mouthpiece aperture 314-3. The outlet 306-3 fluidly connects the heating device 162-3 to the mouthpiece 166-3, and, more specifically, the outlet 306-3 fluidly connects the heating device 162-3 to the mouthpiece aperture 314-3.

The outer surface 318-3 of the mouthpiece 166-3 of the consumable forms a recess adjacent the mouthpiece aperture 314-3. The recess is defined by an inner cylindrical wall 325-3.

A removable filter 330-3 is shown positioned in the consumable 150-3. The mouthpiece 166-3 of the consumable includes a recessed portion of the outer surface 318-3 of the mouthpiece 166-3. The inner wall 325-3 of the recess is sized to accommodate the filter 330-3 in a snug fit, thereby securing the filter 330-3 in the recess by interference fit. The filter 330-3 is made from a fabric, which may be cotton or another fiber. The filter may be formed of a mesh. The filter permits flow of vaporized e-liquid through the filter 330-3 but prevents flow of unvaporized e-liquid through the filter 330-3. This reduces leakage of unvaporized e-liquid into the user's mouth. The filter 330-3 may be a porous gas-permeable and/or liquid-impermeable member/membrane.

The filter 330-3 is tubular, defined by a tubular outer wall 334-3 of an annular cross-section, and an outer surface of the tubular wall 334-3 of the filter 330-3 is in contact with an inner surface 325-3 of the recess in the outer wall of the mouthpiece. The outer wall 334-3 encloses a central filtering portion 335-3 made of a suitable filter material. The filtering portion 335-3 may be fabric, which may be cotton or another fiber. The filtering portion 335-3 may be formed of a mesh. The filtering portion 335-3 permits flow of vaporized e-liquid through the filter 330-3 but prevents flow of unvaporized e-liquid through the filter 330-3. This reduces leakage of unvaporized e-liquid into the user's mouth. The filtering portion 335-3 may be a porous gas-permeable and/or liquid-impermeable member/membrane.

An elliptical planar cap 331-3 is in place in the mouthpiece, covering the filter 330-3. The cap 331-3 is made of rigid plastics material and has an elliptical shape when viewed from above. The planar cap 331-3 defines a central aperture 333-3 through which filtered aerosol vapor may pass into the mouth of a user after passing through the filtering portion 335-3. The cap 331-3 is held in place by an interference fit between the outer annular edge of the cap 331-3 and the inner annular surface 332-3 of the recess. As seen in FIG. 13A the diameter of the cap 331-3 is slightly larger than the diameter of the filter 330-3, such that the cap covers the filter and also extends to cover a shelf formed in the wall of the recess, adjacent the outer edge of the filter. This provides a seat for the cap 331-3 when it is pushed into place in the recess, preventing further insertion. The cap has a thickness of around 0.7 mm.

The positioning of the shelf in the recess and the thickness of the cap 331-3 are such that, when properly secured in place and resting on the shelf, the cap does not protrude beyond the furthest extension of the mouthpiece. This reduces the risk that the cap comes into contact with external objects thereby reducing the risk that the cap becomes accidentally dislodged from the mouthpiece.

In another embodiment (not shown) the consumable includes a retention mechanism which keeps the filter 330-3 and/or cap 331-3 in place once positioned within the recess. This may comprise a snap fit, for example through co-operation of complementary protrusion(s) and recess(es) on the outer wall 334-3 of the filter and/or cap and inner wall 325-3 of the recess. Alternatively, a clip or releasable detent mechanism may be provided to secure the filter and/or cap.

Figure 13B:
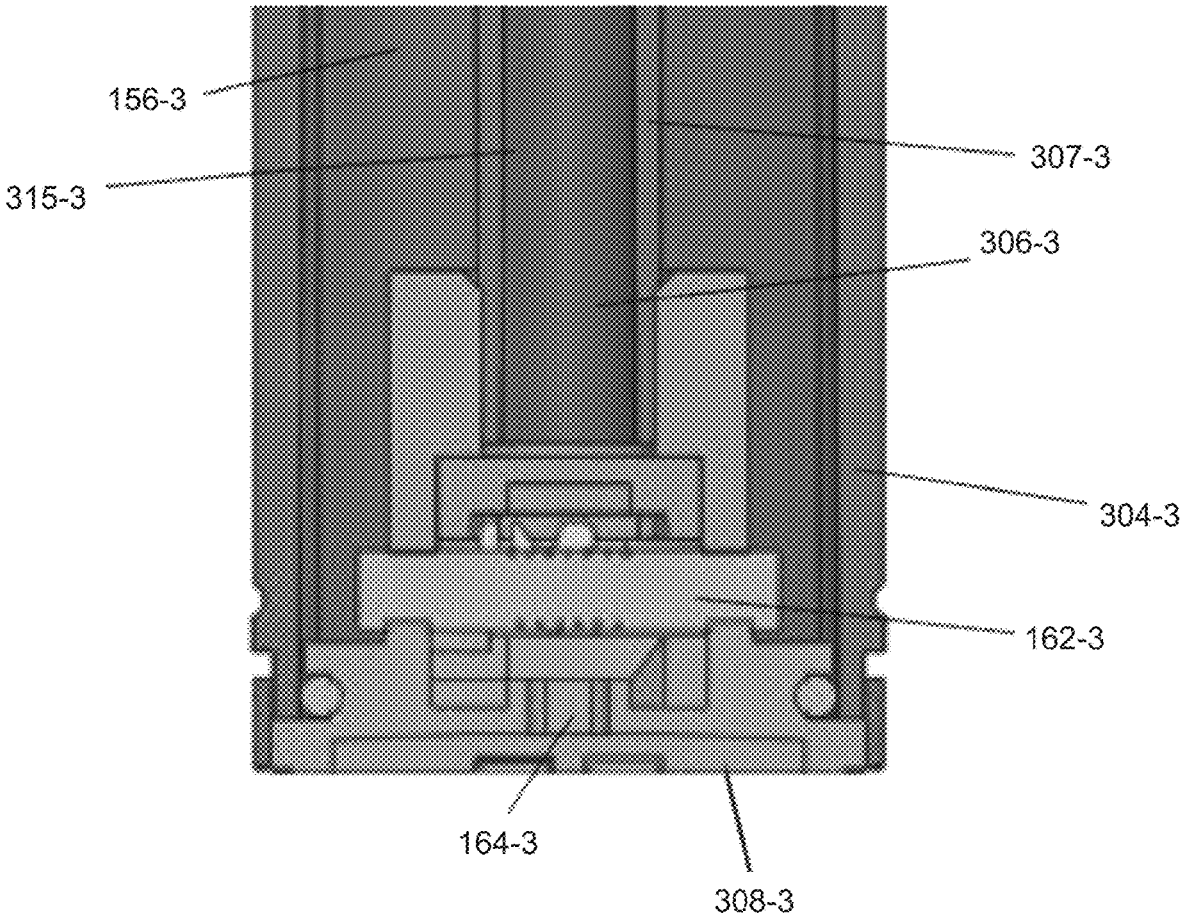
FIG. 13B is a cross-sectional view of the lower portion of the consumable of the third mode of the device showing the heating device.

As explained above, FIG. 13A shows the consumable without any detail of the heating assembly, for clarity. FIG. 13B shows the lower portion of the same consumable shown in FIG. 13A, but also shows the heating device 162-3, which in this example is a coil and wick assembly. The heating device 162-3 comprises an outer shell with one or more apertures. These apertures are filled with a wick material, so that e-liquid may only ingress the heating device 162-3 from the tank 156-3 via capillary action. The wick material passes through or proximal to a coil, which is connected to one or more electrical contacts.

The consumable 150-3 further comprises a tank seal 308-3, which seals a bottom portion of the tank 156-3 beneath the heating device 162-3. The tank seal 308-3 is connected to the heating device 162-3, and the tank seal 308-3 comprises an air inlet 164-3, such that air flow is permitted from outside the tank through the air inlet 164-3 to the heating device 162-3.

The tank 156-3, the outlet 306-3 and the mouthpiece 166-3 are integrally formed with each other. The tank 156-3, the outlet 306-3 and the mouthpiece 166-3 make up a single component formed from a continuous piece of material. The tank 156-3, the outlet 306-3 and the mouthpiece 166-3 are formed in an injection molding process as described below with respect to FIG. 14. The tank 156-3, the outlet 306-3 and the mouthpiece 166-3 are made of a thermoplastic material. More specifically, the tank 156-3, the outlet 306-3 and the mouthpiece 166-3 are made of polypropylene.

In use, when the consumable 150-3 is connected to the main body 120-3, the user inserts the mouthpiece 166-3 into their mouth. The user inhales through the mouthpiece aperture 314-3, which draws air through the air inlet 164-3 and into the heating device 162-3.

At the same time, an electrical current is provided to the one or more contacts, which causes heating of the coil, and consequent vaporization of the e-liquid within the wick material. The air flow passes through the coil and wick assembly, drawing with it vaporized e-liquid to form the aerosol vapor. The aerosol vapor flows up the outlet 306-3, before passing through the mouthpiece aperture 314-3, into the filter 330-3 and finally out of the filter 330-3, through the aperture 333-3 in the cap 331-3 and into the mouth of the user. The e-liquid only enters the coil and wick assembly via the one or more apertures and then, only via the wick.

The aerosol vapor flows through the void 315-3 of the outlet 306-3 and then passes through the mouthpiece aperture 314-3 and into the filtering portion 335-3 of the filter 330-3, which filters unvaporized e-liquid out of the aerosol vapor. Unvaporized e-liquid which remains in the aerosol vapor can condense and flow down the inner surface of the outlet 306-3. This further reduces leakage of unvaporized e-liquid into the user's mouth. Filtered vapor passes out of the filtering portion 335-3 of the filter 330-3, through the aperture 333-3 in the cap 331-3 of the filter 330-3 and into the mouth of the user.

Figure 14:
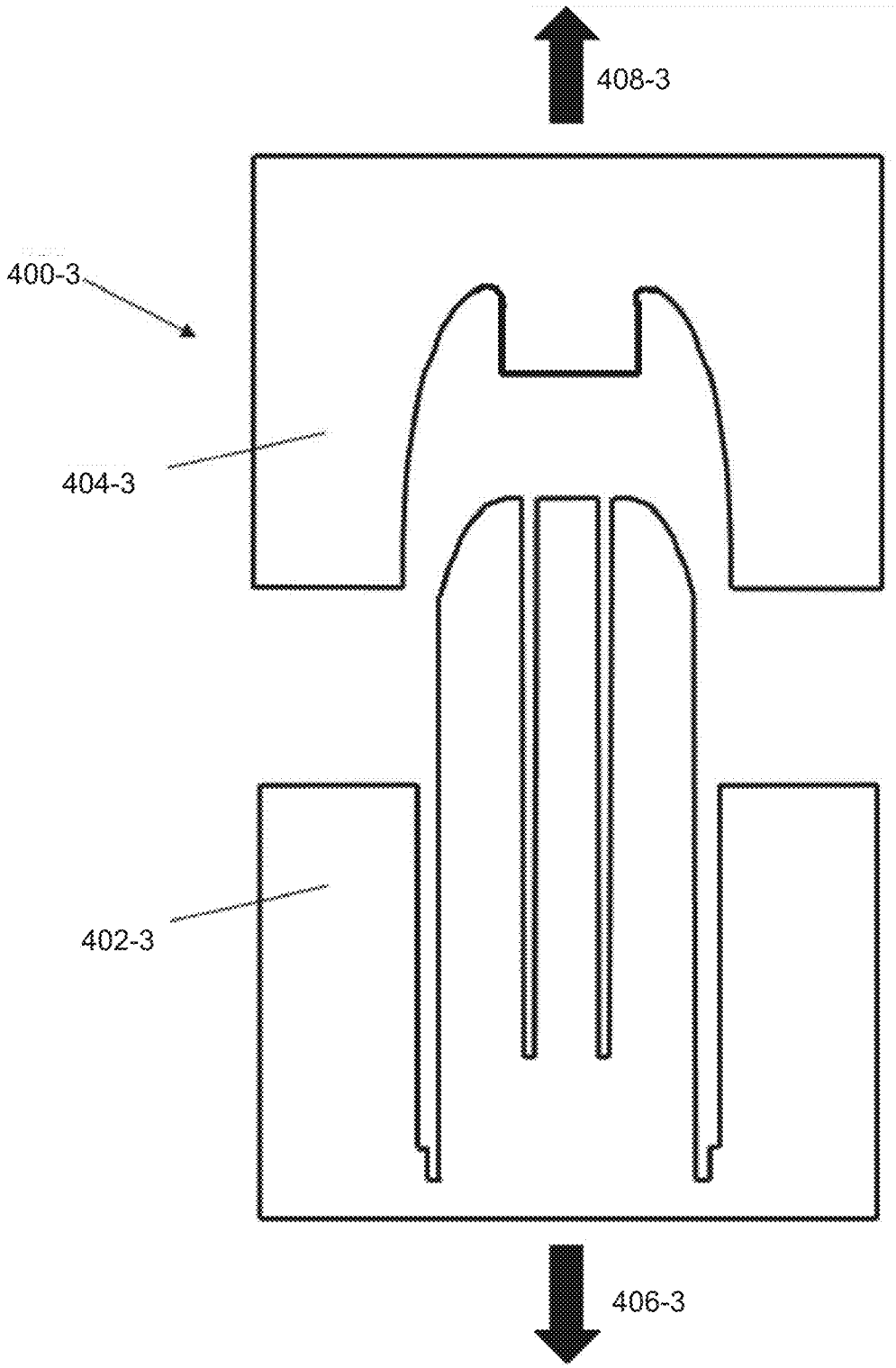
FIG. 14 is a cross-sectional view of a manufacturing assembly of the third mode of the device.

FIG. 14 shows a drawing of a manufacturing assembly 400-3 which is used to manufacture the consumable 150-3. The manufacturing assembly 400-3 comprises a first mold 402-3 and a second mold 404-3.

The first mold 402-3 has a shape which complements that of a first end (a lower end in FIG. 13A) of the integrally formed tank 156-3, mouthpiece 166-3 and outlet 306-3. The first mold 402-3 therefore has a shape which matches the inner surfaces of the tank 156-3, and the inner and outer surfaces of the outlet 306-3.

The second mold 404-3 has a shape which complements that of a second end (an upper end in FIG. 13A) of the integrally formed tank 156-3, mouthpiece 166-3 and outlet 306-3. The second mold 404-3 therefore has a shape which matches the outer surface 318-3 of the mouthpiece 166-3 and the inner surface 316-3 of the mouthpiece aperture 314-3.

When the first mold 402-3 and the second mold 404-3 are brought together, they define a closed cavity which has the shape of the tank 156-3, the mouthpiece 166-3 and the outlet 306-3.

To manufacture the tank 156-3, the mouthpiece 166-3 and the outlet 306-3, heated material is injected into the cavity between the first mold 402-3 and the second mold 404-3. At this point, the first mold 402-3 and the second mold 404-3 meet at a boundary between external surfaces of the mouthpiece 166-3 and the tank 156-3.

The material is subsequently cooled, and the first mold 402-3 and the second mold 404-3 are separated, with the first mold 402-3 travelling in the first demolding direction 406-3 (i.e., away from the second mold 404-3) and the second mold 404-3 travelling in a second demolding direction 408-3 (i.e., away from the first mold 402-3 and opposite to the first demolding direction 406-3). For a particular component, a demolding direction is a direction along which a mold which contacts that component is removed during an injection molding process.

The filter 330-3 can be inserted into the recess in the mouthpiece 166-3 either directly following manufacture and prior to shipping, or may be provided to the user separately who may then insert the filter 330-3 themselves before using the consumable.

Fourth Mode: An Aerosol Delivery Device for a Smoking Substitute System, Wherein a Pair of Contact Pins Having a Circular Cross Section Extend Through the Base of the Aerosol Delivery Device to Electrically Connect a Vaporizer to a Power Supply Aspects and embodiments of the fourth mode of the present disclosure will now be discussed with reference to the accompanying figures. Further aspects and embodiments will be apparent to those skilled in the art. All documents mentioned in this text are incorporated herein by reference.

Figure 15A:
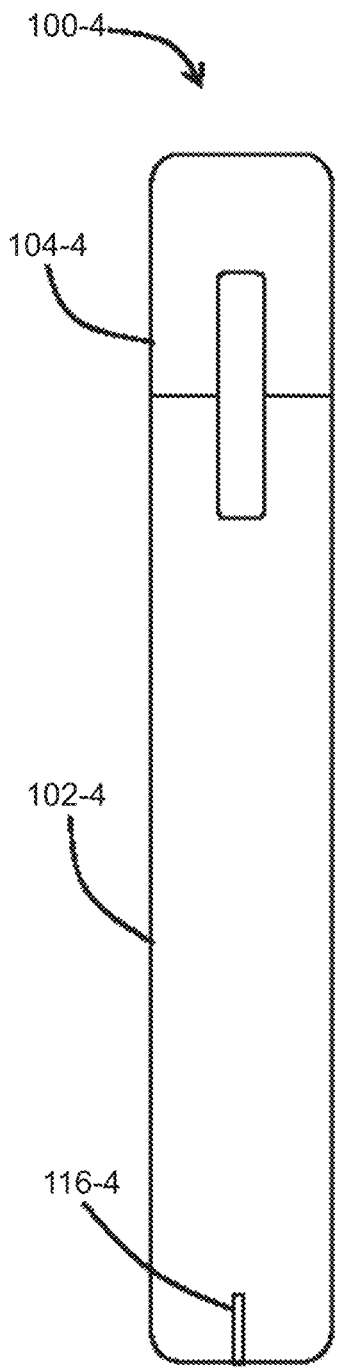
FIG. 15A is a front schematic view of a fourth mode of the smoking substitute system.

FIG. 15A shows a first embodiment of a smoking substitute system 100-4. In this example, the smoking substitute system 100-4 includes a main body 102-4 and an aerosol delivery device in the form of a consumable 104-4. The consumable 104-4 may alternatively be referred to as a "pod", "cartridge" or "cartomizer". It should be appreciated that in other examples (i.e., open systems), the main body may be integral with the consumable such that the aerosol delivery device incorporates the main body. In such systems, a tank of the aerosol delivery device may be accessible for refilling the device.

Figure 15B:
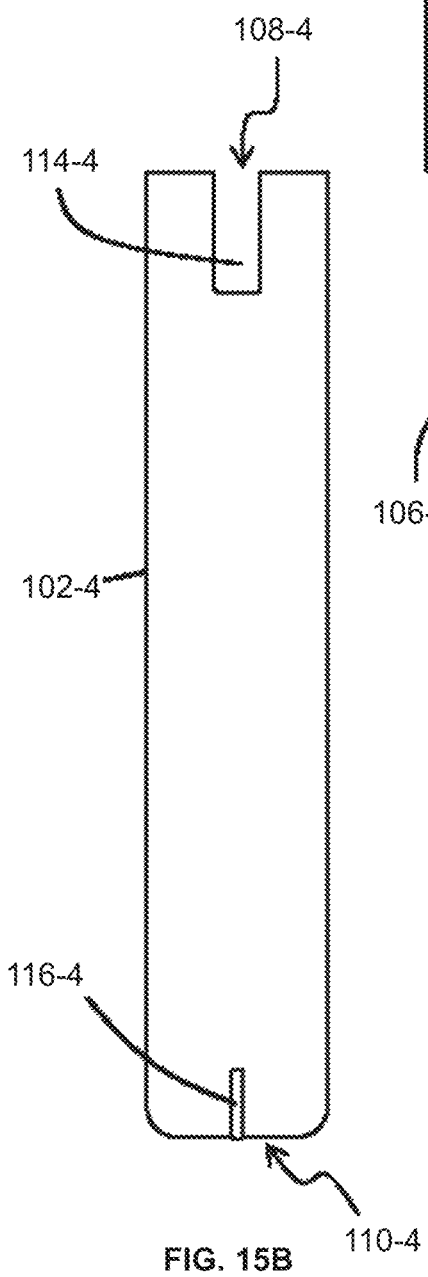
FIG. 15B is a front schematic view of a main body of the fourth mode of the system.
Figure 15C:
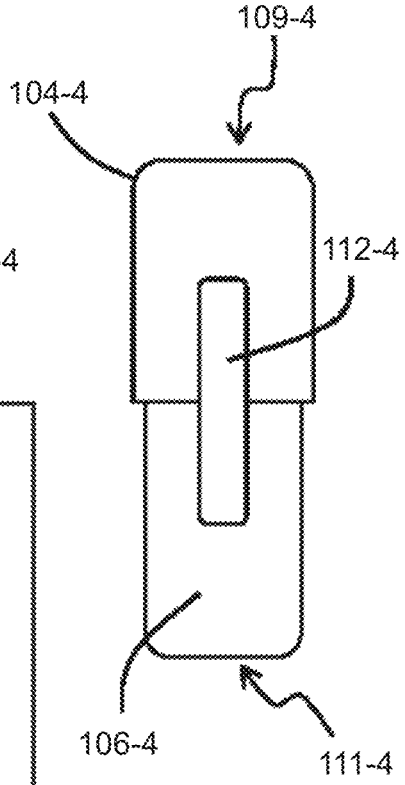
FIG. 15C is a front schematic view of a consumable of the fourth mode of the system.

In this example, the smoking substitute system 100-4 is a closed system vaping system, wherein the consumable 104-4 includes a sealed tank 106-4 and is intended for single-use only. The consumable 104-4 is removably engageable with the main body 102-4 (i.e., for removal and replacement). FIG. 15A shows the smoking substitute system 100-4 with the main body 102-4 physically coupled to the consumable 104-4, FIG. 15B shows the main body 102-4 of the smoking substitute system 100-4 without the consumable 104-4, and FIG. 15C shows the consumable 104-4 of the smoking substitute system 100-4 without the main body 102-4.

The main body 102-4 and the consumable 104-4 are configured to be physically coupled together by pushing the consumable 104-4 into a cavity at an upper end 108-4 of the main body 102-4, such that there is an interference fit between the main body 102-4 and the consumable 104-4. In other examples, the main body 102-4 and the consumable 104-4 may be coupled by screwing one onto the other, or through a bayonet fitting.

The consumable 104-4 includes a mouthpiece (not shown in FIGS. 15A-15C) at an upper end 109-4 of the consumable 104-4, and one or more air inlets (not shown) in fluid communication with the mouthpiece such that air can be drawn into and through the consumable 104-4 when a user inhales through the mouthpiece. The tank 106-4 containing e-liquid is located at the lower end 111-4 of the consumable 104-4.

The tank 106-4 includes a window 112-4, which allows the amount of e-liquid in the tank 106-4 to be visually assessed. The main body 102-4 includes a slot 114-4 so that the window 112-4 of the consumable 104-4 can be seen whilst the rest of the tank 106-4 is obscured from view when the consumable 104-4 is inserted into the cavity at the upper end 108-4 of the main body 102-4.

The lower end 110-4 of the main body 102-4 also includes a light 116-4 (e.g., an LED) located behind a small translucent cover. The light 116-4 may be configured to illuminate when the smoking substitute system 100-4 is activated. While not shown, the consumable 104-4 may identify itself to the main body 102-4, via an electrical interface, RFID chip, or barcode.

Figure 16A:
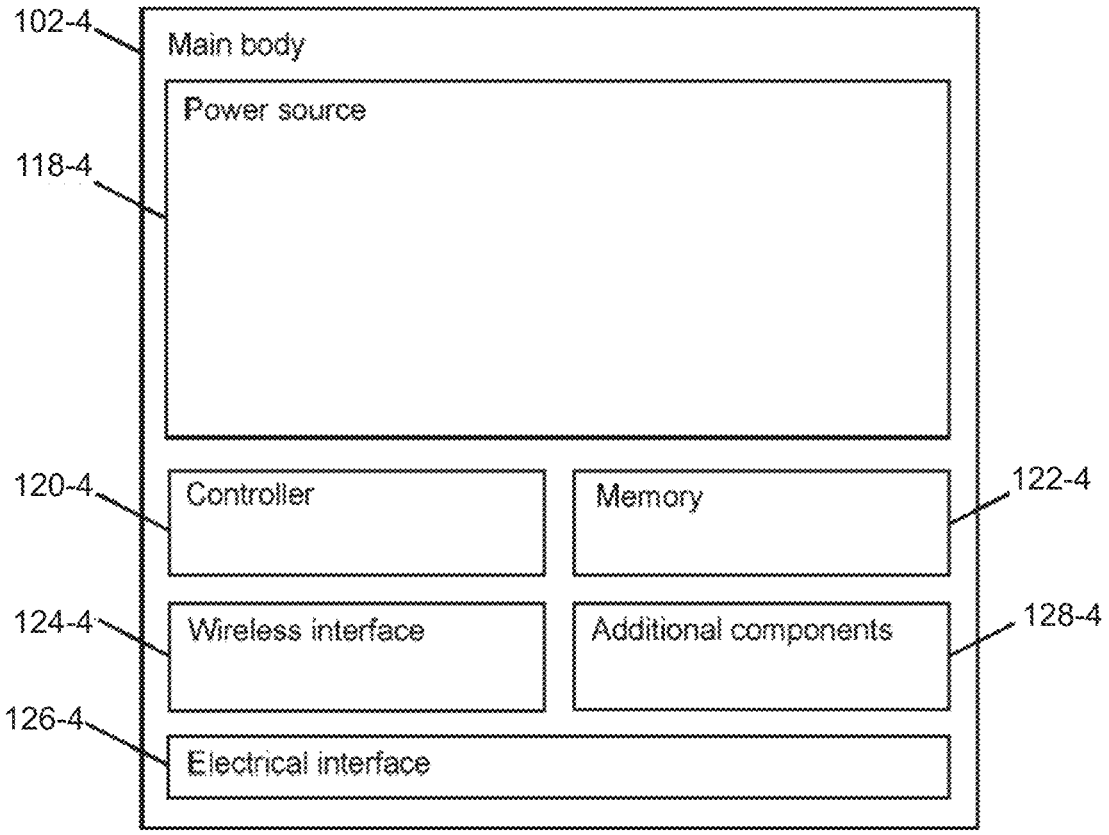
FIG. 16A is a schematic of the components of the main body of the fourth mode of the system.
Figure 16B:
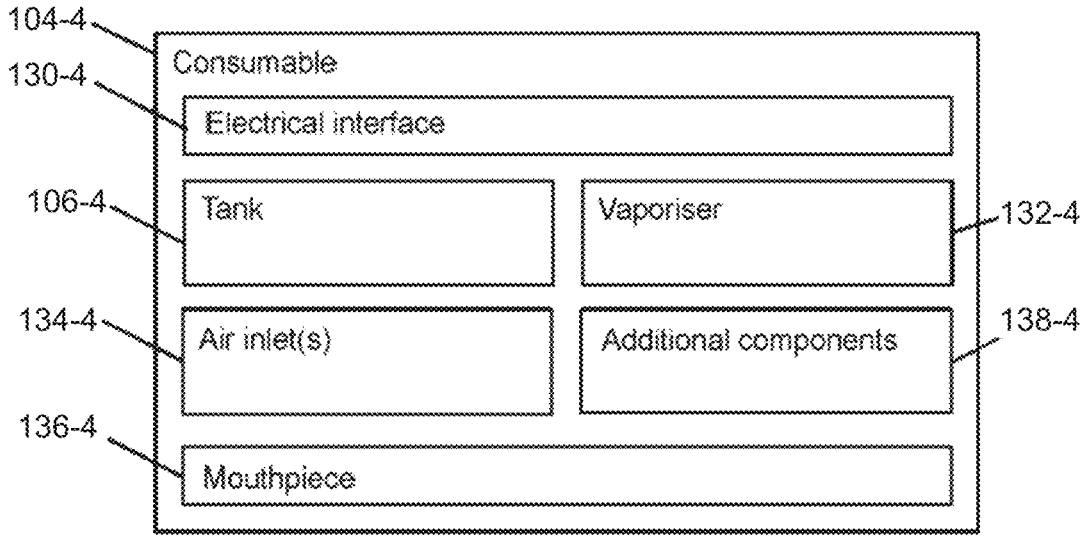
FIG. 16B is a schematic of the components of the consumable of the fourth mode of the system.

FIGS. 16A-16B are schematic drawings of the main body 102-4 and consumable 104-4. As is apparent from FIG. 16A, the main body 102-4 includes a power source 118-4, a controller 120-4, a memory 122-4, a wireless interface 124-4, an electrical interface 126-4, and, optionally, one or more additional components 128-4.

The power source 118-4 is preferably a battery, more preferably a rechargeable battery. The controller 120-4 may include a microprocessor, for example. The memory 122-4 preferably includes non-volatile memory. The memory may include instructions which, when implemented, cause the controller 120-4 to perform certain tasks or steps of a method.

The wireless interface 124-4 is preferably configured to communicate wirelessly with another device, for example a mobile device, e.g., via Bluetooth®. To this end, the wireless interface 124-4 could include a Bluetooth® antenna. Other wireless communication interfaces, e.g., Wi-Fi®, are also possible. The wireless interface 124-4 may also be configured to communicate wirelessly with a remote server.

The electrical interface 126-4 may be located in a base of the aperture in the upper end 108-4 of the main body 102-4. When the main body 102-4 is physically coupled to the consumable 104-4, the electrical interface 126-4 is configured to transfer electrical power from the power source 118-4 to the consumable 104-4 (i.e., upon activation of the smoking substitute system 100-4).

The electrical interface 126-4 may be configured to receive power from a charging station when the main body 102-4 is not physically coupled to the consumable 104-4 and is instead coupled to the charging station. The electrical interface 126-4 may also be used to identify the consumable 104-4 from a list of known consumables. For example, the consumable 104-4 may be a particular flavor and/or have a certain concentration of nicotine (which may be identified by the electrical interface 126-4). This can be indicated to the controller 120-4 of the main body 102-4 when the consumable 104-4 is connected to the main body 102-4. Additionally, or alternatively, there may be a separate communication interface provided in the main body 102-4 and a corresponding communication interface in the consumable 104-4 such that, when connected, the consumable 104-4 can identify itself to the main body 102-4.

The additional components 128-4 of the main body 102-4 may comprise the light 116-4 discussed above.

The additional components 128-4 of the main body 102-4 may also comprise a charging port (e.g., USB or micro-USB port) configured to receive power from the charging station (i.e., when the power source 118-4 is a rechargeable battery). This may be located at the lower end 110-4 of the main body 102-4. Alternatively, the electrical interface 126-4 discussed above may be configured to act as a charging port configured to receive power from the charging station such that a separate charging port is not required.

The additional components 128-4 of the main body 102-4 may, if the power source 118-4 is a rechargeable battery, include a battery charging control circuit, for controlling the charging of the rechargeable battery. However, a battery charging control circuit could equally be located in the charging station (if present).

The additional components 128-4 of the main body 102-4 may include a sensor, such as an airflow (i.e., puff) sensor for detecting airflow in the smoking substitute system 100-4, e.g., caused by a user inhaling through a mouthpiece 136-4 of the consumable 104-4. The smoking substitute system 100-4 may be configured to be activated when airflow is detected by the airflow sensor. This sensor could alternatively be included in the consumable 104-4. The airflow sensor can be used to determine, for example, how heavily a user draws on the mouthpiece or how many times a user draws on the mouthpiece in a particular time period.

The additional components 128-4 of the main body 102-4 may include a user input, e.g., a button. The smoking substitute system 100-4 may be configured to be activated when a user interacts with the user input (e.g., presses the button). This provides an alternative to the airflow sensor as a mechanism for activating the smoking substitute system 100-4.

As shown in FIG. 16B, the consumable 104-4 includes the tank 106-4, an electrical interface 130-4, a vaporizer 132-4, one or more air inlets 134-4, a mouthpiece 136-4, and one or more additional components 138-4.

The electrical interface 126-4 of the main body 102-4 and an electrical interface 130-4 of the consumable 104-4 are configured to contact each other and thereby electrically couple the main body 102-4 to the consumable 104-4 when the lower end 111-4 of the consumable 104-4 is inserted into the upper end 108-4 of the main body 102-4 (as shown in FIG. 15A). In this way, electrical energy (e.g., in the form of an electrical current) is able to be supplied from the power source 118-4 in the main body 102-4 to the vaporizer 132-4 in the consumable 104-4.

The vaporizer 132-4 is configured to heat and vaporize e-liquid contained in the tank 106-4 using electrical energy supplied from the power source 118-4. As will be described further below, the vaporizer 132-4 includes a heating filament and a wick. The wick draws e-liquid from the tank 106-4 and the heating filament heats the e-liquid to vaporize the e-liquid.

The air inlets 134-4 (visible in FIG. 18B) are preferably configured to allow air to be drawn into the smoking substitute system 100-4, when a user inhales through the mouthpiece 136-4. When the consumable 104-4 is physically coupled to the main body 102-4, the air inlets 134-4 receive air, which flows to the air inlets 134-4 along a gap between the main body 102-4 and the lower end 111-4 of the consumable 104-4.

In operation, a user activates the smoking substitute system 100-4, e.g., through interaction with a user input forming part of the main body 102-4 or by inhaling through the mouthpiece 136-4 as described above. Upon activation, the controller 120-4 may supply electrical energy from the power source 118-4 to the vaporizer 132-4 (via electrical interfaces 126-4, 130-4), which may cause the vaporizer 132-4 to heat e-liquid drawn from the tank 106-4 to produce a vapor which is inhaled by a user through the mouthpiece 136-4.

An example of one of the one or more additional components 138-4 of the consumable 104-4 is an interface for obtaining an identifier of the consumable 104-4. As discussed above, this interface may be, for example, an RFID reader, a barcode, a QR code reader, or an electronic interface which is able to identify the consumable. The consumable 104-4 may, therefore include any one or more of an RFID chip, a barcode or QR code, or memory within which is an identifier, and which can be interrogated via the electronic interface in the main body 102-4.

It should be appreciated that the smoking substitute system 100-4 shown in FIGS. 15A-16B is just one exemplary implementation of a smoking substitute system. For example, the system could otherwise be in the form of an entirely disposable (single-use) system or an open system in which the tank is refillable (rather than replaceable).

Figure 17:
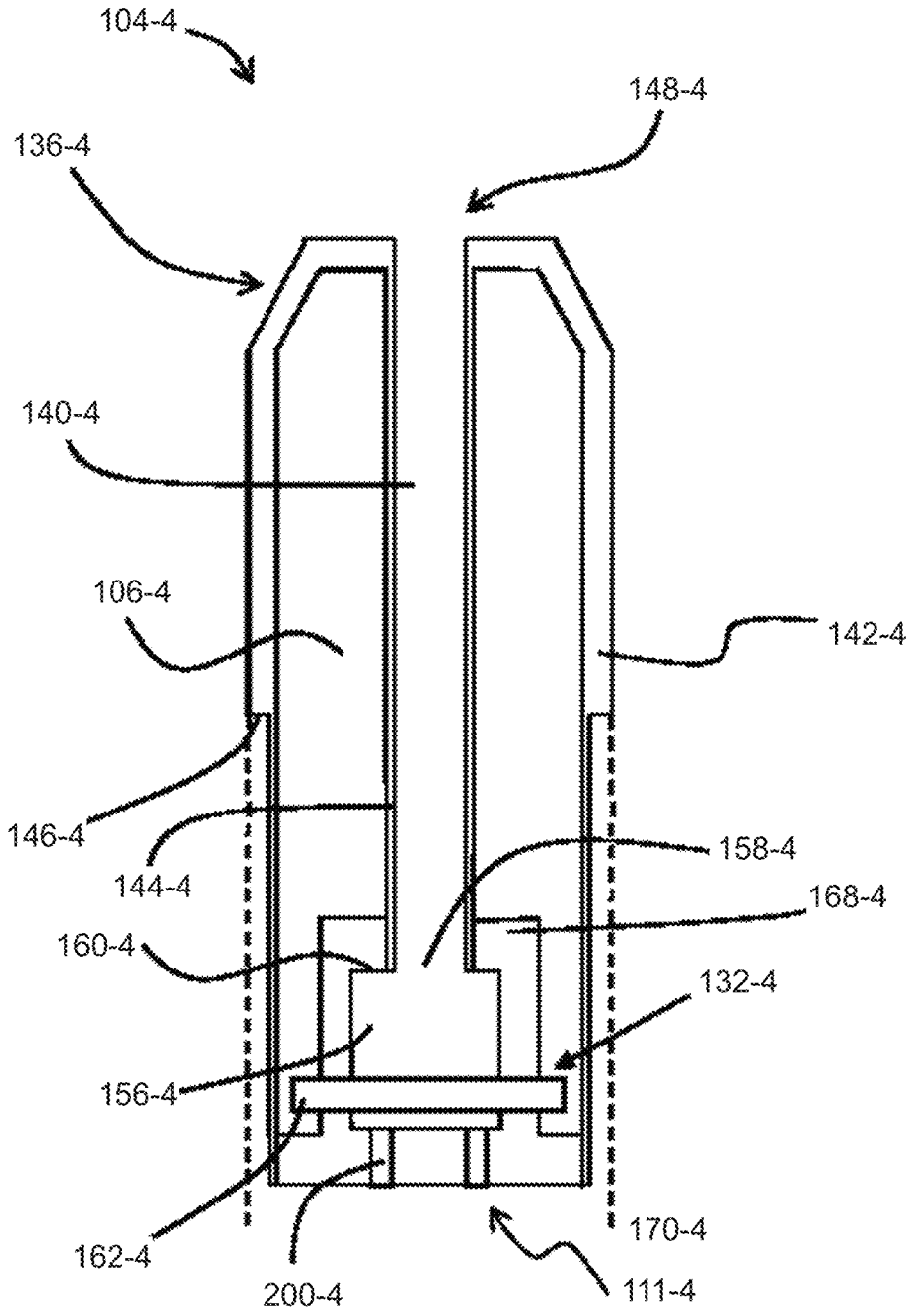
FIG. 17 is a section view of the consumable of the fourth mode of the system.

FIG. 17 is a section view of the consumable 104-4 described above. The consumable 104-4 comprises a tank 106-4 for storing e-liquid, a mouthpiece 136-4 and a passage 140-4 extending along a longitudinal axis of the consumable 104-4. In the illustrated embodiment, the passage 140-4 is in the form of a tube having a substantially circular transverse cross-section (i.e., transverse to the longitudinal axis). The tank 106-4 surrounds the passage 140-4, such that the passage 140-4 extends centrally through the tank 106-4.

A tank housing 142-4 of the tank 106-4 defines an outer casing of the consumable 104-4, whilst a passage wall 144-4 defines the passage 140-4. The tank housing 142-4 extends from the lower end 111-4 of the consumable 104-4 to the mouthpiece 136-4 at the upper end 109-4 of the consumable 104-4. At the junction between the mouthpiece 136-4 and the tank housing 142-4, the mouthpiece 136-4 is wider than the tank housing 142-4, so as to define a lip 146-4 that overhangs the tank housing 142-4. This lip 146-4 acts as a stop feature when the consumable 104-4 is inserted into the main body 102-4 (i.e., by contact with an upper edge of the main body 102-4).

The tank 106-4, the passage 140-4 and the mouthpiece 136-4 are integrally formed with each other so as to form a single unitary component. This component may be formed by way of an injection molding process and, for example, may be formed of a thermoplastic material such as polypropylene.

Although not immediately apparent from the figures, the tank housing 142-4 tapers, such that the thickness of the tank housing 142-4 decreases in a downward direction away from the mouthpiece 136-4. This means that, aside from a small number of indents (which provide physical connection between the consumable 104-4 and the main body 102-4), the thickness of the tank housing 142-4 decreases with increasing distance away from the mouthpiece 136-4. In particular, the tank housing 142-4 tapers in this way, because internal and external surfaces of the tank housing 142-4 are angled with respect to the downward direction away from the mouthpiece 136-4. This tapering assists in forming the tank housing 142-4 and passage wall 144-4 as a single (i.e., unitary) component.

Like the tank housing 142-4, the passage wall 144-4 is also tapered such that the thickness of the passage wall 144-4 decreases in the downward direction away from the mouthpiece 136-4. Again, the thickness of the passage wall 144-4 decreases due to internal and external surfaces of the passage wall 144-4 being angled with respect to this downward direction. As a result of the tapering of the passage wall 144-4, the passage 140-4 has an internal diameter that decreases in a downstream direction (i.e., an upward direction in FIG. 17). For example, the passage 140-4 has an internal width less than 4.0 mm and greater than 3.0 mm at an upstream end of the passage 140-4 (e.g., approximately 3.6 mm). On the other hand, the passage 140-4 has an internal width of less than 3.8 mm and greater than 2.8 mm at the downstream end of the passage 140-4 (e.g., approximately 3.4 mm).

The mouthpiece 136-4 comprises a mouthpiece aperture 148-4 defining an outlet of the passage 140-4. Although not shown in the figures, the mouthpiece aperture 148-4 has a radially inwardly directed inner surface, which joins an outer surface of the mouthpiece 136-4 (i.e., a surface which contacts a user's lips in use) at an outer edge of the mouthpiece aperture 148-4. At this outer edge, the included angle between the inner surface of the mouthpiece aperture 148-4 and the outer surface of the mouthpiece 136-4 (i.e., the "mouthpiece angle") is greater than 90 degrees. This may be due to the outer edge being rounded. This edge may otherwise be chamfered or beveled.

The vaporizer 132-4 is located in a vaporizing chamber 156-4 of the consumable 104-4. The vaporizing chamber 156-4 is downstream of a plurality of device air inlets 134-4 of the consumable 104-4 and is fluidly connected to the mouthpiece aperture 148-4 (i.e., outlet) by the passage 140-4. In particular, the passage 140-4 extends between the mouthpiece aperture 148-4 and an opening 158-4 from the chamber 156-4. This opening 158-4 is formed in a downstream (i.e., upper) wall 160-4 of the chamber 156-4.

The lower end 111-4 (i.e., base) of the consumable 104-4 that connects with the main body 102-4 is defined by a base insert 170-4. The base insert 170-4 is inserted into an open lower end of the tank 106-4 so as to seal against the tank housing 142-4.

The vaporizer 132-4 comprises a porous wick 162-4 and a heater filament 164-4 (not shown in FIG. 17, but described in more detail below in relation to FIGS. 18A-18C) coiled around the porous wick 162-4. The wick 162-4 extends transversely across the chamber 156-4 between sidewalls of the chamber 156-4 which form part of an inner sleeve 168-4 of the base insert 170-4.

The inner sleeve 168-4 projects into the tank 106-4 and seals with the passage 140-4 (around the passage wall 144-4) so as to separate the chamber 156-4 from the e-liquid in the tank 106-4. Transverse ends of the wick 162-4 project into the tank 106-4 so as to be in contact with the e-liquid in the tank 106-4. In this way, e-liquid is transported along the wick 162-4 (e.g., by capillary action) to a central portion of the wick 162-4 that is exposed to airflow through the chamber 156-4. The transported e-liquid is heated by the heater filament 164-4 (when activated, e.g., by detection of inhalation), which causes the e-liquid to be vaporized and to be entrained in air flowing past the wick 162-4. This vaporized liquid may cool to form an aerosol in the passage 140-4, which may then be inhaled by a user.

Figure 18A:
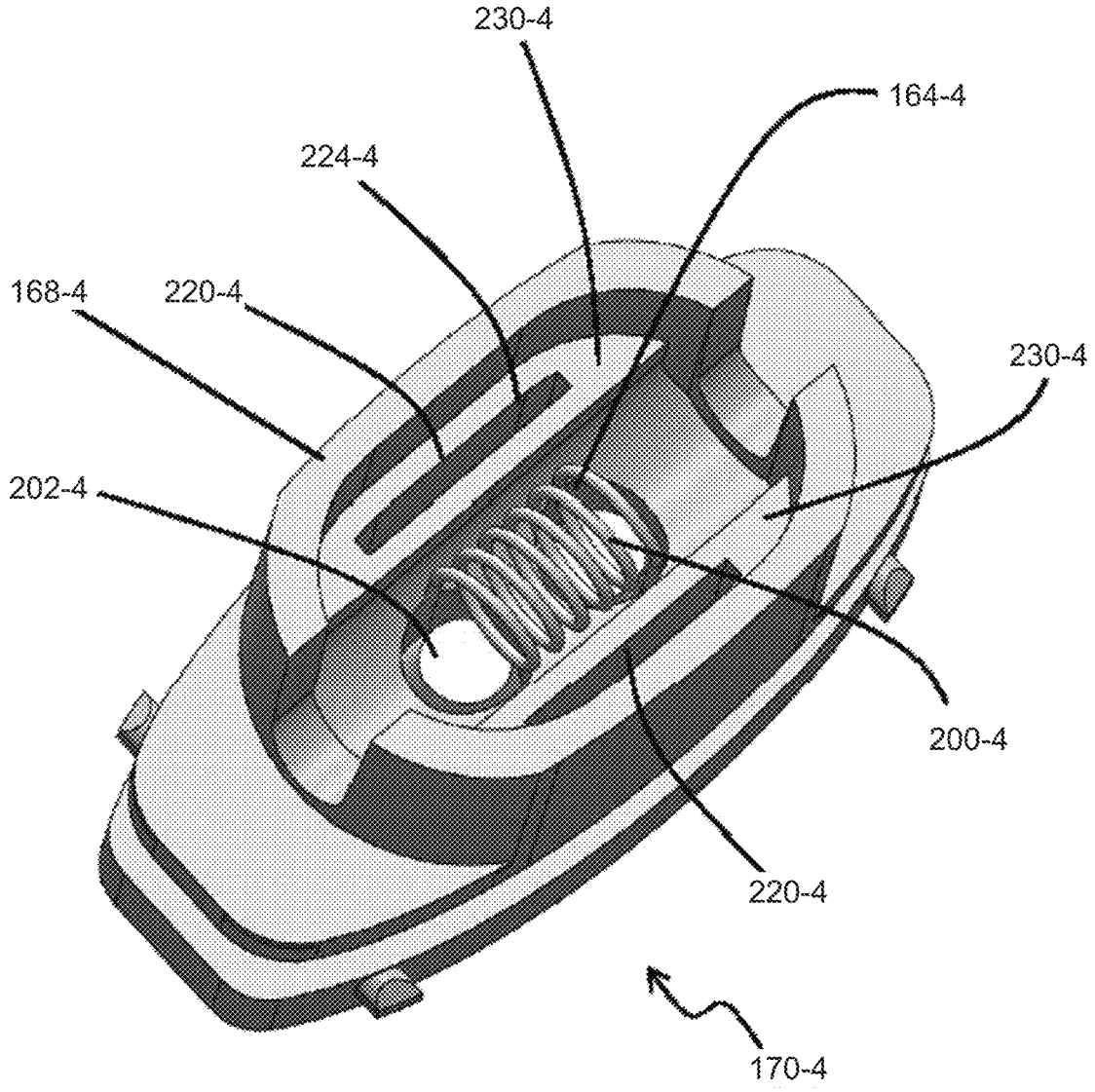
FIG. 18A is a perspective view of a base portion of the consumable of the fourth mode of the system.

FIG. 18A illustrates the base insert 170-4 of the consumable 104-4. FIG. 18A also illustrates the coiled heater filament 164-4 but does not show the wick 162-4. A pair of contact pins 200-4 having a circular cross section in the longitudinal direction are embedded in the base portion 170-4. As is more clearly shown in FIG. 18C, the contact pins 200-4 extend through the base portion 170-4 in a direction substantially parallel to the longitudinal axis of the consumable 104-4.

An upper (downstream) face 202-4 of each of the pair of contact pins 200-4 is electrically connected to respective ends of the heater filament 164-4. The upper face 202-4 of each of the pair of contact pins 200-4 is also physically connected to respective ends of the heater filament 164-4.

The upper faces 202-4 of the contact pins 200-4 may be connected to the heater filament 164-4 by crimping, welding, or compressing.

Figure 18B:
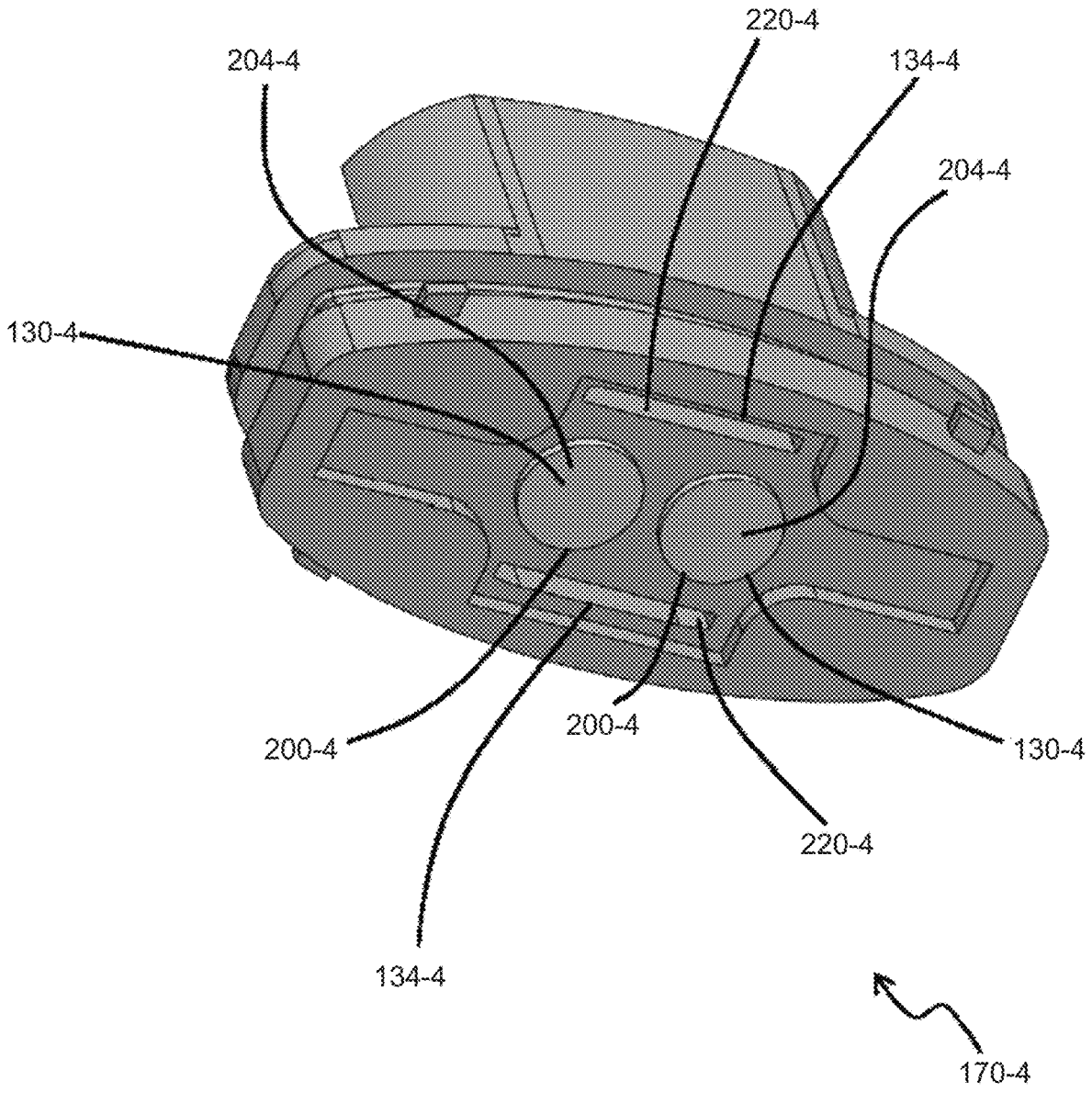
FIG. 18B is an alternative perspective view of the base portion of FIG. 18A.

As shown in FIG. 18B, a lower (upstream) face 204-4 of each of the contact pins 200-4 comprises the electrical interface 130-4 for interfacing with the corresponding electrical interface 126-4 on the main body 102-4. Thus, when the consumable 104-4 is engaged with the main body 102-4, the lower faces 204-4 of the contact pins 200-4 contact corresponding electrical contacts on the main body 102-4. As the main body electrical contacts are electrically connected to the power source 118-4, power can be supplied by the main body 102-4, via the contact pins 200-4, to the filament 164-4 in order to heat the filament 164-4.

The contact pins 200-4 are aligned with each other in a transverse direction perpendicular to the longitudinal direction of the device. The contact pins 200-4 are also transversely aligned parallel to the transversely extending wick 162-4. The wick 162-4 overlies the contact pins 200-4 in the longitudinal direction.

Figure 18C:
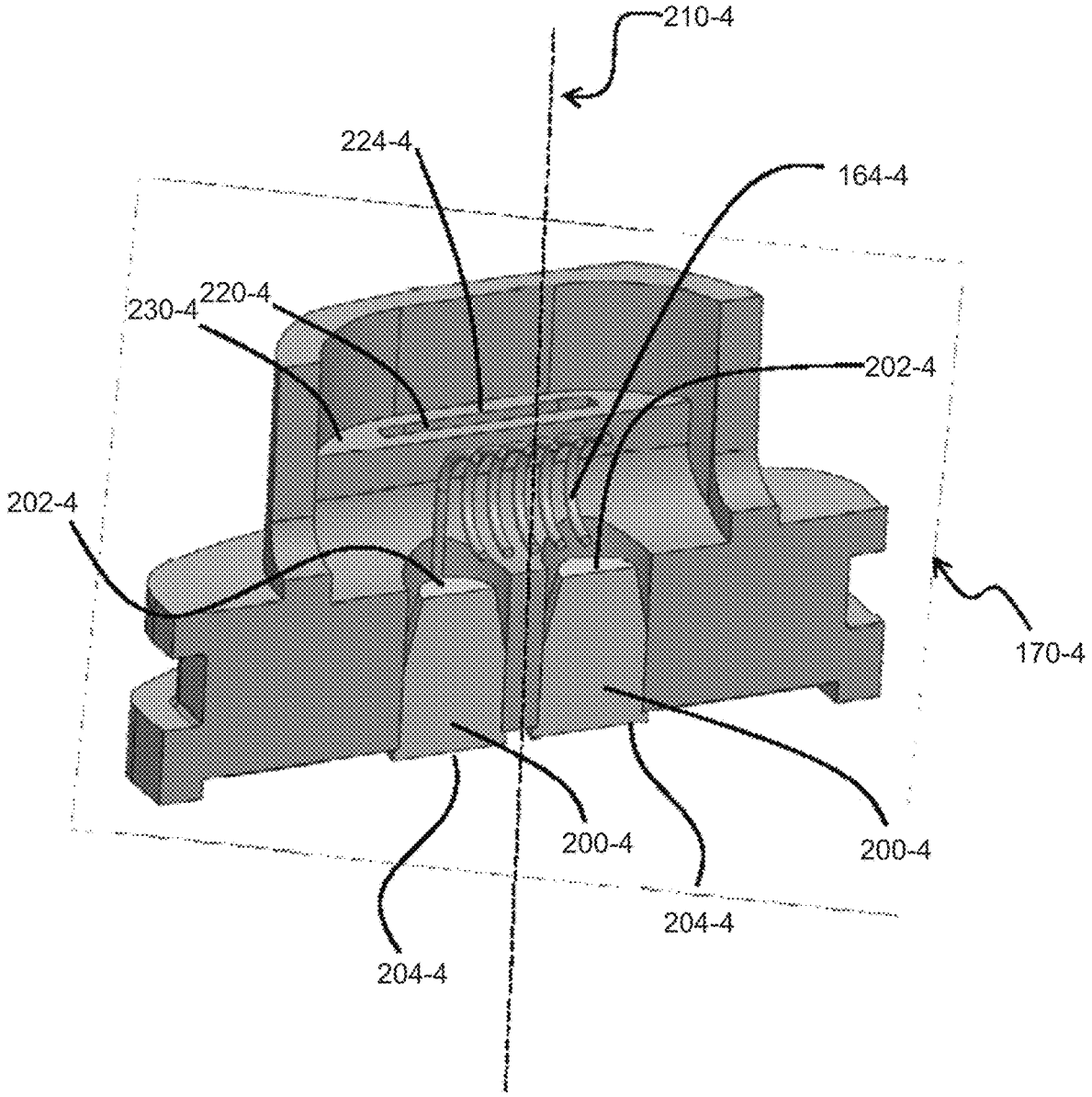
FIG. 18C is a section view of the base portion of FIG. 18A.

Furthermore, as shown more clearly in FIG. 18C, the connection between the upper face 202-4 of each contact pin 200-4 and the heater filament 164-4 is located upstream of the heater filament 164-4 and wick 162-4.

As shown in FIG. 18C, the heating filament 164-4 and the wick 162-4 are positioned to overlie the axial center of the base insert 170-4. Accordingly, the heating filament 164-4 and wick 162-4 are centrally positioned in the consumable 104-4 in the transverse plane relative to the longitudinal axis of the consumable 104-4, such that the central longitudinal axis 210-4 of the consumable 104-4 intersects the heating filament 164-4 and wick 162-4.

Each contact pin 200-4 is spaced in the transverse direction from the central longitudinal axis 210-4 of the consumable 104-4. Specifically, each contact pin 200-4 is spaced from the central longitudinal axis 210-4 of the consumable 104-4 by a same distance on either side of the central longitudinal axis 210-4.

Each of the contact pins 200-4 is substantially cylindrical. However, as shown in FIGS. 18A-18C, each contact pin 200-4 tapers towards the upper face 202-4, which is connected to the heating filament 164-4.

The contact pins 200-4 may be formed from a metal/metal alloy with high electrical conductivity. The contact pins 200-4 may be formed from one or more of silver, copper, gold, platinum, palladium, tungsten, nickel, graphite, molybdenum, for example.

As previously mentioned, the heating filament 164-4 and wick 162-4 are positioned within a vaporizing chamber 156-4. As shown in FIGS. 18A-18C, a pair of inlet channels 220-4 extend through the base insert 170-4 into the vaporizing chamber 156-4. The inlet channels 220-4 extend in a generally longitudinal direction of the device. They allow air to flow through the base insert 170-4 from device inlets 134-4 at the lowermost surface 111-4 of the consumable 104-4 (i.e., lowermost surface of the base portion 170-4), through openings 224-4 into the vaporizing chamber 156-4. Thus, by drawing on the mouthpiece 136-4, a user may draw air through the device inlets 134-4, the inlets channels 220-4, the vaporizing chamber 156-4, the passage 140-4, and out through the aperture 148-4 in the mouthpiece 136-4.

In FIGS. 18A-18C, the two openings 224-4 of the inlet channels 220-4 are transversely offset from the central longitudinal axis 210-4 of the consumable 104-4 on either side of the central longitudinal axis 210-4 in the front to rear direction. The two openings 224-4 of the inlet channels 220-4 are equally spaced from the central longitudinal axis 210-4 of the aerosol delivery device on either side of the central longitudinal axis 210-4. They are aligned with each other in the front to rear direction.

The openings 224-4 of the inlet channels 220-4 are formed in perpendicular stepped portions 230-4 in the front and rear walls of the vaporizing chamber 156-4. The stepped portions 230-4 in the front and rear walls, and therefore the openings 224-4 of the inlet channels 220-4, are axially downstream of the heating filament 164-4 and the wick 162-4.

The openings 224-4 of the inlet channels 220-4 are elongated in the transverse direction such that they extend substantially parallel to the transversely-extending wick 162-4. The device inlets 222-4 at the lowermost surface 111-4 of the base portion 170-4 are also elongated in the transverse direction such that they extend substantially parallel to the transverse axis through the lower faces 204-4 of the contact pins 200-4 on the lowermost surface of the base portion.

CONCLUSION

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful and is not intended to exclude other embodiments from the scope of the disclosure, or from the scope of the claims.

What is claimed is:

1. An aerosol delivery device having a vaporizing chamber, the vaporizing chamber housing a vaporizer for vaporizing a vaporizable liquid and a transverse airflow-directing baffle mounted downstream from the vaporizer in a direction towards an outlet of the device, the transverse airflow-directing baffle defining at least one aperture through which a chamber airflow path extends downstream of the vaporizer, wherein an upstream face of the transverse airflow-directing baffle facing the vaporizer comprises a recessed surface, wherein an inlet to the vaporizing chamber and the transverse airflow-directing baffle are transversely aligned on a longitudinal axis.

2. A device according to claim 1, wherein the recessed surface is a planar surface.

3. A device according to claim 1, wherein the recessed surface comprises at least one sloped surface sloping to at least one gutter on the upstream face of the transverse airflow-directing baffle.

4. A device according to claim 1, wherein the recessed surface is defined by a recess wall, wherein the recess wall is substantially vertical or sloped.

5. A device according to claim 1, wherein the recessed surface comprises a plurality of ridges and a plurality of gutters extending in a front to back direction of the device perpendicular to transverse and longitudinal directions of the device.

6. An aerosol delivery device having a vaporizer for vaporizing a vaporizable liquid and a transverse airflow-directing baffle mounted downstream from the vaporizer in a direction towards an outlet of the device, the transverse airflow-directing baffle defining at least one aperture through which an airflow path extends downstream of the vaporizer, wherein an upstream face of the transverse airflow-directing baffle facing the vaporizer comprises at least one sloped surface, the at least one sloped surface sloping to at least one gutter on the upstream face of the transverse airflow-directing baffle.

7. A device according to claim 6, wherein the transverse airflow-directing baffle and vaporizer are both mounted in a vaporizing chamber.

8. A device according to claim 6, wherein the at least one gutter extends in a transverse direction or in a front to back direction of the device.

9. A device according to claim 6, wherein the upstream face of the transverse airflow-directing baffle facing the vaporizer comprises a recessed surface comprising the at least one sloped surface.

10. A device according to claim 9, wherein the recessed surface is defined by a recess wall, wherein the recess wall is substantially vertical or sloped.

11. A device according to claim 10, wherein the recessed surface has a waist portion adjacent the or each aperture, the recessed surface having at least one transversely elongated channel adjacent the waist portion.

12. A device according to claim 11, wherein the at least one gutter is a transverse gutter extending in the at least one channel.

13. A device according to claim 6, wherein the upstream face comprises one or more pairs of sloped surfaces which meet at a ridge.

14. A device according to claim 13, wherein the upstream face of the transverse airflow-directing baffle comprises a transverse ridge with two sloped surfaces each sloping to a respective one of two transverse gutters.

15. A device according to claim 14, wherein the upstream face comprises a plurality of ridges and a plurality of gutters extending in a front to back direction of the device perpendicular to the transverse and longitudinal directions.

16. A smoking substitute system comprising:

a main body comprising a power source; and a device according to claim 1, the device engageable with the main body such that the vaporizer of the device is electrically connected to the power source of the main body.

* * * * *